US011864719B2

(12) United States Patent
Brown et al.

(10) Patent No.: US 11,864,719 B2
(45) Date of Patent: Jan. 9, 2024

(54) BATTERY AND SUCTION MOTOR ASSEMBLY FOR A SURFACE TREATMENT APPARATUS AND A SURFACE TREATMENT APPARATUS HAVING THE SAME

(71) Applicant: SharkNinja Operating, LLC, Needham, MA (US)

(72) Inventors: Andre D. Brown, Natick, MA (US); Jason B. Thorne, Dover, MA (US); Kai Xu, Suzhou (CN); Sam Liu, Needham, MA (US); Lee Cottrell, Needham, MA (US)

(73) Assignee: SharkNinja Operating LLC, Needham, MA (US)

( * ) Notice: Subject to any disclaimer, the term of this patent is extended or adjusted under 35 U.S.C. 154(b) by 67 days.

(21) Appl. No.: 16/562,989

(22) Filed: Sep. 6, 2019

(65) Prior Publication Data

US 2020/0077855 A1 Mar. 12, 2020

Related U.S. Application Data

(60) Provisional application No. 62/730,337, filed on Sep. 12, 2018, provisional application No. 62/728,165, filed on Sep. 7, 2018.

(51) Int. Cl.

| | |
|---|---|
| ***A47L 9/28*** | (2006.01) |
| ***A47L 5/28*** | (2006.01) |
| ***A47L 9/32*** | (2006.01) |

(52) U.S. Cl.

CPC ..... *A47L 9/2842* (2013.01); *A47L 5/28* (2013.01); *A47L 9/2857* (2013.01); *A47L 9/2884* (2013.01); *A47L 9/325* (2013.01)

(58) Field of Classification Search

CPC ..... A47L 9/2857; A47L 9/2884; A47L 9/325; A47L 5/28; A47L 9/2842; A47L 5/225; A47L 5/36; A47L 9/2836

See application file for complete search history.

(56) References Cited

U.S. PATENT DOCUMENTS

| | | | |
|---|---|---|---|
| 1,983,567 | A | 12/1934 | Replogle et al. |
| 2,677,846 | A | 5/1954 | Segesman |

(Continued)

FOREIGN PATENT DOCUMENTS

| | | |
|---|---|---|
| CN | 2303758 | 1/1999 |
| CN | 2324840 | 6/1999 |

(Continued)

OTHER PUBLICATIONS

PCT Search Report and Written Opinion dated Sep. 10, 2019, received in PCT Application No. PCT/US19/38303, 9 pgs.

(Continued)

*Primary Examiner* — Don M Anderson
*Assistant Examiner* — Sarah Akyaa Fordjour
(74) *Attorney, Agent, or Firm* — Grossman Tucker Perreault & Pfleger, PLLC

(57) ABSTRACT

An example of a system, consistent with the present disclosure, may include a motor-battery assembly. The motor-battery assembly may include a housing defining one or more cavities, a suction motor configured to be fluidly coupled to a debris compartment of a vacuum cleaner for generating air flow through the vacuum cleaner for entraining debris, one or more batteries at least partially disposed within at least one of the one or more cavities, and a motor/battery controller at least partially disposed within at least one of the one or more cavities, the motor/battery controller configured to control power provided to the suction motor and to regulate charging and/or discharging of the one or more batteries.

15 Claims, 39 Drawing Sheets

(56) References Cited

U.S. PATENT DOCUMENTS

| | | | | |
|---|---|---|---|---|
| 4,156,952 | A | 6/1979 | Lynch, Jr. | |
| 4,513,472 | A | 4/1985 | Wells | |
| 5,101,615 | A | 4/1992 | Fassauer | |
| 5,331,716 | A | 7/1994 | Hemmann et al. | |
| 5,388,303 | A | 2/1995 | Hemmann et al. | |
| 5,389,004 | A | 2/1995 | Gray et al. | |
| 5,504,970 | A | 4/1996 | Neshat et al. | |
| 5,787,546 | A | 8/1998 | Bass et al. | |
| 5,850,666 | A | 12/1998 | Farone et al. | |
| 6,085,382 | A * | 7/2000 | Bobrosky | A47L 9/122 15/340.1 |
| 6,098,242 | A | 8/2000 | Choi | |
| 6,173,474 | B1 | 1/2001 | Conrad | |
| 6,256,833 | B1 | 7/2001 | Steinberg | |
| 6,260,235 | B1 * | 7/2001 | Leung | A47L 5/22 15/410 |
| 6,311,366 | B1 | 11/2001 | Sepke et al. | |
| 6,497,001 | B2 | 12/2002 | Di Nunzio et al. | |
| 6,530,118 | B2 | 3/2003 | Oh | |
| 6,588,051 | B2 | 7/2003 | Hashizume et al. | |
| 7,823,251 | B2 | 11/2010 | Dyson et al. | |
| RE42,155 | E | 2/2011 | Ragner | |
| 8,281,456 | B2 | 10/2012 | Finke | |
| 8,528,160 | B2 | 9/2013 | Conrad | |
| 8,826,490 | B1 | 9/2014 | Giarmo | |
| 8,966,708 | B2 | 3/2015 | Worker et al. | |
| 8,991,005 | B2 | 3/2015 | Mersmann | |
| 9,402,516 | B2 | 8/2016 | Pilch | |
| 9,622,630 | B2 | 4/2017 | Faremo et al. | |
| 9,854,955 | B2 | 1/2018 | Richter | |
| 10,413,146 | B2 | 9/2019 | Williams et al. | |
| 10,660,494 | B1 | 5/2020 | Alton | |
| 2001/0018780 | A1 | 9/2001 | Hashizume et al. | |
| 2002/0101075 | A1 | 8/2002 | Park et al. | |
| 2004/0223803 | A1 | 11/2004 | Fahy et al. | |
| 2005/0155177 | A1 * | 7/2005 | Baer | A47L 9/2873 15/353 |
| 2007/0040376 | A1 | 2/2007 | Choi | |
| 2007/0226946 | A1 * | 10/2007 | Best | A47L 9/1666 15/329 |
| 2008/0086833 | A1 * | 4/2008 | Capron-Tee | A47L 9/2873 15/300.1 |
| 2008/0281481 | A1 | 11/2008 | Abramson et al. | |
| 2009/0064449 | A1 | 3/2009 | Newton et al. | |
| 2009/0089969 | A1 | 4/2009 | Lee et al. | |
| 2009/0165242 | A1 | 7/2009 | Lee et al. | |
| 2010/0005614 | A1 | 1/2010 | Cochran et al. | |
| 2011/0088196 | A1 | 4/2011 | Wills et al. | |
| 2011/0088197 | A1 | 4/2011 | Postle et al. | |
| 2011/0088198 | A1 | 4/2011 | Wills et al. | |
| 2011/0088200 | A1 | 4/2011 | White et al. | |
| 2011/0088205 | A1 | 4/2011 | Dyson et al. | |
| 2011/0088206 | A1 | 4/2011 | Ford et al. | |
| 2011/0088208 | A1 | 4/2011 | White et al. | |
| 2011/0088212 | A1 | 4/2011 | Dyson et al. | |
| 2011/0094054 | A1 | 4/2011 | Dos Reis et al. | |
| 2011/0219569 | A1 | 9/2011 | Vines et al. | |
| 2011/0219581 | A1 | 9/2011 | Vines et al. | |
| 2012/0030900 | A1 | 2/2012 | Seo et al. | |
| 2012/0180258 | A1 | 7/2012 | Seo | |
| 2012/0222250 | A1 | 9/2012 | Conrad | |
| 2012/0222251 | A1 | 9/2012 | Conrad | |
| 2012/0233806 | A1 | 9/2012 | Streciwilk | |
| 2013/0081226 | A1 | 4/2013 | Mcluckie et al. | |
| 2013/0086770 | A1 * | 4/2013 | Wolfe, Jr. | H01M 50/116 15/412 |
| 2013/0091813 | A1 | 4/2013 | Smith | |
| 2014/0033471 | A1 | 2/2014 | Toole et al. | |
| 2014/0245562 | A1 | 9/2014 | Conrad | |
| 2014/0338148 | A1 | 11/2014 | Lee et al. | |
| 2016/0128527 | A1 | 5/2016 | Grey et al. | |
| 2016/0198914 | A1 * | 7/2016 | Conrad | A47L 9/325 15/329 |
| 2016/0208981 | A1 | 7/2016 | Kaesemeyer | |
| 2016/0213218 | A1 * | 7/2016 | Ham | A47L 5/362 |
| 2016/0270614 | A1 | 9/2016 | Kawamura et al. | |
| 2016/0270615 | A1 | 9/2016 | Kawamura et al. | |
| 2017/0265697 | A1 | 9/2017 | Conrad | |
| 2017/0340177 | A1 | 11/2017 | Conrad | |
| 2018/0064301 | A1 | 3/2018 | Cottrell et al. | |
| 2018/0132683 | A1 | 5/2018 | Walker | |

FOREIGN PATENT DOCUMENTS

| | | |
|---|---|---|
| CN | 1889877 | 1/2007 |
| CN | 101116770 | 2/2008 |
| CN | 100539920 | 9/2009 |
| CN | 101828891 | 9/2010 |
| CN | 201631106 | 11/2010 |
| CN | 104271020 | 1/2015 |
| CN | 105832247 | 8/2016 |
| CN | 205458447 | 8/2016 |
| DE | 3834686 | 12/1989 |
| DE | 202008017137 | 3/2009 |
| DE | 102011001631 | 10/2011 |
| DE | 102012110182 | 4/2014 |
| EP | 0983741 | 3/2000 |
| EP | 1356755 | 10/2003 |
| EP | 1591052 | 11/2005 |
| EP | 1758493 | 3/2007 |
| EP | 2055219 | 5/2009 |
| GB | 2290462 | 1/1996 |
| GB | 2304549 | 3/1997 |
| JP | S60194919 | 10/1985 |
| JP | S61012461 | 1/1986 |
| JP | S62151835 | 9/1987 |
| JP | 63194615 | 8/1988 |
| JP | H02172427 | 7/1990 |
| JP | H02234733 | 9/1990 |
| JP | H033956 | 1/1991 |
| JP | H034825 | 1/1991 |
| JP | H05184502 | 7/1993 |
| JP | H07322972 | 12/1995 |
| JP | 2000116574 | 4/2000 |
| JP | 4258730 | 4/2009 |
| JP | 2010194070 A | 9/2010 |
| JP | 2013162882 A | 8/2013 |
| KR | 100774508 | 11/2007 |
| KR | 101003601 | 12/2010 |
| KR | 101052161 | 7/2011 |
| KR | 20120004104 | 1/2012 |
| KR | 20120014326 | 2/2012 |
| KR | 20120016810 | 2/2012 |
| WO | 2005034706 | 4/2005 |
| WO | 2008142642 | 11/2008 |
| WO | 2009030885 | 3/2009 |
| WO | 2013139364 | 9/2013 |

OTHER PUBLICATIONS

PCT Search Report and Written Opinion dated Nov. 25, 2019, received in PCT Application No. PCT/US19/49925, 10 pgs.

PCT Search Report and Written Opinion dated Apr. 26, 2019, received in PCT Application No. PCT/US19/17030, 9 pgs.

Chinese Office Action with English translation dated Aug. 24, 2021, received in Chinese Patent Application No. 201980049043.X, 10 pages.

U.S. Office Action dated Mar. 30, 2021, received in U.S. Appl. No. 16/447,734, 15 pages.

Chinese Office Action with English translation dated Nov. 15, 2021, received in Chinese Patent Application No. 201980070915.0, 13 pages.

US Office Action dated Oct. 6, 2021, received in U.S. Appl. No. 16/447,734, 13 pages.

UK Examination Report dated Feb. 17, 2022, received in UK Patent Application No. GB2020866.6, 6 pages.

US Office Action dated Mar. 30, 2022, received in U.S. Appl. No. 16/447,734, 13 pages.

U.S. Office Action dated Nov. 30, 2022, received in U.S. Appl. No. 16/447,734, 15 pages.

(56) References Cited

OTHER PUBLICATIONS

Chinese Office Action with English summary, dated Aug. 2, 2022, received in Chinese Patent Application No. 201980070915.0, 11 pages.
Chinese Office Action with English translation dated Feb. 27, 2023, received in Chinese Patent Application No. 2019800709150, 10 pages.

* cited by examiner

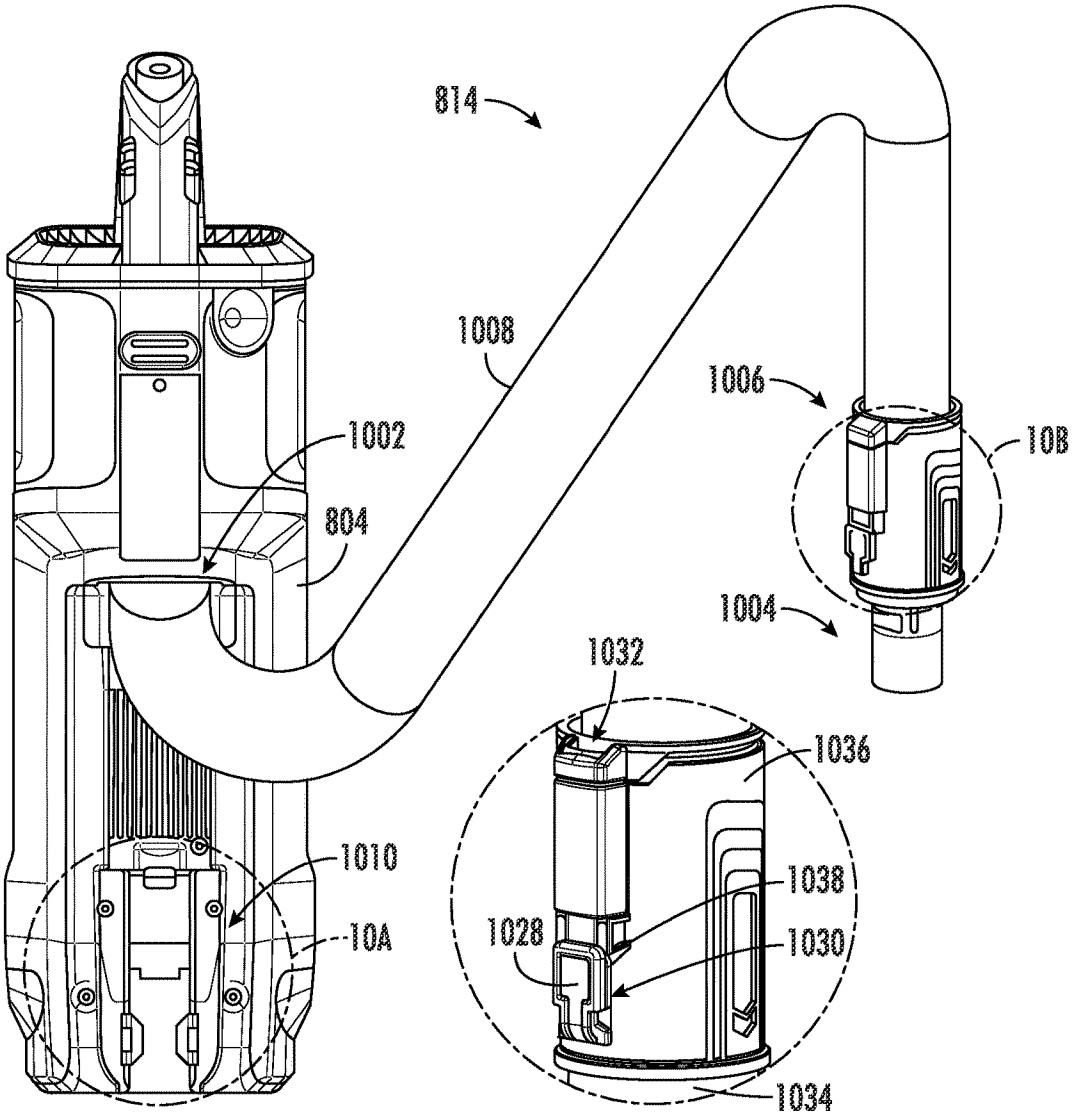
FIG. 10B
FIG. 10
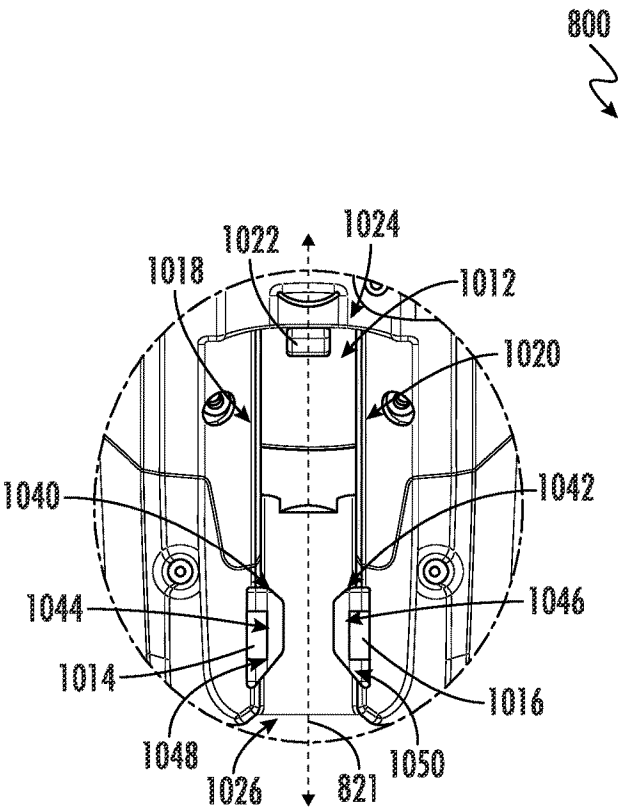
FIG. 10A

BATTERY AND SUCTION MOTOR ASSEMBLY FOR A SURFACE TREATMENT APPARATUS AND A SURFACE TREATMENT APPARATUS HAVING THE SAME

CROSS-REFERENCE TO RELATED APPLICATIONS

The present application claims the benefit of U.S. Provisional Application Ser. No. 62/728,165 filed on Sep. 7, 2018, entitled Vacuum Pod Configured to Couple to one or more Accessories and U.S. Provisional Application Ser. No. 62/730,337 filed on Sep. 12, 2018, entitled Battery and Suction Motor Assembly, each of which are fully incorporated herein by reference.

TECHNICAL FIELD

The present disclosure is generally directed to surface treatment apparatuses and more specifically to a motor-battery assembly capable of being used with a surface treatment apparatus.

BACKGROUND INFORMATION

Surface treatment apparatuses may include vacuum cleaners configured to suction debris from a surface (e.g., a floor). The vacuum cleaner may include a surface treatment head having one or more brush rolls configured to agitate a surface (e.g., a carpet) to urge debris into an airflow stream generated by the vacuum cleaner. The debris within the airflow stream may then be deposited in a debris collector (e.g., a bag) for later disposal.

BRIEF DESCRIPTION OF THE DRAWINGS

These and other features and advantages will be better understood by reading the following detailed description, taken together with the drawings, wherein:

FIG. 10 shows a perspective rear-view of the vacuum pod of FIG. 8, consistent with embodiments of the present disclosure.

FIG. 10A shows a magnified perspective view corresponding to region 10A of FIG. 10, consistent with embodiments of the present disclosure.

FIG. 10B shows a magnified perspective view corresponding to region 10B of FIG. 10, consistent with embodiments of the present disclosure.

DETAILED DESCRIPTION

The present disclosure is generally directed to a motor-battery assembly for a surface treatment apparatus (e.g., a vacuum cleaner). The motor-battery assembly may include a housing defining one or more cavities, a suction motor configured to be fluidly coupled to a debris compartment of a vacuum cleaner for generating air flow through the vacuum cleaner for entraining debris, one or more batteries at least partially disposed within at least one of the one or more cavities, and a motor/battery controller at least partially disposed within at least one of the one or more cavities. The motor/battery controller may be configured to control power provided to the suction motor and to regulate charging and/or discharging of the one or more batteries. According to one embodiment, both the suction motor and battery controllers may be integrated into a single controller which may reduce and/or eliminate the wiring needed for the vacuum cleaner, thereby reducing manufacturing costs. In addition, integrating both the suction motor controller and the battery controller into a single controller may further reduce manufacturing costs by eliminating the need to install two separate controllers in the vacuum cleaner. Finally, integrating both the suction motor controller and the battery controller into a single controller may reduce the overall size of the vacuum cleaner and provide greater design flexibility (e.g., allowing the designer to create a more pleasant aesthetic design).

As generally referred to herein, the term resiliently deformable may refer to an ability of a mechanical component to repeatably transition between an un-deformed and a deformed state (e.g., transition between the un-deformed and deformed state at least 100 times, 1,000 times, 100,000 times, 1,000,000 times, 10,000,000 times, or any other suitable number of times) without the component experiencing a mechanical failure (e.g., the component is no longer able to function as intended).

Figure 1:
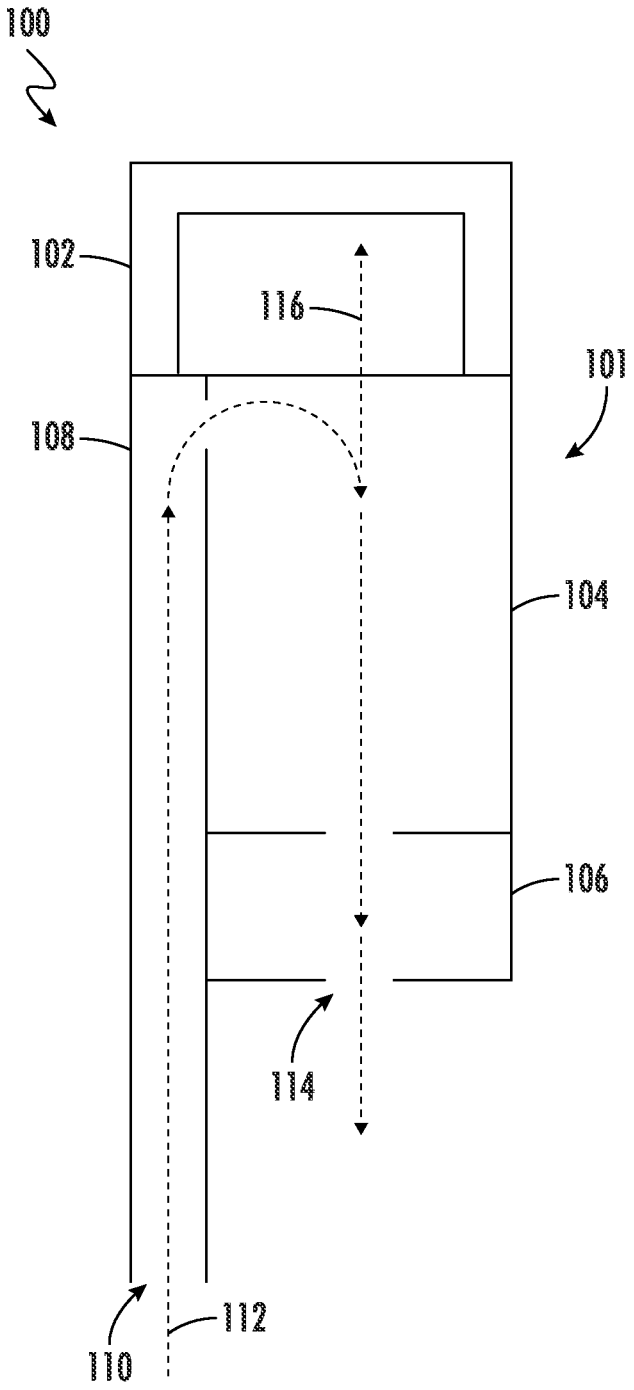
FIG. 1 shows a schematic cross-sectional view of a vacuum pod, consistent with embodiments of the present disclosure.

FIG. 1 shows a schematic cross-sectional view of a vacuum pod 100 having a handle 102, a dust cup 104, a suction motor 106, and a fluid conduit 108. The fluid conduit 108 includes an air inlet 110 fluidly coupled to the dust cup 104 such that, when the suction motor 106 is activated, fluid (e.g., air) flows along a flow path 112 extending from the air inlet 110 through the dust cup 104 and suction motor 106 and exiting the vacuum pod 100 at an outlet 114. The suction motor 106 can be powered using, for example, one or more batteries and/or an electrical power grid.

As shown, at least a portion of the dust cup 104 is disposed between the handle 102 and the suction motor 106. This positions the handle 102 and the suction motor 106 at opposing end regions of the vacuum pod 100 (e.g., on opposing sides of a central plane extending through the center of the vacuum pod 100, wherein the central plane extends perpendicular to a longitudinal axis of the vacuum pod 100). The dust cup 104 and the suction motor 106 are disposed along an axis 116. The axis 116 may be a central axis of the dust cup 104. Additionally, or alternatively, a center of mass of the suction motor 106 may be generally aligned with the axis 116. The suction motor 106 may have any orientation relative to the axis 116.

The fluid conduit 108 may include a flexible and/or expandable (e.g., longitudinally) hose. In these instances, the fluid conduit 108 can be configured to include a portion that is removably coupled to the vacuum pod 100 such that a portion of the fluid conduit 108 can be maneuvered independently of, for example, the dust cup 104 and the suction motor 106. As a result, a user can carry a vacuum pod body 101 (e.g., the portion of vacuum pod 100 housing at least the dust cup 104 and the suction motor 106) of the vacuum pod 100 in one hand while maneuvering the fluid conduit 108 with the other.

Figure 2:
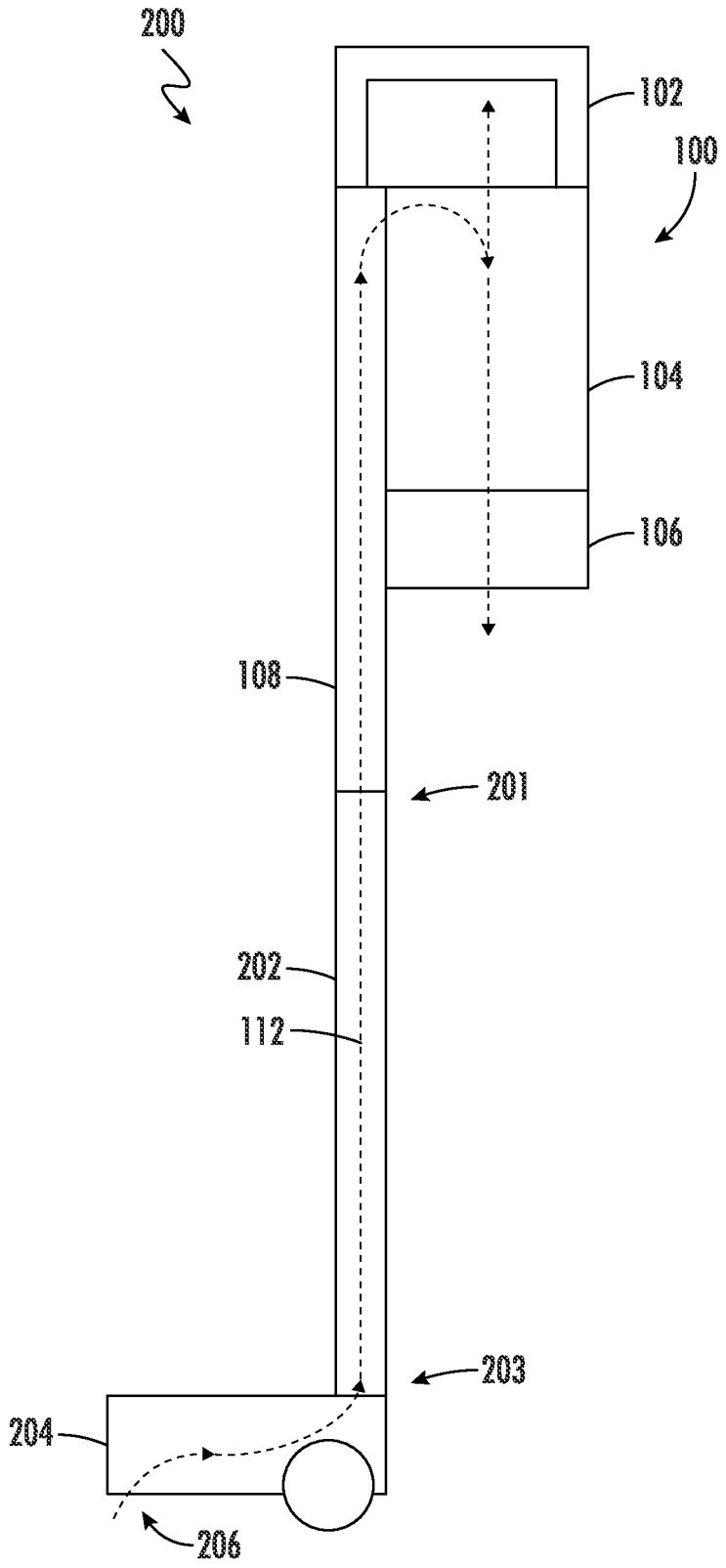
FIG. 2 shows a schematic view of a surface treatment apparatus having the vacuum pod of FIG. 1 coupled thereto, consistent with embodiments of the present disclosure.

FIG. 2 shows a schematic view of a surface treatment apparatus 200 having the vacuum pod 100 fluidly coupled to a first end 201 of a wand 202 and a surface treatment head 204 coupled to a second end 203 of the wand 202, wherein the first end 201 is opposite the second end 203. As shown, the vacuum pod 100 is positioned proximate to the first end 201 of the wand 202.

The dust cup 104 and the suction motor 106 can be disposed between the handle 102 and the surface treatment head 204 such that the surface treatment head 204 is disposed closer to the suction motor 106 than the handle 102. Such a configuration positions the center of mass of the vacuum pod 100 at a position closer to the surface treatment head 204 when compared to a configuration having, for example, the suction motor 106 disposed between the dust cup 104 and the handle 102. As a result, the surface treatment apparatus 200 may feel lighter to a user.

As shown, when the suction motor 106 is activated, the flow path 112 extends from a surface treatment head inlet 206 through the wand 202 and the fluid conduit 108 into the dust cup 104 through the suction motor 106 and exits the vacuum pod 100. As such, the vacuum pod 100 can generally be described as being fluidly coupled to the surface treatment head 204 and the wand 202. In some instances, the wand 202 and the fluid conduit 108 may be electrified such that the suction motor 106 and electric components of the surface treatment head 204 (e.g., a brush roll motor, a light source, and/or any other electric component) can be powered from a common source (e.g., a battery and/or an electrical power grid).

Figure 3:
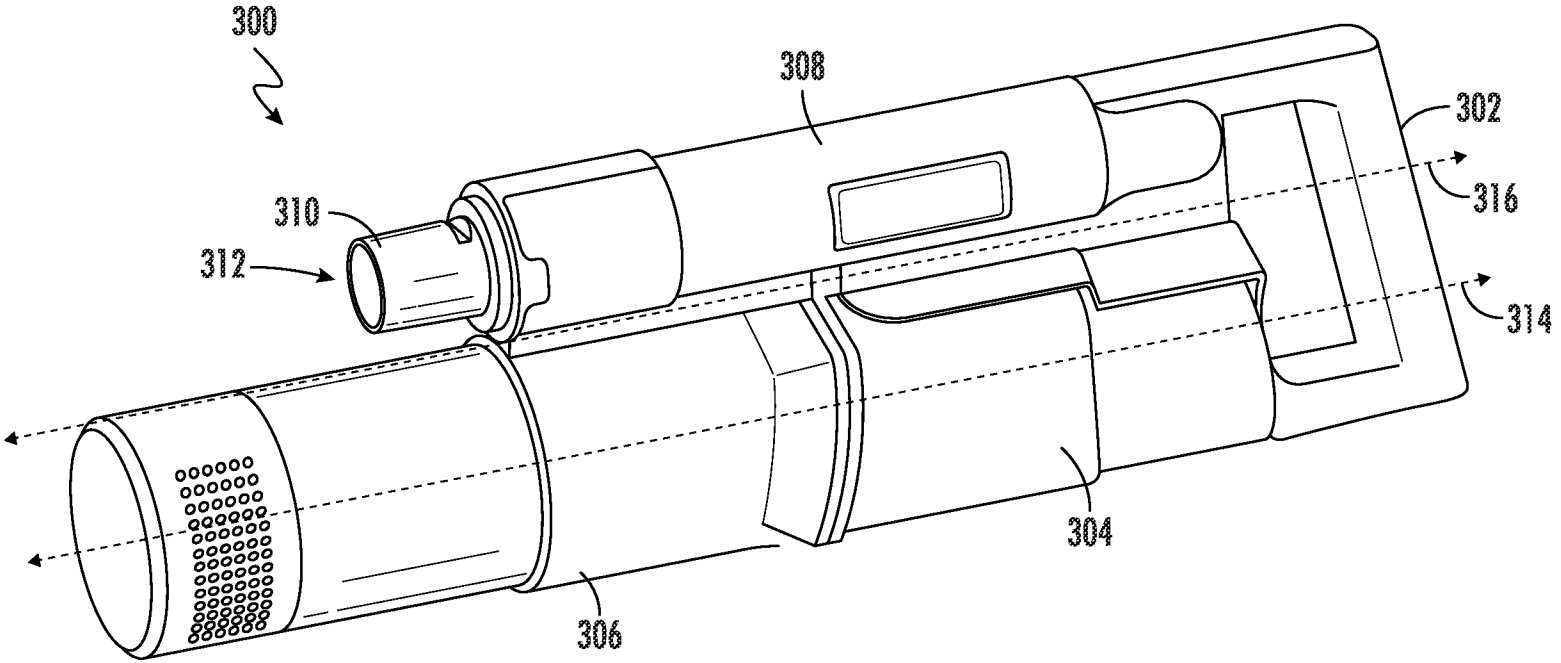
FIG. 3 shows a perspective view of a vacuum pod, consistent with embodiments of the present disclosure.

FIG. 3 shows a perspective view of a vacuum pod 300, which may be an example of the vacuum pod 100 of FIG. 1. As shown, the vacuum pod 300 includes a handle 302, a dust cup 304, a suction motor assembly 306, and a fluid conduit 308. As also shown, a coupling 310 that defines a fluid inlet 312 is provided at an end of the fluid conduit 308. The coupling 310 may be configured to fluidly couple to one or more surface treatment accessories.

The dust cup 304 may be positioned along an axis 314 (e.g., an axis of the dust cup 304 and/or the suction motor assembly 306) and between the handle 302 and the suction motor assembly 306. The axis 314 extends generally parallel to a longitudinal axis 316 of the vacuum pod 300 and/or generally parallel to the fluid conduit 308. As shown, the axis 314 extends through both the suction motor assembly 306 and the dust cup 304. Therefore, the dust cup 304 and the suction motor assembly 306 may generally be described as being in an in-line (or a series) configuration. In some instances, the axis 314 may be a central axis of the dust cup 304. Additionally, or alternatively, the center of mass of the suction motor assembly 306 may be generally aligned with the axis 314.

Figure 4:
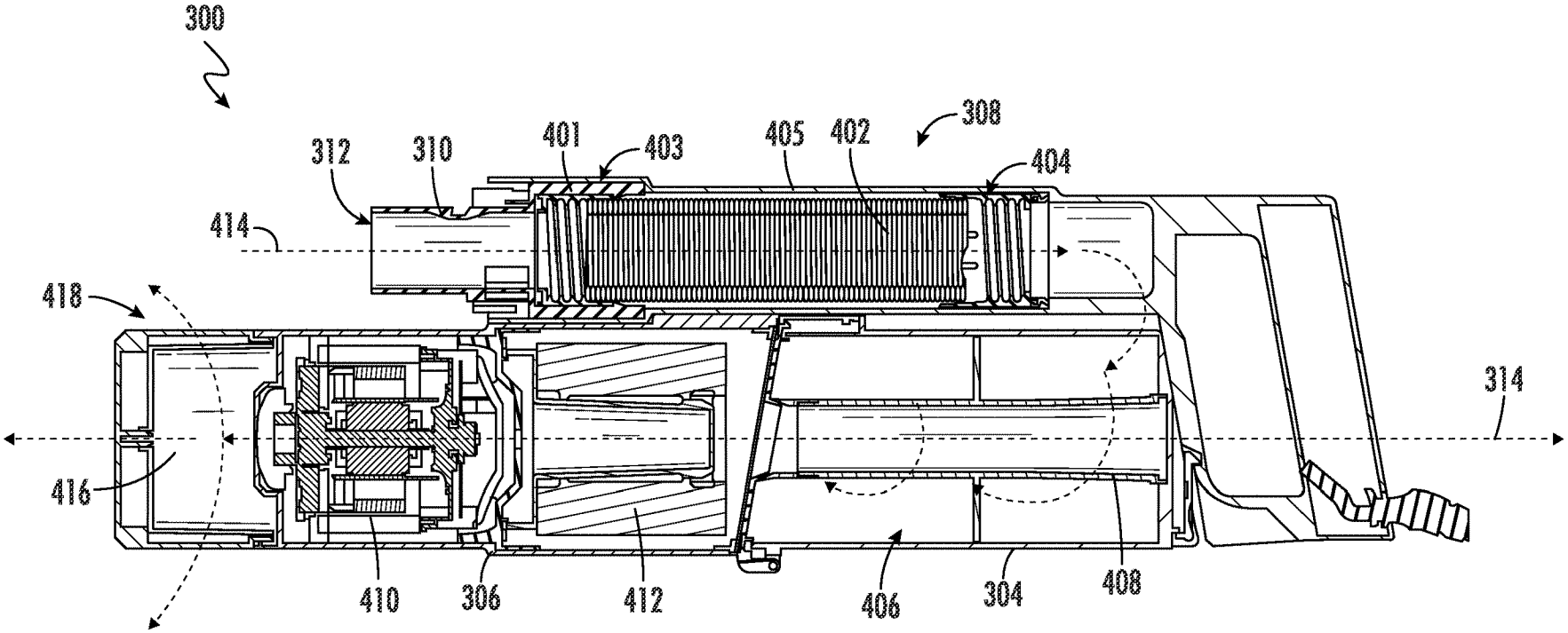
FIG. 4 shows a cross-sectional view of the vacuum pod of FIG. 3, consistent with embodiments of the present disclosure.
Figure 5:
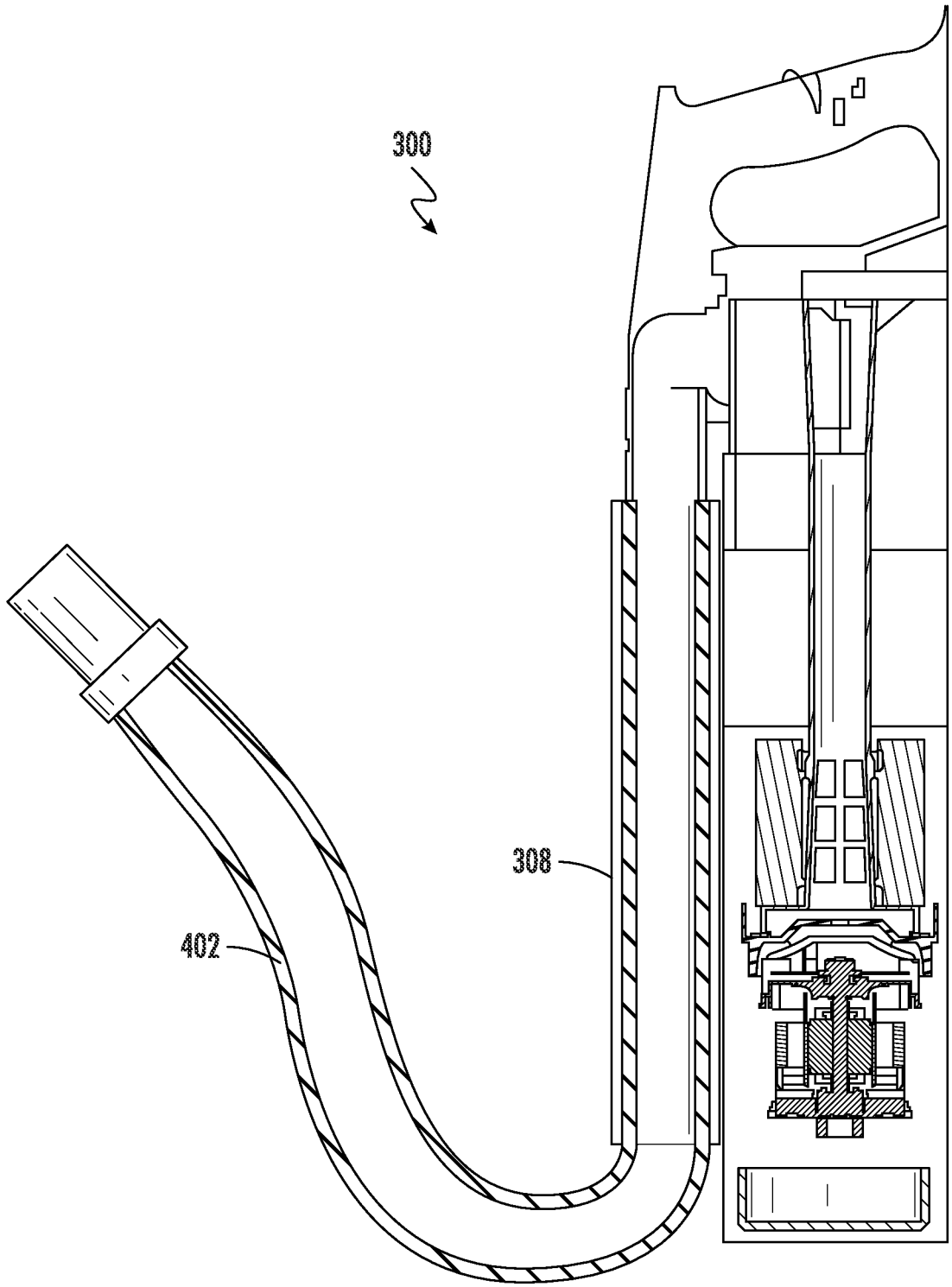
FIG. 5 shows another cross-sectional view of the vacuum pod of FIG. 3, consistent with embodiments of the present disclosure.

FIG. 4 shows a cross-sectional view of the vacuum pod 300 of FIG. 3. As shown, a flexible hose 402 extends within a cavity 404 defined by a conduit body 405 of the fluid conduit 308. As such, the fluid conduit 308 may generally be described as including the flexible hose 402. The flexible hose 402 is expandable such that the flexible hose 402 is capable of extending from the cavity 404. As such, the flexible hose 402 may generally be described as being configured to be stored within the cavity 404. In other words, the flexible hose 402 may generally be described as being configured to transition between an extended/expanded position (as shown in FIG. 5) and a retracted position (as shown in FIG. 4). In some instances, the flexible hose 402 may have sufficient elasticity to urge to flexible hose 402 in a direction of the retracted position.

The flexible hose 402 is coupled to the coupling 310. The coupling 310 can include an engaging portion 401 configured to engage a surface 403 of the cavity 404 such that the flexible hose 402 can be retained in a retracted position (e.g., such that the flexible hose 402 is stored within the cavity 404). For example, the engaging portion 401 may form a friction fit with the surface 403, the engaging portion 401 and/or the surface 403 may include one or more detents, and/or any other retaining mechanism.

As shown, the dust cup 304 includes a debris cavity 406. The dust cup 304 may be configured to cause a cyclone to be generated. For example, the dust cup 304 may include at least one vortex finder 408 and/or a tangential inlet such that at least one cyclone can be generated within the dust cup 304. In some instances, the cyclone extends generally parallel to, for example, the fluid conduit 308 and/or the axis 314. As also shown, the suction motor assembly 306 includes a suction motor 410 and a premotor filter 412. In some instances, and as shown, a central axis of the suction motor 410 (e.g., a rotation axis of an impeller) and a longitudinal axis of the vortex finder 408 and/or dust cup 304 (e.g., a central axis of the vortex finder 408 and/or dust cup 304) may extend along the axis 314.

When the suction motor 410 is activated fluid is caused to flow along a flow path 414. The flow path 414 extends from the fluid inlet 312 of the coupling 310 through the flexible hose 402 into the dust cup 304 through the premotor filter 412 into the suction motor 410 through a post motor filter 416 and out an exhaust outlet 418.

Figure 6:
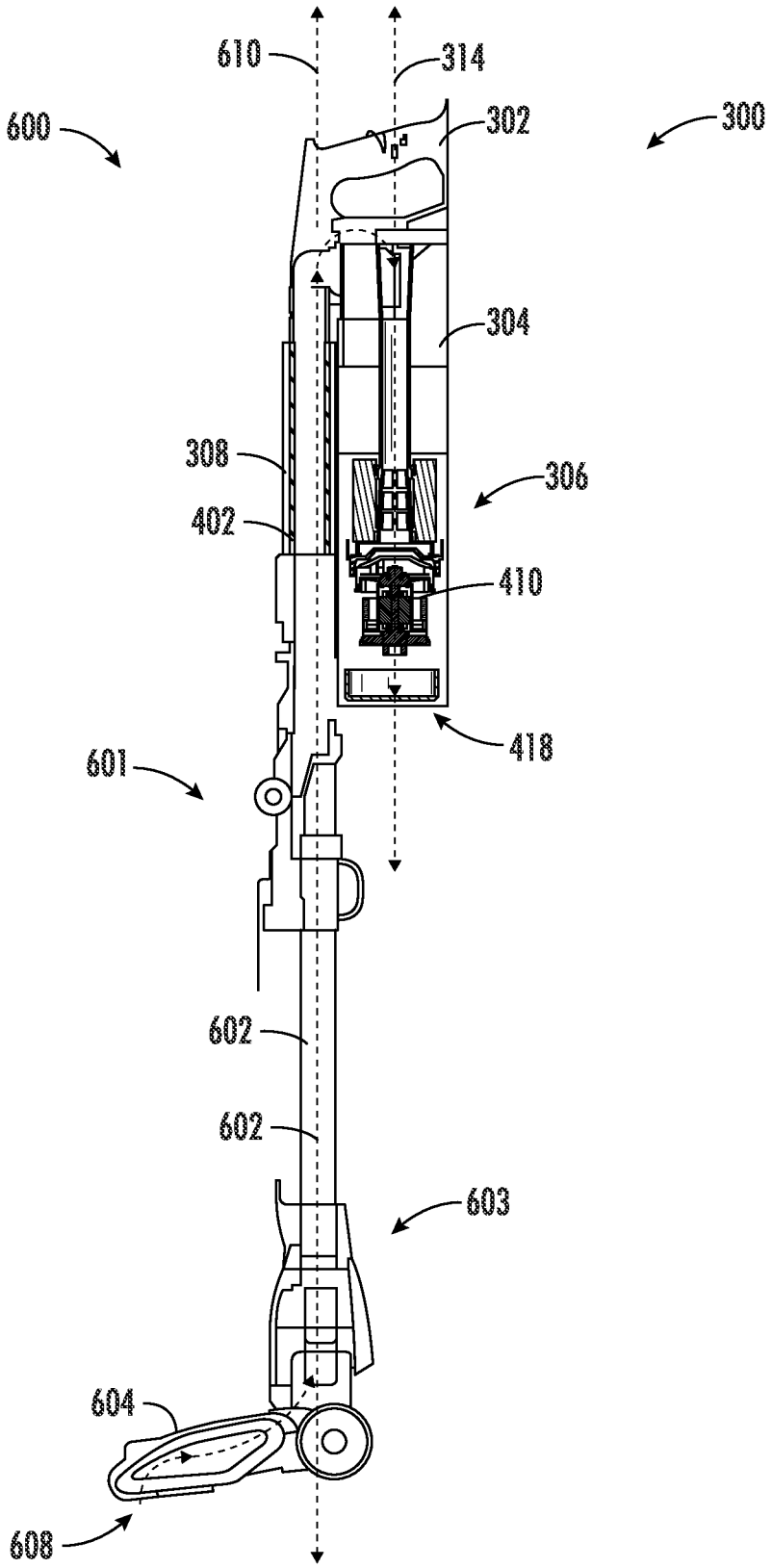
FIG. 6 shows a partial cross-sectional view of a surface treatment apparatus including the vacuum pod of FIG. 3, consistent with embodiments of the present disclosure.

FIG. 6 shows a partial cross-sectional view of an example of a surface treatment apparatus 600 having the vacuum pod 300 of FIG. 3 fluidly coupled to a first end 601 of a wand 602 (e.g., using the flexible hose 402) and a surface treatment head 604 coupled to a second end 603 of the wand 602, wherein the first end 601 is opposite the second end 603. As shown, the vacuum pod 300 is positioned proximate to the first end 601 of the wand 602.

As also shown, the dust cup 304 and the suction motor 410 are disposed between the handle 302 and the surface treatment head 604 such that the surface treatment head 604 is disposed closer to the suction motor 410 than the handle 302. Such a configuration positions the center of mass of the vacuum pod 300 at a location closer to the surface treatment head 604 when compared to a configuration having, for example, the suction motor 410 disposed between the handle 302 and the dust cup 304. As a result, the surface treatment apparatus 600 may feel lighter to a user.

When the suction motor 410 is activated a fluid is caused to flow along a flow path 606. The flow path 606 extends from an inlet 608 of the surface treatment head 604 along a channel defined in the wand 602 through the fluid conduit 308 into the dust cup 304 and the suction motor 410 and out of the exhaust outlet 418. In some instances, the wand 602 and/or the fluid conduit 308 (e.g., the flexible hose 402) can be electrified such that the suction motor 410 and electronic components of the surface treatment head 604 (e.g., a brush motor, a light source, and/or any other electric component) can be powered from a common source (e.g., a battery and/or an electrical power grid).

Figure 7:
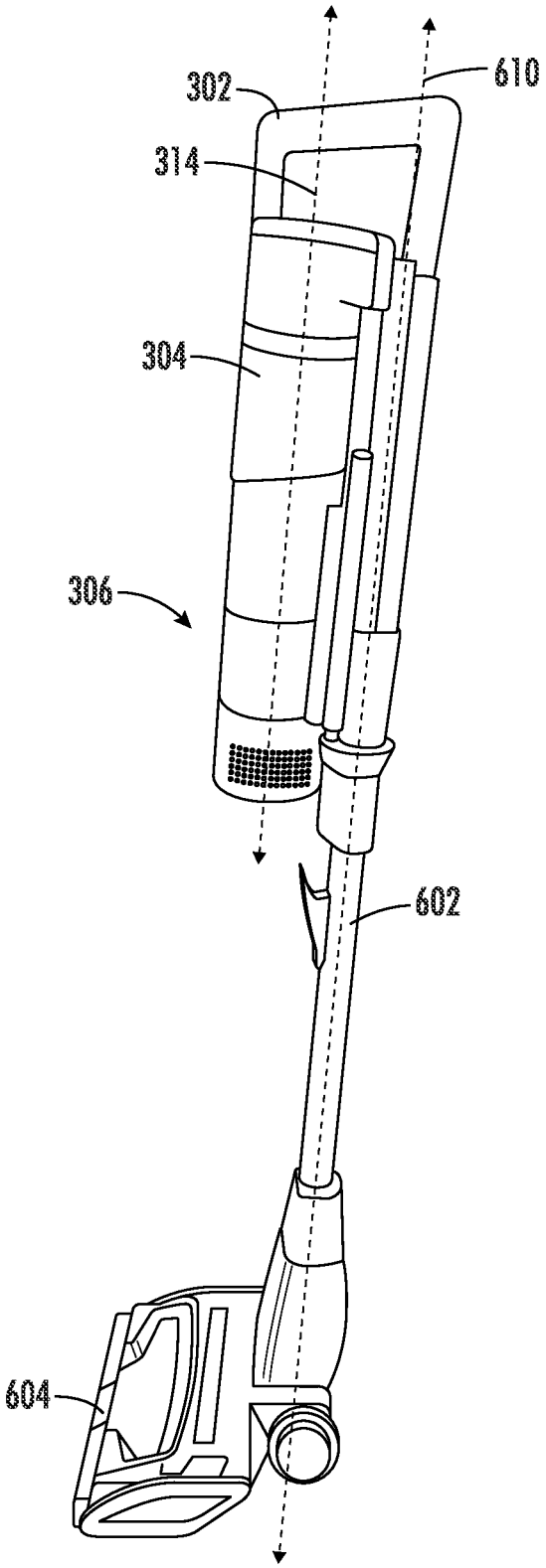
FIG. 7 shows a perspective view of the surface treatment apparatus of FIG. 6, consistent with embodiments of the present disclosure.

As shown, the suction motor assembly 306 and the dust cup 304 can extend under the handle 302 along the axis 314 in a direction of the surface treatment head 604. The axis 314 can be spaced apart from and generally parallel to a longitudinal axis 610 of the wand 602. For example, and, as shown, the axis 314 can be spaced apart from the longitudinal axis 610 of the wand 602 in a direction such that the suction motor assembly 306 and the dust cup 304 are positioned on a user facing side of the surface treatment apparatus 600. By way of further example, and as shown in FIG. 7, the axis 314 can be spaced apart from the longitudinal axis 610 of the wand 602 in a direction such that the suction motor assembly 306 and the dust cup 304 are positioned over the surface treatment head 604 (e.g., opposite the user facing side of the surface treatment apparatus 600).

As also shown, the longitudinal axis 610 of the wand 602 aligns with the longitudinal axis of the fluid conduit 308 when the vacuum pod 300 is coupled to the wand 602 of the surface treatment apparatus 600. In other words, the wand 602 and the fluid conduit 308 may generally be described as being axially aligned along the longitudinal axis 610 of the wand 602 when the vacuum pod 300 is coupled to the wand 602 of the surface treatment apparatus 600.

Figure 9:
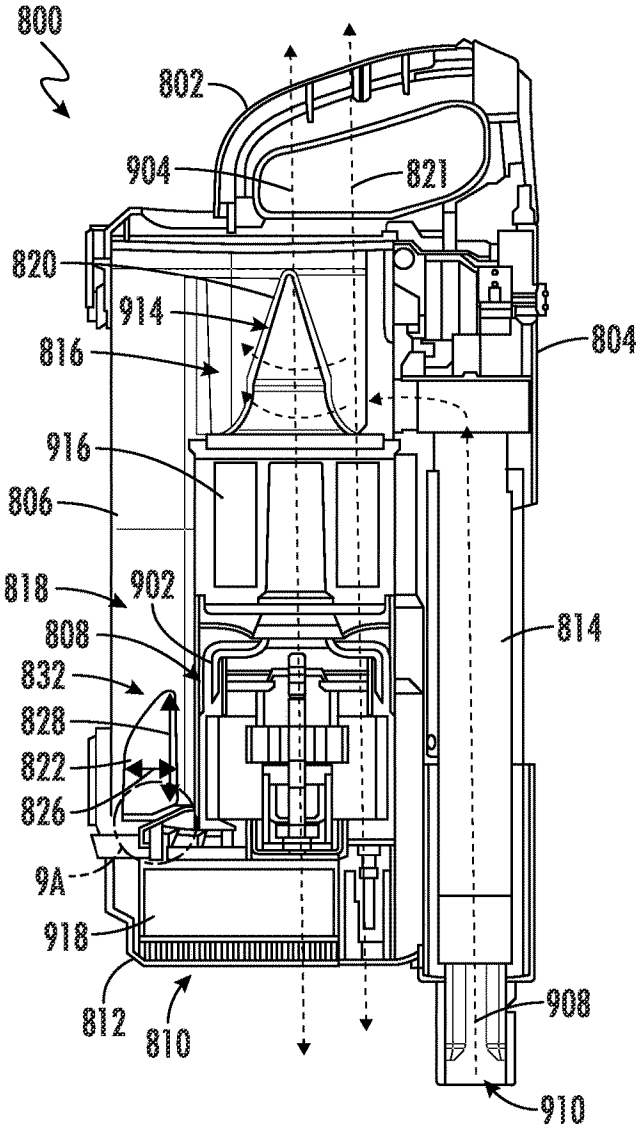
FIG. 9 shows a cross-sectional view of the vacuum pod of FIG. 8 taken along the line IX-IX, consistent with embodiments of the present disclosure.
Figure 8:
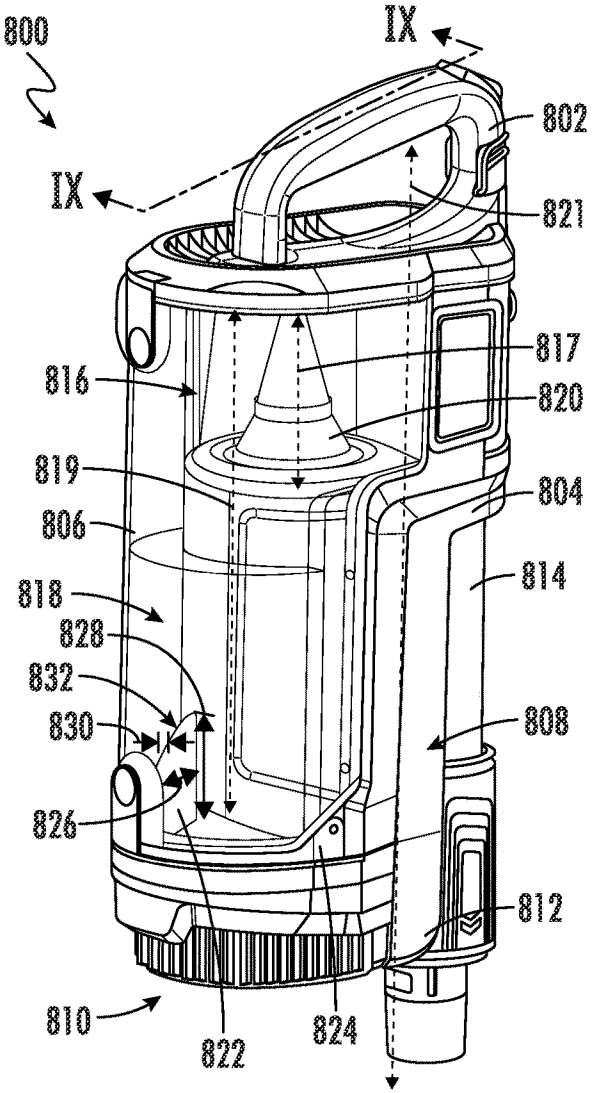
FIG. 8 shows a perspective view of a vacuum pod, consistent with embodiments of the present disclosure.

FIG. 8 shows a perspective view of a vacuum pod 800 and FIG. 9 shows a cross-sectional perspective view of the vacuum pod 800 taken along the line IX-IX of FIG. 8. The vacuum pod 800 may be an example of the vacuum pod 100 of FIG. 1. The vacuum pod 800 includes a handle 802 and a vacuum pod body 804. The vacuum pod body 804 defines a receptacle configured to receive a dust cup 806 such that the dust cup 806 can be removably coupled to the vacuum pod body 804, a suction motor cavity 808 for receiving a suction motor 902, and a post motor filter cavity 810 having a removable panel 812. A fluid conduit 814 is coupled to the vacuum pod body 804 and is fluidly coupled to the dust cup 806.

The dust cup 806 can include a cyclonic region 816 and a debris collection region 818. As shown, a cyclonic region central axis 817 and a debris collection region central axis 819 can be horizontally spaced apart and each can extend generally parallel to a longitudinal axis 821 of the vacuum pod 800. As such, the dust cup 806 can generally be described as having a first portion (e.g., that includes the debris collection region 818) that extends longitudinally along the vacuum pod body 804 and a second portion (e.g., that includes the cyclonic region 816) that extends transverse to the longitudinal axis 821 of the vacuum pod 800. The cyclonic region 816 can be configured to cause air flowing therein to move cyclonically. The cyclonic region 816 can include a vortex finder 820 about which air moving through the dust cup 806 cyclonically extends. The cyclonic motion of air about the vortex finder 820 can cause at least a portion of debris entrained within the air to fall out of the air and be deposited in the debris collection region 818.

Figure 9A:
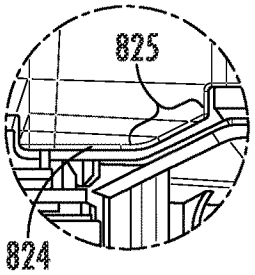
FIG. 9A shows a magnified view corresponding to region 9A of FIG. 9, consistent with embodiments of the present disclosure.

In operation, a portion of the debris stored within the debris collection region 818 may become re-entrained within air flowing through the dust cup 806. As such, the debris collection region 818 may include a protrusion 822 that is configured to mitigate/discourage or prevent entrainment of debris deposited in the debris collection region 818 within air flowing through the dust cup 806. The protrusion 822 can extend from a distal end of the debris collection region 818. For example, the protrusion 822 may extend from an openable door 824 of the dust cup 806, wherein the openable door 824 is configured to transition between a closed position and an open position in order to empty the dust cup 806 when the dust cup 806 is decoupled from the vacuum pod body 804. The openable door 824 can be pivotally coupled to a distal end of the dust cup 806 such that the openable door 824 is spaced apart from the cyclonic region 816. As shown in FIG. 9A, which shows a magnified view corresponding to region 9A of FIG. 9, the openable door 824 includes a sloped portion 825 that extends towards the vacuum pod body 804 in a direction of the cyclonic region 816 and from which at least a portion of the protrusion 822 can extend.

As shown, a protrusion width 826 may measure less than a protrusion height 828 and a protrusion thickness 830 may measure less than the protrusion width 826 and the protrusion height 828. As such, the protrusion may generally be described as forming a fin. As also shown, the protrusion 822 may include a chamfered region 832. The chamfered region 832 may be spaced apart from the openable door 824 and extend along a distal end of the protrusion 822 in a direction of the vacuum pod body 804.

As also shown, the dust cup 806 is coupled to the vacuum pod body 804 such that at least a portion of the dust cup 806 extends between the handle 802 and the suction motor cavity 808. For example, at least a portion of the cyclonic region 816 may be disposed between the handle 802 and the suction motor cavity 808. In these instances, and as shown, for example, in FIG. 9, the suction motor cavity 808 can be configured such that the suction motor 902 and the vortex finder 820 are aligned along an axis 904 extending parallel to the longitudinal axis 821 of the vacuum pod 800. Such a configuration, may allow an air path 908 extending from the vortex finder 820 and through suction motor 902 to be generally linear.

For example, and as shown in FIG. 9, the air path 908 extends from an inlet 910 of the fluid conduit 814 through the fluid conduit and into the dust cup 806. Once in the dust cup 806, the air path 908 extends cyclonically around the vortex finder 820 and exits the dust cup 806 through a passageway 914 defined in the vortex finder 820. Upon entering the passageway 914, the air path 908 extends generally linearly through a premotor filter 916, the suction motor 902, and a post motor filter 918.

FIG. 10 is a perspective view of the vacuum pod 800, wherein FIGS. 10A and 10B correspond to magnified perspective views of regions 10A and 10B of FIG. 10, respectively. As shown, a first end 1002 of the fluid conduit 814 is coupled to the vacuum pod body 804 and a second end 1004 of the fluid conduit 814 includes a coupling 1006. The coupling 1006 can be configured to removably couple to at least a portion of the vacuum pod body 804 such that the fluid conduit 814 can be moved independently of the vacuum pod body 804. In some instances, at least a portion of the fluid conduit 814 can be resiliently deformable such that the fluid conduit 814 can be moved independently of the vacuum pod body 804. For example, the fluid conduit 814 can include a flexible hose 1008 extending between the coupling 1006 and the vacuum pod body 804. As shown, a first end of the flexible hose 1008 is coupled to the vacuum pod body 804 and a second end of the flexible hose 1008 is coupled to the coupling 1006.

The flexible hose 1008 can be configured to transition between an extended/expanded position and a retracted position. When the flexible hose 1008 is in the extended position, the coupling 1006 can be decoupled from the vacuum pod body 804 and a length of the flexible hose 1008 measures greater than a length of the flexible hose 1008 in the retracted position. When in the retracted position, the coupling 1006 can be coupled to the vacuum pod body 804 and an overall length of the flexible hose 1008 may measure less than a longitudinal length of the vacuum pod 800. As such, when the coupling 1006 is coupled to the vacuum pod body 804, the flexible hose 1008 may not extend beyond the vacuum pod body 804 in a longitudinal direction.

The vacuum pod body 804 can include a receptacle 1010 configured to receive at least a portion of the coupling 1006. As shown, the receptacle 1010 defines a channel 1012 that extends in a direction generally parallel to the longitudinal axis 821 of the vacuum pod 800. The channel 1012 includes first and second retention arms 1014 and 1016 disposed on opposing longitudinal sidewalls 1018 and 1020 of the channel 1012 and a retention hook 1022 on a distal end wall 1024 of the channel 1012. The channel 1012 can include an open end 1026 that is opposite the distal end wall 1024. The channel 1012 and the open end 1026 can be configured to receive at least a portion of the coupling 1006.

The retention arms 1014 and 1016 can be biased inwardly into the channel 1012 (e.g., using a biasing mechanism such as a spring). As such, when at least a portion of the coupling 1006 is received within the channel 1012, the retention arms 1014 and 1016 can generally be described as being urged into engagement with the coupling 1006. The retention hook 1022 can be biased inwardly into the channel 1012 in a direction generally parallel to the longitudinal axis 821 of the vacuum pod 800 (e.g., using a biasing mechanism such as a spring). As such, when at least a portion of the coupling 1006 is received within the channel 1012, the retention hook 1022 can generally be described as being urged into engagement with the coupling 1006.

The coupling 1006 can include a catch 1028, wherein at least a portion of the catch 1028 is configured to be received within the channel 1012. For example, the catch 1028 can be configured to engage the first and second retention arms 1014 and 1016. When the coupling 1006 is urged into engagement with the receptacle 1010 such that the coupling 1006 can be coupled to the vacuum pod body 804, the catch 1028 can be configured to urge the retention arms 1014 and 1016 outwardly. For example, and as shown, the catch 1028 can include a plurality of grooves 1030 defined on opposing sides of the catch 1028 and the catch 1028 can be configured to urge the retention arms 1014 and 1016 outwardly until at least a portion of the retention arms 1014 and 1016 can engage corresponding grooves 1030. When at least a portion of the retention arms 1014 and 1016 are aligned with corresponding grooves 1030, the retention arms 1014 and 1016 are urged into the corresponding groves 1030 as a result of being biased inwardly. As such, the retention arms 1014 and 1016 can generally be described as being urged into corresponding grooves 1030 when the coupling 1006 is coupled to the receptacle 1010.

The coupling 1006 can also include a retention cavity 1032 configured to receive at least a portion of the retention hook 1022. When the coupling 1006 is urged into engagement with the receptacle 1010, a portion of the coupling 1006 can be configured to urge the retention hook 1022 outwardly from the channel 1012 until the retention hook 1022 can be received within the retention cavity 1032. As such, the retention hook 1022 can generally be described as being urged into the retention cavity 1032 when the coupling 1006 is coupled to the receptacle 1010.

As shown, the retention arms 1014 and 1016 can include first retaining bevels 1044 and 1046 and second retaining bevels 1048 and 1050. The surfaces defining the first retaining bevels 1044 and 1046 extend transverse (e.g., perpendicular) to surfaces defining the second retaining bevels 1048 and 1050. A portion of the catch 1028 can be configured to engage one or more of the first and/or second retaining bevels 1044, 1046, 1048, and/or 1050 when the coupling 1006 is being coupled to the receptacle 1010 such that the retention arms 1014 and 1016 are urged outwardly. As such, the coupling 1006 can be coupled to the receptacle 1010 in response to being inserted into the channel 1012 in a direction transverse to and/or generally parallel to the longitudinal axis 821 of the vacuum pod 800. In other words, the first and/or second retaining bevels 1044, 1046, 1048, and/or 1050 can be configured to cooperate with at least a portion of the coupling 1006 to urge the retention arms 1014 and 1016 outwardly until at least a portion of the retention arms 1014 and 1016 can be received within a respective groove 1030 of the catch 1028.

When the coupling 1006 is removed from the channel 1012, the retention arms 1014 and 1016 can be urged outwardly from the channel 1012. For example, the coupling 1006 can be configured to urge the retention arms 1014 and 1016 outwardly in response to a force being applied to the coupling 1006 (e.g., a force applied to the coupling in a direction generally parallel to the longitudinal axis 821 of the vacuum pod 800).

The coupling 1006 can include a coupling body 1034 and a sleeve 1036. The sleeve 1036 can be configured to slideably engage the coupling body 1034. The sleeve 1036 can be configured to slide longitudinally along the coupling body 1034 between a retaining position and a release position. When the sleeve 1036 is urged towards the release position, the sleeve 1036 is configured to urge the retention arms 1014 and 1016 outwardly such that the coupling 1006 can disengage the receptacle 1010. For example, the sleeve 1036 can include a wedge 1038 configured to engage corresponding release bevels 1040 and 1042 defined by the retention arms 1014 and 1016. The engagement between the wedge 1038 and the release bevels 1040 and 1042 urges the retention arms 1014 and 1016 outwardly. As the retention arms 1014 and 1016 are urged outwardly, the retention arms 1014 and 1016 come out of engagement with the grooves 1030 such that the coupling 1006 can be separated from the receptacle 1010.

Figure 11:
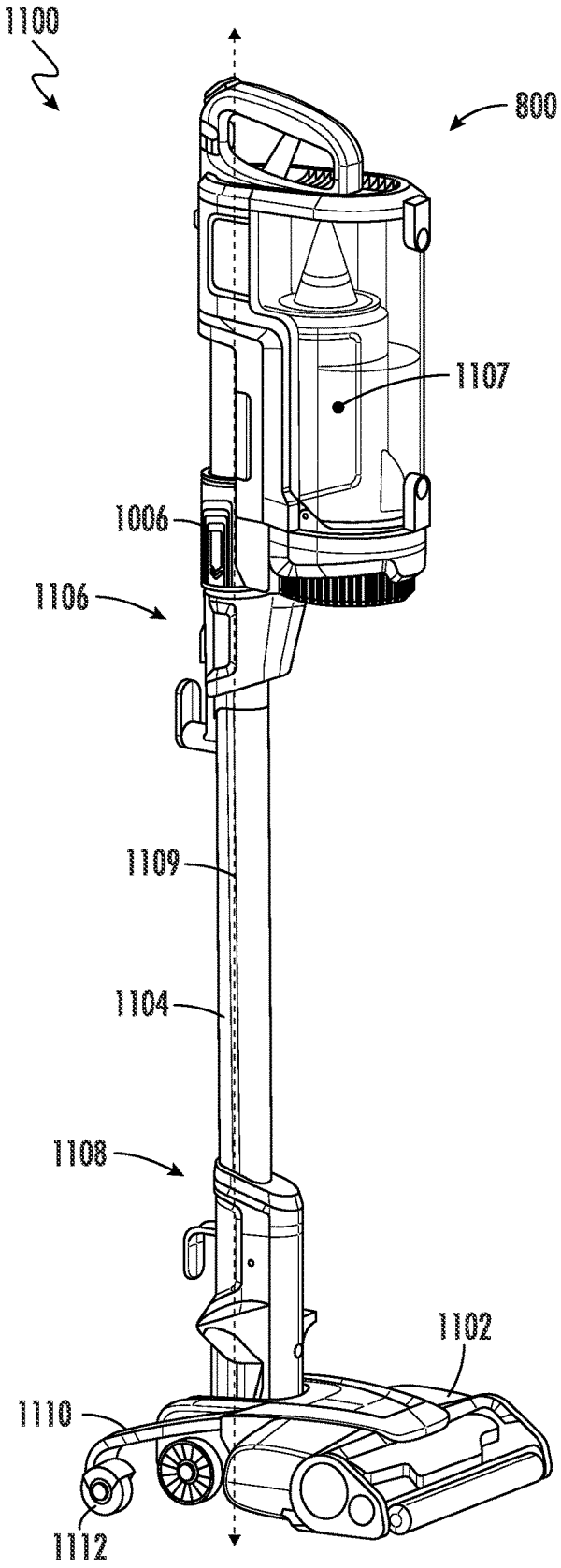
FIG. 11 shows a perspective view of an upright vacuum cleaner including the vacuum pod of FIG. 8, consistent with embodiments of the present disclosure.

FIG. 11 shows a perspective view of an upright vacuum cleaner 1100, which may be an example of the surface treatment apparatus 200 of FIG. 2. As shown, the upright vacuum cleaner 1100 includes the vacuum pod 800 which is fluidly coupled to a surface treatment head 1102 via a wand 1104. A first end 1106 of the wand 1104 is removably coupled to the coupling 1006. As such, the vacuum pod 800 may be decoupled from the wand 1104 and be used independently of the wand 1104 and the surface treatment head 1102. A second end 1108 of the wand 1104 is removably coupled to the surface treatment head 1102. As such, the wand 1104 can be decoupled from the surface treatment head 1102 such that the vacuum pod 800 and the wand 1104 can be used independently of the surface treatment head 1102.

When coupled to the wand 1104 a center of mass 1107 of the vacuum pod 800 may be positioned forward of a central longitudinal axis 1109 of the wand 1104 such that the center of mass 1107 of the vacuum pod 800 is positioned over the surface treatment head 1102. Such a configuration may increase the stability of the upright vacuum cleaner 1100. In some instances, the surface treatment head 1102 may include one or more stabilizers 1110. The stabilizers 1110 may be configured to increase the stability of the upright vacuum cleaner 1100 when in a storage position. As such, the stabilizers 1110 can be configured to transition between a retracted position and an extended position in response to the upright vacuum cleaner 1100 transitioning between an in-use and a storage position (e.g., when the wand 1104 transitions between an upright and a reclined position). In some instances, the stabilizers 1110 may include one or more stabilizer wheels 1112. The stabilizer wheels 1112 may be configured to facilitate movement of the upright vacuum cleaner 1100 when the upright vacuum cleaner 1100 is in a storage position.

Figure 12:
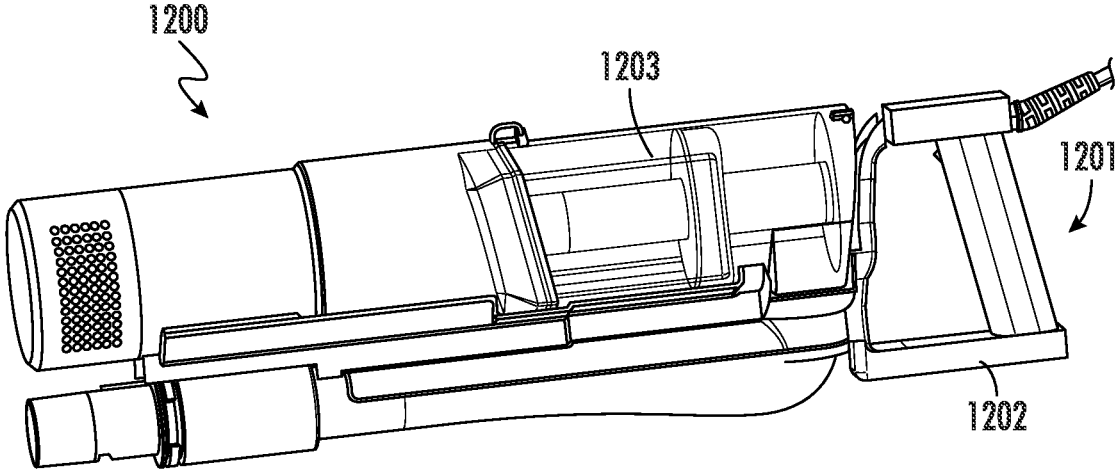
FIG. 12 shows a perspective view of a vacuum pod having a rotatable handle in a first handle position, consistent with embodiments of the present disclosure.
Figure 13:
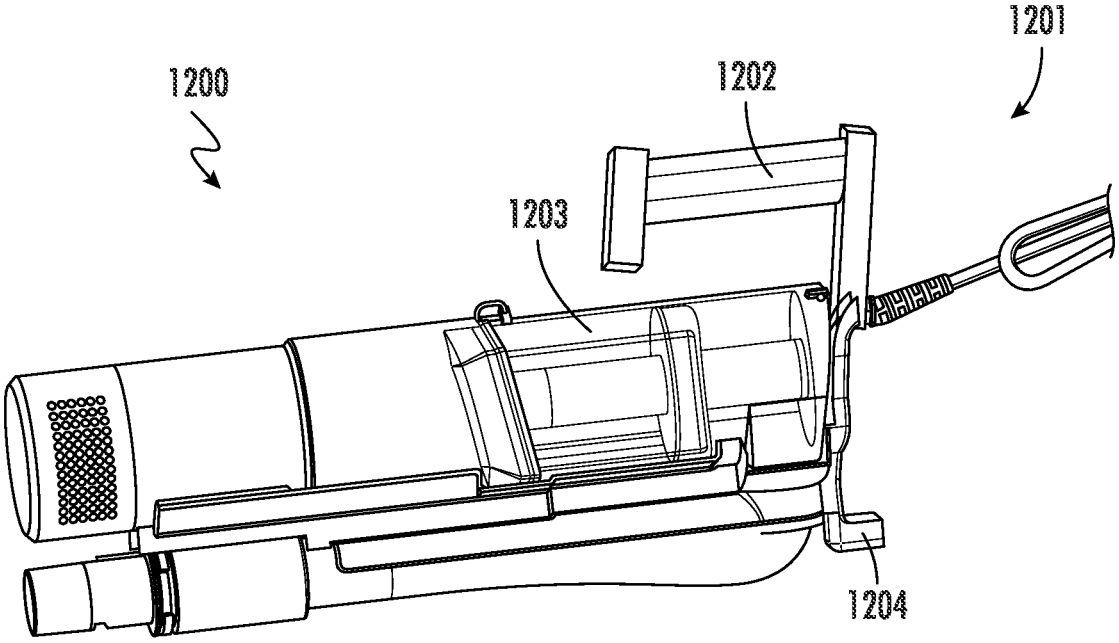
FIG. 13 shows another perspective view of the vacuum pod of FIG. 12 having the rotatable handle in a second handle position, consistent with embodiments of the present disclosure.

FIGS. 12 and 13 show perspective views of a vacuum pod 1200, which may be an example of the vacuum pod 100 of FIG. 1. As shown, the vacuum pod 1200 includes a rotatable handle 1202 positioned at a distal end 1201 of the vacuum pod 1200 proximate a dust cup 1203. The rotatable handle 1202 is configured to transition between a first handle position (FIG. 12) and a second handle position (FIG. 13). The rotatable handle 1202 can be configured to rotate in response to the actuation of a latch 1204. By configuring the rotatable handle 1202 to transition between a first and second handle position, a user may be able to adjust the position of the rotatable handle 1202 based on how the vacuum pod 1200 is being used.

Figure 14:
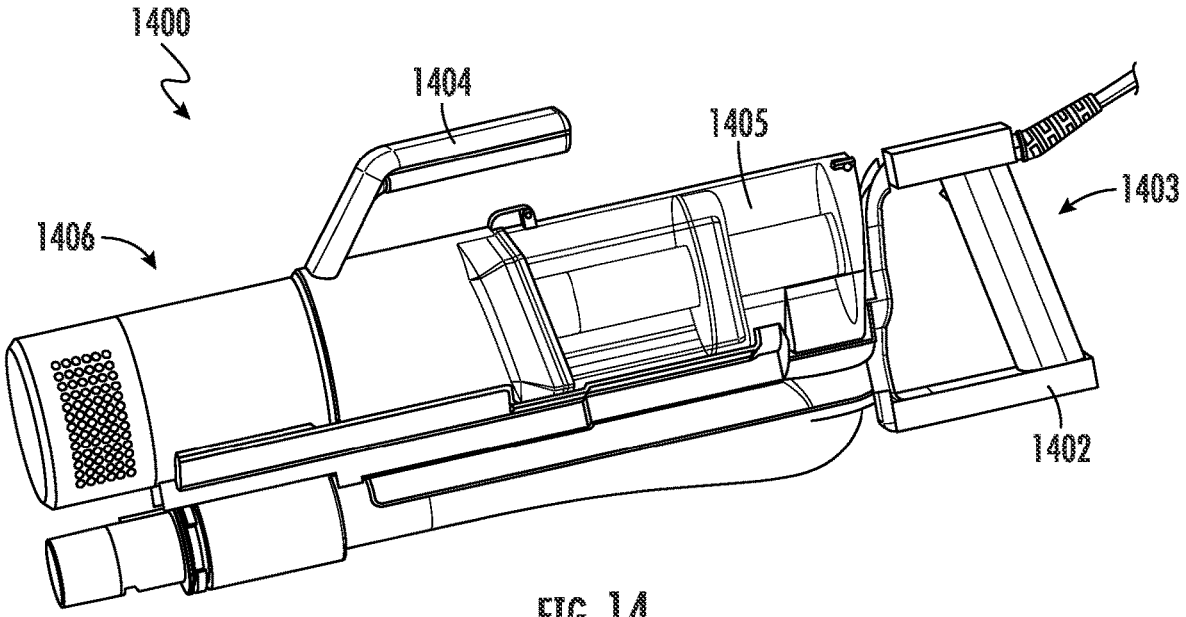
FIG. 14 shows a perspective view of a vacuum pod having a forward and rearward handle, consistent with embodiments of the present disclosure.
Figure 15:
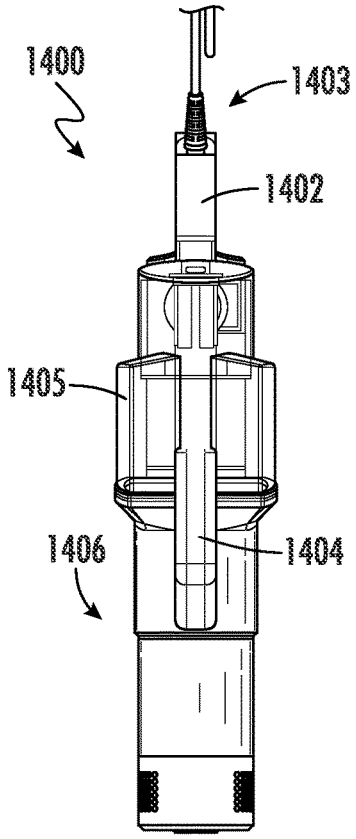
FIG. 15 shows a top view of the vacuum pod of FIG. 14, consistent with embodiments of the present disclosure.

FIGS. 14 and 15 show perspective views of a vacuum pod 1400, which may be an example of the vacuum pod 100 of FIG. 1. As shown, the vacuum pod 1400 includes a rearward handle 1402 disposed at a distal end 1403 of the vacuum pod 1400 and proximate a dust cup 1405. As also shown, the vacuum pod 1400 includes a forward handle 1404 extending from a vacuum pod body 1406 of the vacuum pod 1400. By including the rearward handle 1402 and the forward handle 1404, a user can alternate between the forward and rearward handles 1402 and 1404 based on how the vacuum pod 1400 is being used.

Figure 16:
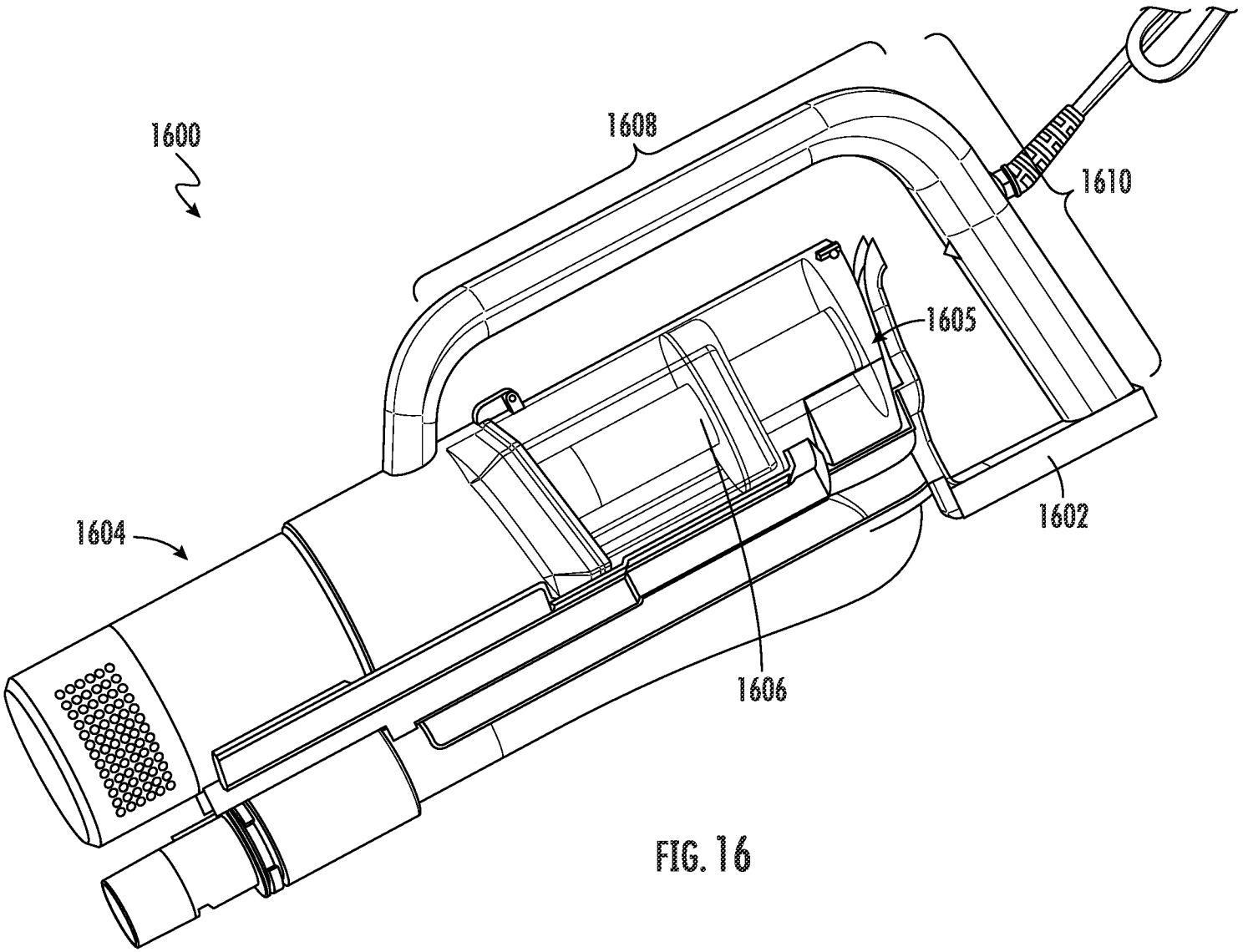
FIG. 16 shows a perspective view of a vacuum pod having a wrap-around handle, consistent with embodiments of the present disclosure.

FIG. 16 shows a perspective view of a vacuum pod 1600, which may be an example of the vacuum pod 100 of FIG. 1. As shown, the vacuum pod 1600 includes a wrap-around handle 1602 that extends along at least a portion of a vacuum pod body 1604 of the vacuum pod 1600 and over a distal end 1605 of a dust cup 1606. As such, the wrap-around handle 1602 can generally be described as having a first hand position 1608 that extends generally parallel to the vacuum pod body 1604 and a second hand position 1610 that extends generally parallel to the distal end 1605 of the dust cup 1606 (e.g., transverse to a longitudinal axis of the vacuum pod body 1604). The first and second hand positions 1608 and 1610 may allow a user to alternate a holding position of the vacuum pod 1600 based on how the vacuum pod 1600 is being used.

Figure 17:
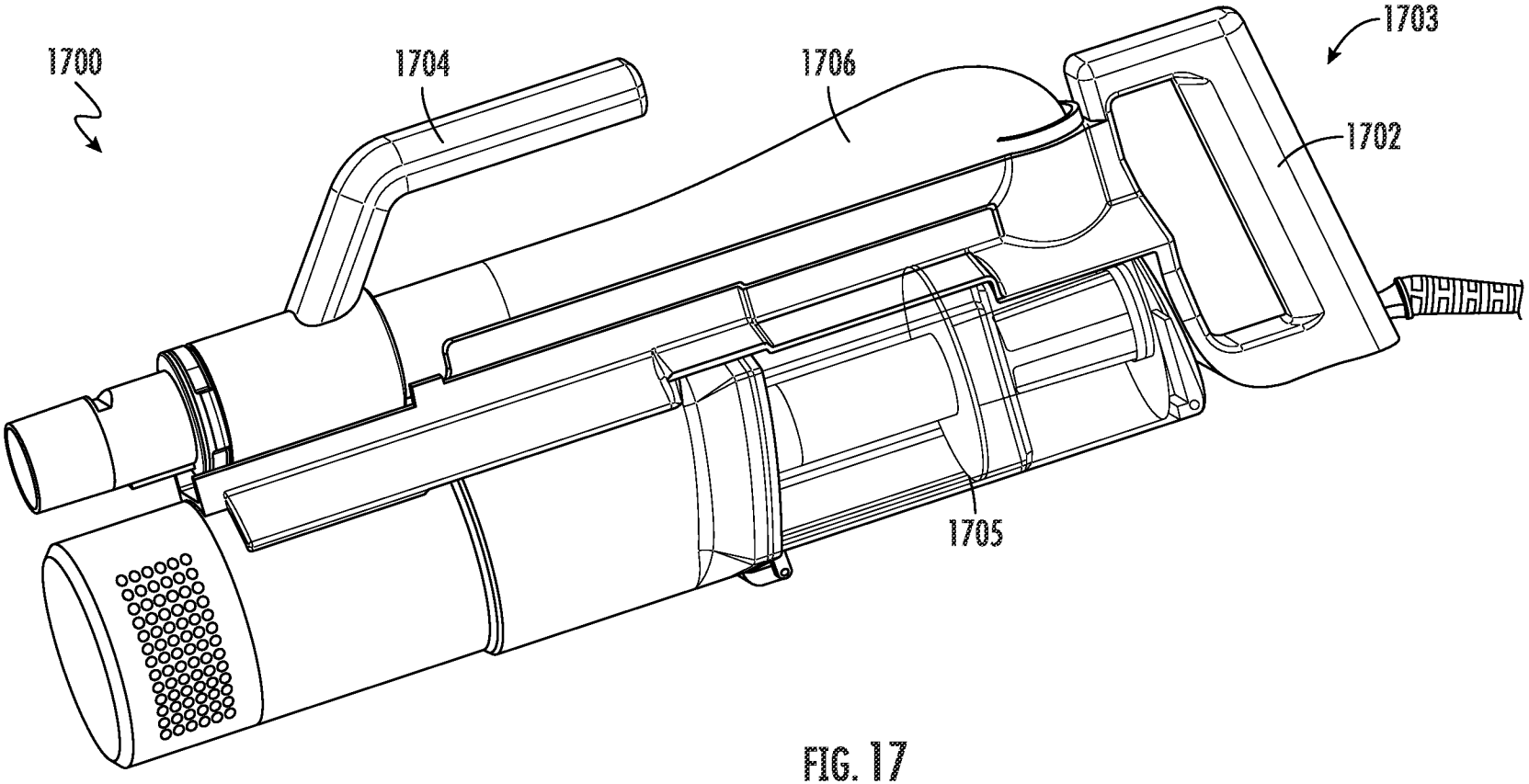
FIG. 17 shows a perspective view of a vacuum pod having a forward handle and a rearward handle, consistent with embodiments of the present disclosure.

FIG. 17 shows a perspective view of a vacuum pod 1700, which may be an example of the vacuum pod 100 of FIG. 1. As shown, the vacuum pod 1700 includes a rearward handle 1702 disposed at a distal end 1703 of the vacuum pod 1700 and proximate a dust cup 1705. As also shown, the vacuum pod 1700 includes a forward handle 1704 extending from a fluid conduit 1706 of the vacuum pod 1700. By including the rearward handle 1702 and the forward handle 1704, a user can alternate between the forward and rearward handles 1702 and 1704 based on how the vacuum pod 1700 is being used.

Figure 18:
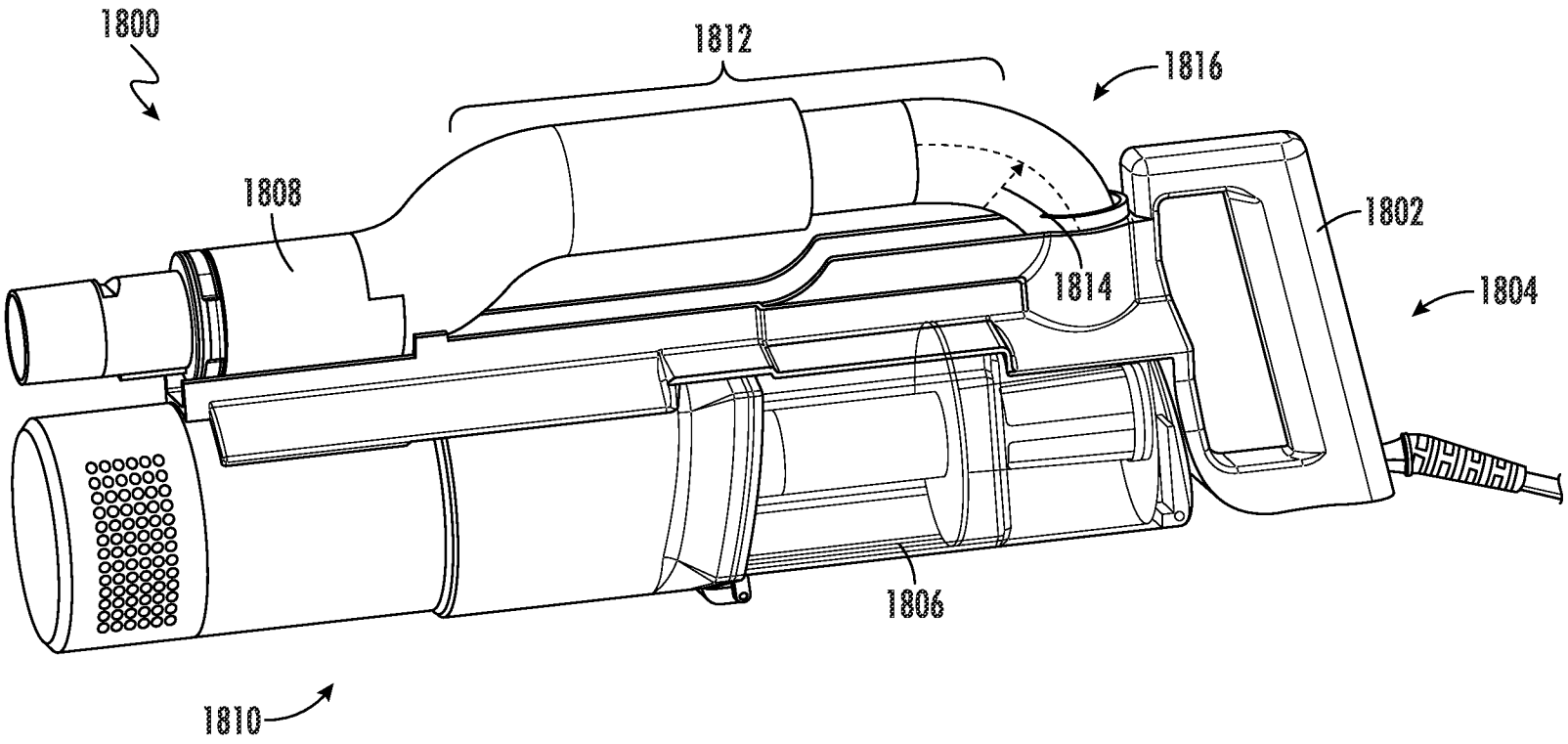
FIG. 18 shows a perspective view of a vacuum pod, wherein at least a portion of a fluid conduit defines a handle portion, consistent with embodiments of the present disclosure.

FIG. 18 shows a perspective view of a vacuum pod 1800, which may be an example of the vacuum pod 100 of FIG. 1. As shown, the vacuum pod 1800 includes a handle 1802 positioned at a distal end 1804 of the vacuum pod 1800 proximate a dust cup 1806. As shown, the vacuum pod 1800 includes a fluid conduit 1808 extending along a vacuum pod body 1810 of the vacuum pod 1800. As also shown, the fluid conduit 1808 defines a handle portion 1812. As shown, the handle portion 1812 is defined at a location along the fluid conduit 1808 where the fluid conduit 1808 extends in a direction away from the vacuum pod body 1810 for a first predetermined distance and then extends generally parallel to the vacuum pod body 1810 for a second predetermined distance before extending in a direction towards the vacuum pod body 1810. The first and second predetermined distances may be selected such that a user can grasp the fluid conduit 1808 at the handle portion 1812.

When the fluid conduit 1808 defines the handle portion 1812, a radius 1814 of a connection portion 1816 of the fluid conduit 1808 may be increased (e.g., relative to a vacuum pod not having the handle portion 1812). As shown, the connection portion 1816 is coupled to an inlet to the dust cup 1806. As such, by increasing the radius 1814 fluid flow is more gradually urged into the dust cup 1806, which may improve the performance of the vacuum pod 1800.

Figure 19:
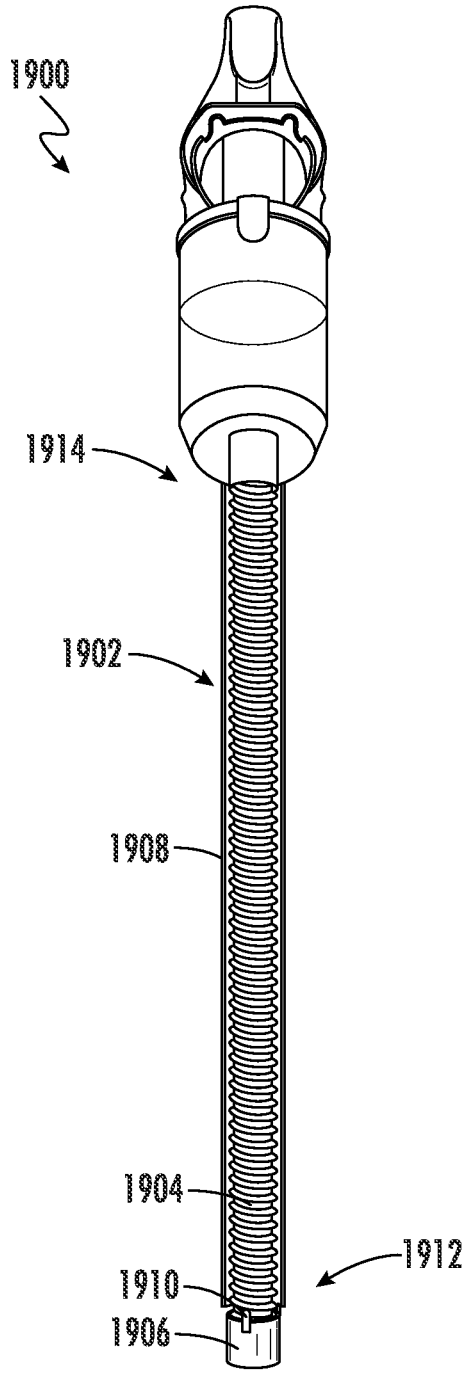
FIG. 19 shows a perspective view of a vacuum pod having an extension channel configured to receive at least a portion of a fluid conduit, consistent with embodiments of the present disclosure.

FIG. 19 shows an example of a vacuum pod 1900, which may be an example of the vacuum pod 100 of FIG. 1. As shown, the vacuum pod 1900 includes a fluid conduit 1902. The fluid conduit 1902 includes a flexible hose 1904 and a coupling 1906. As shown, when in an extended position, the flexible hose 1904 can be configured to extend within an extension channel 1908. The extension channel 1908 can be configured to maintain the flexible hose 1904 in an extended position. As such, the vacuum pod 1900 can be stored and/or used with the flexible hose 1904 in an extended position without an operator exerting a continuous force on the flexible hose 1904 to maintain the flexible hose 1904 in the extended position. For example, the extension channel 1908 can be configured to couple to the coupling 1906 using one or more catches 1910 that extend from the coupling 1906. In some instances, the coupling 1906 may also be configured such that it can be removably coupled to the vacuum pod 1900.

The extension channel 1908 can extend circumferentially around at least a portion of the flexible hose 1904. A distal end 1912 of the extension channel 1908 and/or the coupling 1906 may be configured to directly couple to one or more cleaning accessories such that the cleaning accessories are fluidly coupled to the vacuum pod 1900. A proximal end 1914 of the extension channel 1908 can be configured to be coupled to the vacuum pod 1900, wherein the proximal end 1914 of the extension channel 1908 is opposite the distal end 1912 of the extension channel 1908.

Figure 20:
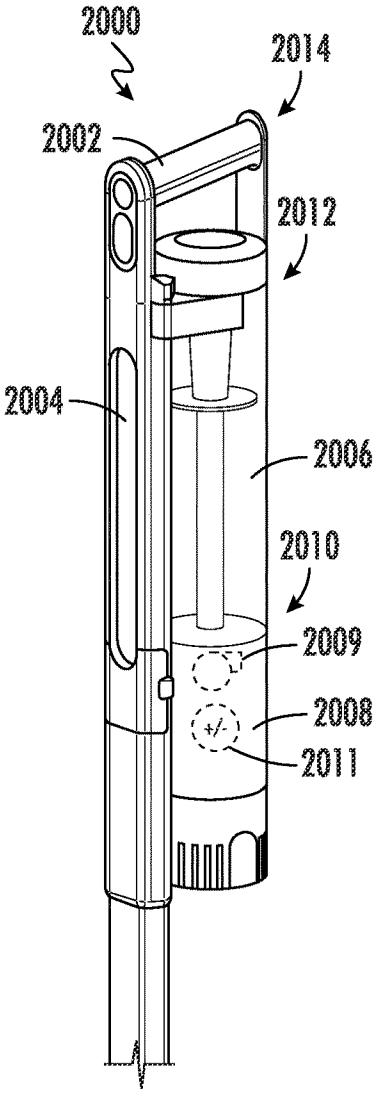
FIG. 20 shows a perspective view of an example of a vacuum pod configured to be operated using one or more batteries, consistent with embodiments of the present disclosure.

FIG. 20 shows an example of a vacuum pod 2000, which may be one example of the vacuum pod 100 of FIG. 1. The vacuum pod 2000 includes a handle 2002, a fluid conduit 2004, a dust cup 2006 having a first distal end 2010 that is opposite a second distal end 2012, and a motor compartment 2008. As shown, the dust cup 2006 can be disposed between the handle 2002 and the motor compartment 2008. The motor compartment 2008 can be configured to receive a suction motor 2009 and one or more batteries 2011 for powering the suction motor 2009. As such, the one or more batteries 2011 and suction motor 2009 are positioned at the first distal end 2010 of the dust cup 2006 and the handle 2002 is positioned at a second distal end 2012 of the dust cup 2006. As such, a center of mass of the vacuum pod 2000 can be positioned further from the handle 2002.

In some instances, the one or more batteries 2011 may be positioned at a location between the suction motor 2009 and the dust cup 2006. As such, air exiting the dust cup 2006 may be used to cool the one or more batteries 2011. In other instances, the suction motor 2009 may be positioned at a location between the one or more batteries 2011 and the dust cup 2006. As such, air exiting the suction motor 2009 may be used to cool the one or more batteries 2011.

As also shown, the dust cup 2006 and the motor compartment 2008 can extend below the handle 2002 such that the dust cup 2006 and the motor compartment 2008 are positioned on a user facing side 2014 of the vacuum pod 2000. However, other configurations are possible. For example, the dust cup 2006 and the motor compartment 2008 can be positioned on a side opposite the user facing side 2014 of the vacuum pod 2000.

Figure 21:
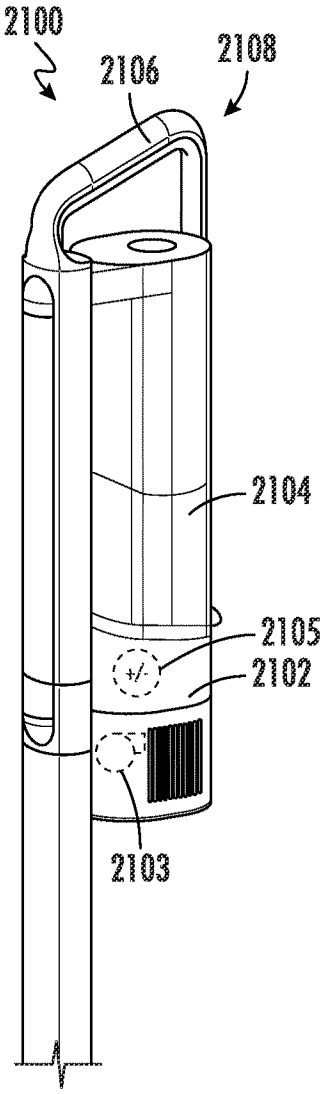
FIG. 21 shows a perspective view of an example of a vacuum pod configured to be operated using one or more batteries, consistent with embodiments of the present disclosure.

FIG. 21 shows another example of a vacuum pod 2100 having a motor compartment 2102 configured to receive a suction motor 2103 and one or more batteries 2105 to power the suction motor 2103 and may be an example of the vacuum pod 100 of FIG. 1. As shown, the vacuum pod 2100 includes a dust cup 2104 positioned between a handle 2106 and the motor compartment 2102.

In some instances, the one or more batteries 2105 may be positioned at a location between the suction motor 2103 and the dust cup 2104. As such, air exiting the dust cup 2104 may be used to cool the one or more batteries 2105. In other instances, the suction motor 2103 may be positioned at a location between the one or more batteries 2105 and the dust cup 2104. As such, air exiting the suction motor 2103 may be used to cool the one or more batteries 2105.

As also shown, the dust cup 2104 and the motor compartment 2102 can extend below the handle 2106 such that the dust cup 2104 and the motor compartment 2102 are positioned on a user facing side 2108 of the vacuum pod 2100. However, other configurations are possible. For example, the dust cup 2104 and the motor compartment 2102 can be positioned on a side opposite of the user facing side 2108 of the vacuum pod 2100.

Figure 22:
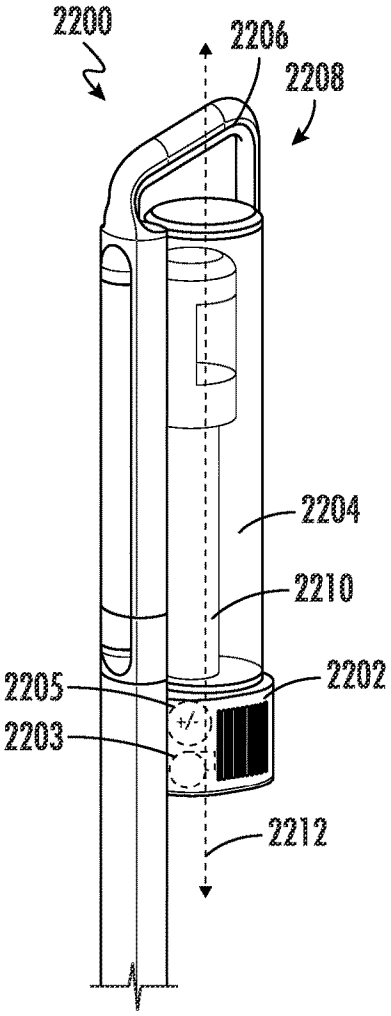
FIG. 22 shows a perspective view of an example of a vacuum pod configured to be operated using one or more batteries, consistent with embodiments of the present disclosure.

FIG. 22 shows another example of a vacuum pod 2200 having a motor compartment 2202 configured to receive a suction motor 2203 and one or more batteries 2205 for powering the suction motor 2203 and may be an example of the vacuum pod 100 of FIG. 1. As shown, the vacuum pod 2200 includes a dust cup 2204 positioned between a handle 2206 and the motor compartment 2202.

In some instances, the one or more batteries 2205 can be positioned adjacent a perimeter of the suction motor 2203. For example, a plurality of batteries 2205 can extend around a perimeter of the suction motor 2203. In these instances, a longitudinal axis of the one or more batteries 2205 may be substantially parallel with an axis of the suction motor 2203 that extends parallel to the air flow direction into the suction motor 2203.

As also shown, the dust cup 2204 and the motor compartment 2202 can extend below the handle 2206 such that the dust cup 2204 and the motor compartment 2202 are positioned on a user facing side 2208 of the vacuum pod 2200. However, other configurations are possible. For example, the dust cup 2204 and the motor compartment 2202 can be positioned on a side opposite of the user facing side 2208 of the vacuum pod 2200.

As also shown, in some instances, a pre-motor filter 2210 can extend within the dust cup 2204 along a longitudinal axis 2212 of the dust cup 2204. Such a configuration may allow for a reduction in the width of the dust cup 2204 when compared to using, for example, a ring pre-motor filter.

Figure 23:
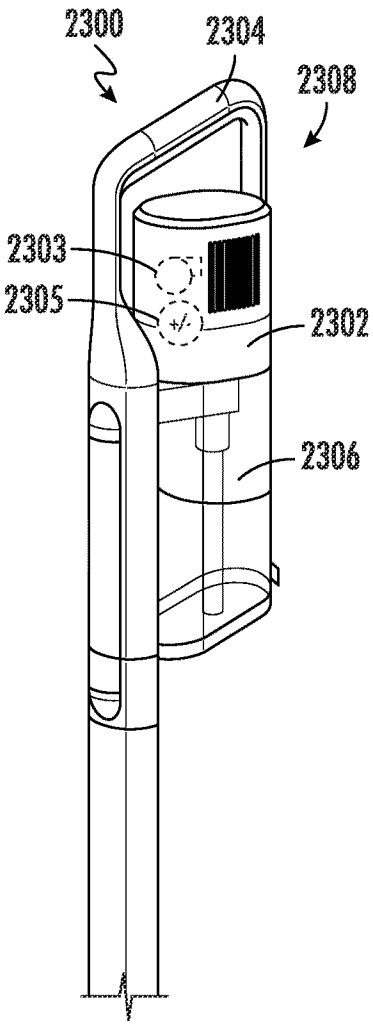
FIG. 23 shows a perspective view of an example of a vacuum pod configured to be operated using one or more batteries, consistent with embodiments of the present disclosure.

FIG. 23 shows an example of a vacuum pod 2300, which may be an example of the vacuum pod 100 of FIG. 1. As shown, the vacuum pod 2300 can include a motor compartment 2302 positioned between a handle 2304 and a dust cup 2306. The motor compartment 2302 can be configured to receive a suction motor 2303 and one or more batteries 2305 for powering the suction motor.

In some instances, the batteries may be positioned at a location between the suction motor 2303 and the dust cup 2306. As such, air exiting the dust cup 2306 may be used to cool the batteries 2305. In other instances, the suction motor 2303 may be positioned at a location between the batteries 2305 and the dust cup 2306. As such, air exiting the suction motor 2303 may be used to cool the batteries 2305.

As also shown, the dust cup 2306 and the motor compartment 2302 can extend below the handle 2304 such that the dust cup 2306 and the motor compartment 2302 are positioned on a user facing side 2308 of the vacuum pod 2300. However, other configurations are possible. For example, the dust cup 2306 and the motor compartment 2302 can be positioned on a side opposite the user facing side 2308 of the vacuum pod 2300.

Figure 24:
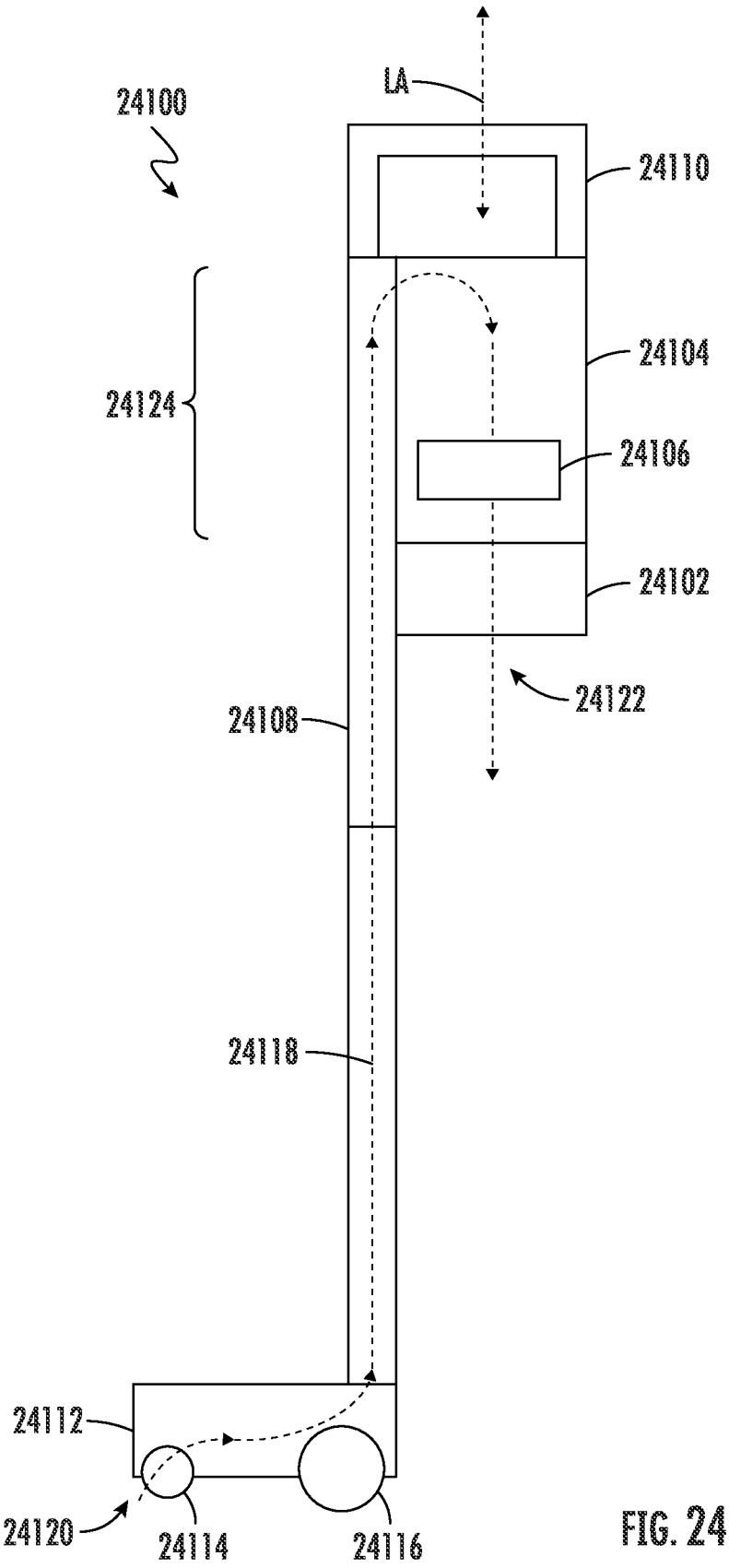
FIG. 24 shows a schematic cross-sectional view of a vacuum cleaner including a motor-battery assembly, consistent with embodiments of the present disclosure.

FIG. 24 shows a schematic cross-sectional view of an exemplary embodiment of a vacuum cleaner 24100, which may be an example of the surface treatment apparatus 200 of FIG. 2, having a motor-battery assembly 24102. The vacuum cleaner 24100 may include a debris compartment (or dust cup) 24104, one or more pre-motor filters 24106, and a fluid conduit 24108. The vacuum cleaner 24100 may also optionally include a handle 24110 and a surface treatment head 24112. The surface treatment head 24112 may include one or more rotatable agitators 24114 and/or one or more wheels 24116. It should be understood that the vacuum cleaner 24100 shown is for exemplary purposes only and that the motor-battery assembly 24102 may be used in combination with any type of vacuum cleaner 24100 including, but not limited to, an "all in the head" type vacuum, upright vacuum cleaners, canister vacuum cleaners, stick vacuum cleaners, robotic vacuum cleaners, and central vacuum systems.

As explained herein, the motor-battery assembly 24102 includes one or more suction motors, batteries, and motor/battery controllers. The motor-battery assembly 24102 may be fluidly coupled to the debris compartment 24104 and fluid conduit 24108 such that when the suction motor is activated, fluid (e.g., air) flows along a flow path 24118 extending from the air inlet 24120, through the fluid conduit 24108, debris compartment 24104, and motor-battery assembly 24102 and exits the vacuum cleaner 24100 at an exhaust outlet 24122 (which may be located in the motor-battery assembly 24102).

As shown, the debris compartment 24104 may be disposed between the handle 24110 and the motor-battery assembly 24102. This positions the handle 24110 and the motor-battery assembly 24102 at opposing end regions of the main body 24124 of the vacuum cleaner 24100 (e.g., on opposing sides of a central plane extending through the center of the vacuum cleaner 24100 and that is perpendicular to a longitudinal axis of the vacuum cleaner 24100). The debris compartment 24104 and the motor-battery assembly 24102 may be disposed along a longitudinal axis LA. The axis LA may be a central axis of the debris compartment 24104. Additionally, or alternatively, a center of mass of the motor-battery assembly 24102 may be generally aligned with the axis LA. The motor-battery assembly 24102 may have any orientation relative to the axis LA.

The fluid conduit 24110 may include a flexible and/or expandable hose. In these instances, the fluid conduit 24110 can be configured to include a portion that is removably coupled to the main body 24124 of the vacuum cleaner 24100 such that a portion of the fluid conduit 24108 can be maneuvered independently of, for example, the debris compartment 24104 and the motor-battery assembly 24102. As a result, a user can carry a main body 24128 (e.g., the portion of vacuum cleaner 24100 housing at least the debris compartment 24104 and the motor-battery assembly 24102) of the vacuum cleaner 24100 in one hand while maneuvering the fluid conduit 24108 with the other.

Figure 25:
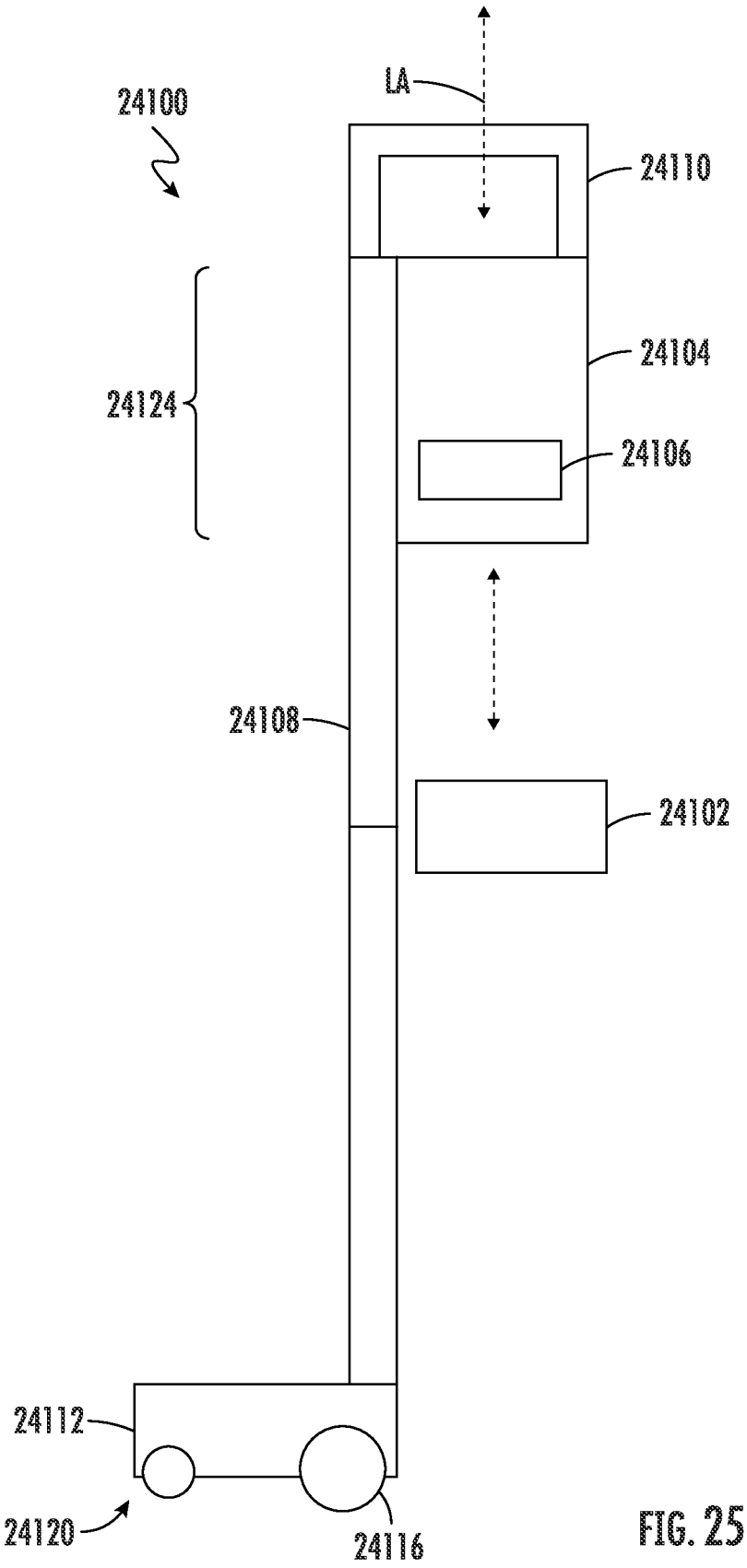
FIG. 25 shows a schematic view of one embodiment a motor-battery assembly disconnected from the vacuum cleaner of FIG. 24, consistent with embodiments of the present disclosure.

According to one embodiment, the motor-battery assembly 24102 may be integral with the vacuum cleaner 24100 (e.g., the main body 24124 of the vacuum cleaner 24100). As used herein, the motor-battery assembly 24102 is integral with the vacuum cleaner 24100 if the motor-battery assembly 24102 cannot be removed from the vacuum cleaner 24100 by the user without the use of tools. Alternatively, the motor-battery assembly 24102 may be removably coupled to the vacuum cleaner 24100 (e.g., the main body 24124 vacuum cleaner 24100) as generally illustrated in FIG. 25. The motor-battery assembly 24102 may be removably coupled to the vacuum cleaner 24100 using any mechanism known to those skilled in the art including, but not limited to, releasable clips, detents, magnetic connections, clamps, or the like.

Figure 26:
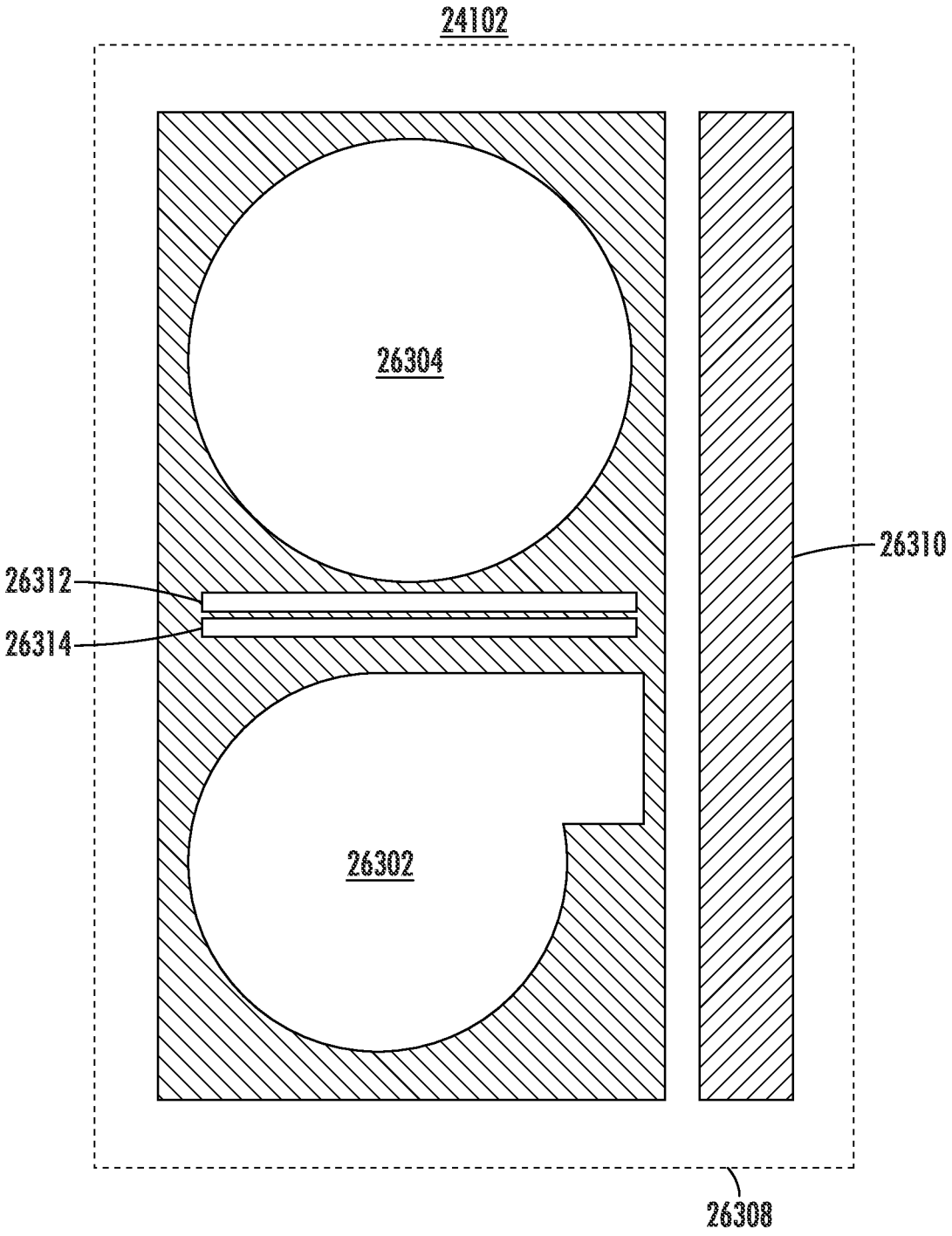
FIG. 26 shows a schematic view of one embodiment a motor-battery assembly, consistent with embodiments of the present disclosure.

Referring now to FIG. 26, one embodiment of the motor-battery assembly 24102 is generally illustrated. The motor-battery assembly 24102 may include one or more suction motors 26302, one or more batteries 26304, and one or more motor/battery controllers 26306 at least partially disposed within a housing 26308. As described herein, the suction motor 26302 may include an electric motor coupled to a fan and may be configured to generate the airflow along path 24118 for entraining debris and transporting the debris into the debris compartment 24104, e.g., as directed by the motor/battery controllers 26306. For example, the fan may be directly coupled to the electric motor and may include an inlet configured to be fluidly coupled to the debris compartment 24104 for drawing air through the vacuum cleaner 24100 as described herein. The fan may include an outlet configured to discharge the air from the suction motor 26302. The outlet may be configured to flow air around one or more of the batteries 26304 (e.g., to cool the batteries 26304) and/or through one or more optional post-motor filters 26310. The filter 26310 may be at least partially disposed within the housing 26308 and may include a fine filtration filter such as, but not limited to, a high efficiency particulate air (HEPA) filter or the like.

The batteries 26304 may include one or more rechargeable batteries. The batteries 26304 may be configured to provide electrical power to the suction motor 26302, for example, as directed by the motor/battery controllers 26306. The batteries 26304 may optionally additionally provide power to any other electrical device coupled to the vacuum cleaner 24100 such as, but not limited to, the motors driving the agitator 24114, any lights on the vacuum cleaner 24100, any control circuitry, and/or to provide power to drive wheels (e.g., in the case wherein the vacuum cleaner 24100 is a robotic vacuum cleaner). At least one of the batteries 26304 may be disposed proximate to the suction motor 26302. As used herein, a battery 26304 is proximate to the suction motor 26302 if the separation distance between the battery 26302 and the suction motor 26302 is less than a maximum outer dimension of the suction motor 26302. According to one embodiment, all of the batteries 26304 within the housing 26308 may be proximate to the suction motor 26302. Optionally, one or more thermal barriers 26312 and/or noise barriers 26314 may be disposed between one or more of the batteries 26304 and the suction motor 26302 and/or between the suction motor 26302 and the housing 26308. The thermal barriers 26312 may be configured to reduce the amount of heat transferred between the suction motor 26302 and the batteries 26304, thereby improving the efficiency of the motor-battery assembly 24102. The noise barrier 26314 may be configured to reduce the amount of noise emitted from the motor-battery assembly 24102.

The motor/battery controllers 26306 may be configured to regulate electrical power provided to the suction motor 26302 and/or configured to regulate the charging/discharging of the batteries 26304. For example, the motor battery controller 26306 may include a signal controller 26305 configured to control power provided to the suction motor 26302 and to regulate charging and/or discharging of the batteries 26304. The motor/battery controllers 26306 may also be configured to regulate electrical power provided to other devices (e.g., lights, agitators, etc.) coupled to the vacuum cleaner 24100. The motor/battery controllers 26306 may be implemented as a processing device/circuit such as, for example, a field-programmable gate array (FPGA), Reduced Instruction Set Computer (RISC) processor, x86 instruction set processor, microcontroller, an application-specific integrated circuit (ASIC). The motor/battery controllers 26306 may be configured to execute a plurality of instructions to carry out processes in accordance with various aspects and embodiments disclosed herein. For example, the motor/battery controllers 26306 may be configured to execute battery charging/discharging algorithms/processes for charging/discharging the batteries 26304 and/or regulating electrical power to the suction motors 26302. The algorithms/processes may be may be implemented, for example, using software (e.g., C or C++ executing on the motor/battery controllers 26306), hardware (e.g., hardcoded gate level logic or purpose-built silicon including, for example, one or more printed circuit boards, PCBs) or firmware (e.g., embedded routines executing on a microcontroller), or any combination thereof. As disclosed herein, the motor/battery controllers 26306 may a single, integrated controller for regulating electrical power provided to the suction motor 26302 and for regulating the charging/discharging of the batteries 26304. Alternatively, the motor/battery controllers 26306 may include a first controller for regulating electrical power provided to the suction motor 26302 and a second, separate controller for regulating the charging/discharging of the batteries 26304.

Figure 27:
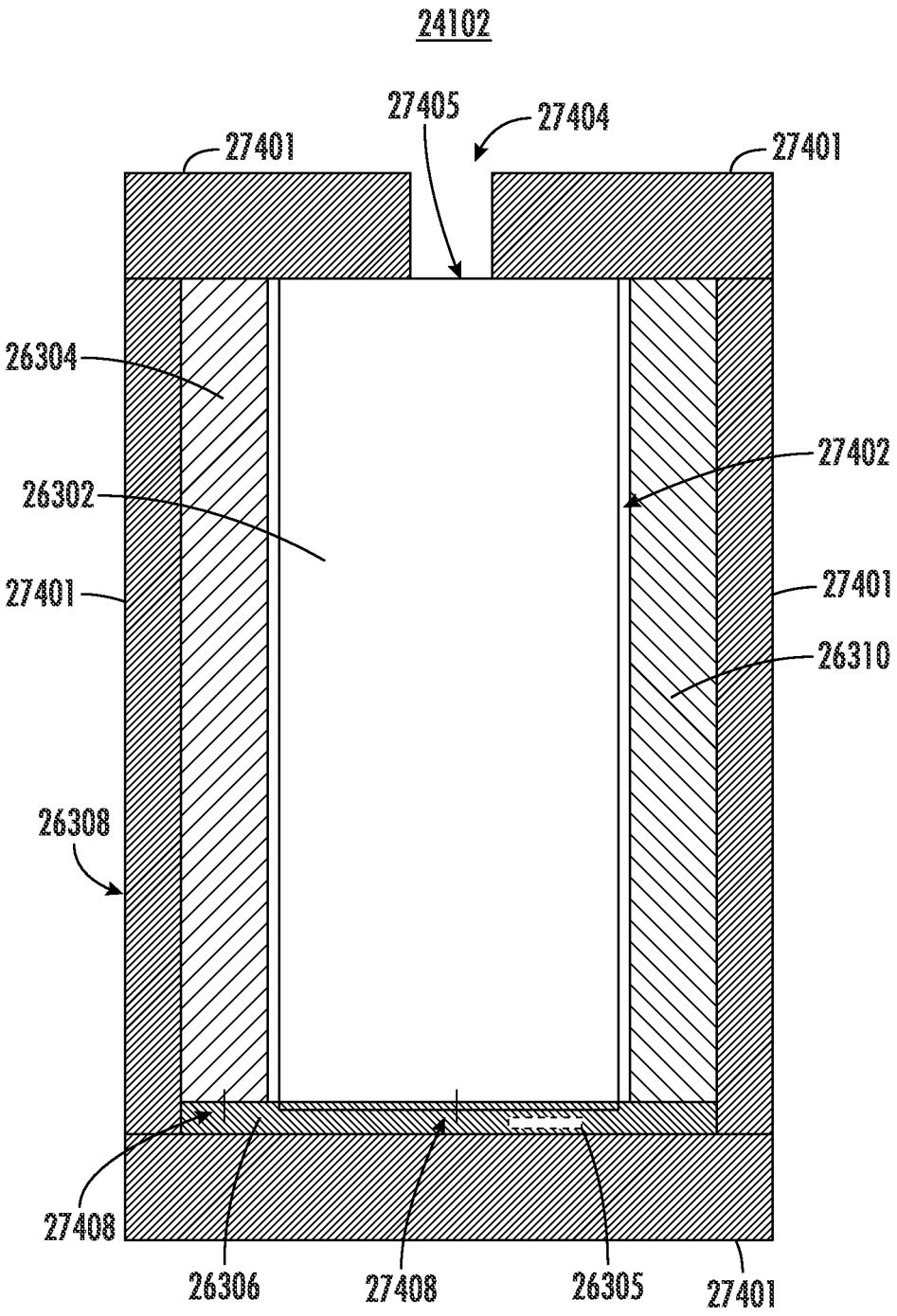
FIG. 27 shows a cross-sectional view of another embodiment of a motor-battery assembly, consistent with embodiments of the present disclosure.
Figure 28:
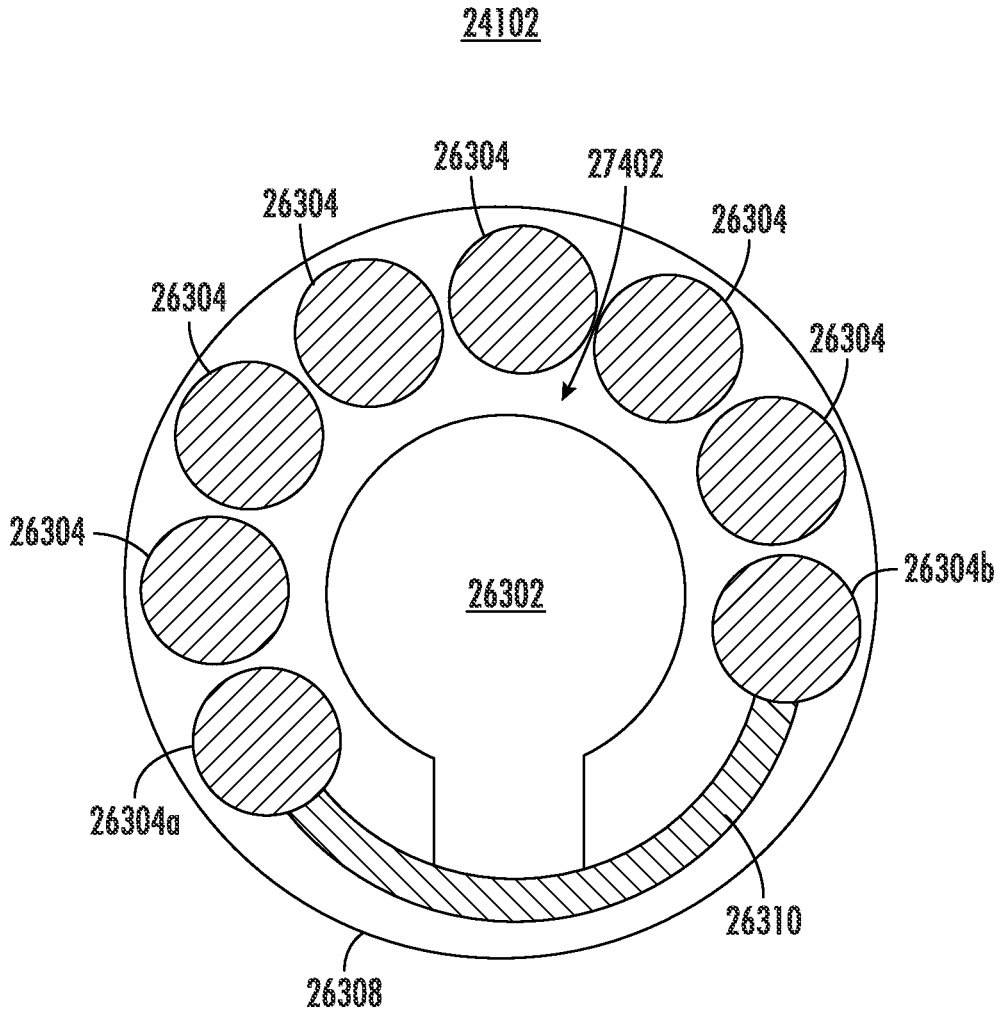
FIG. 28 shows a cross-sectional view of one arrangement of the batteries of a motor-battery assembly, consistent with embodiments of the present disclosure.
Figure 29:
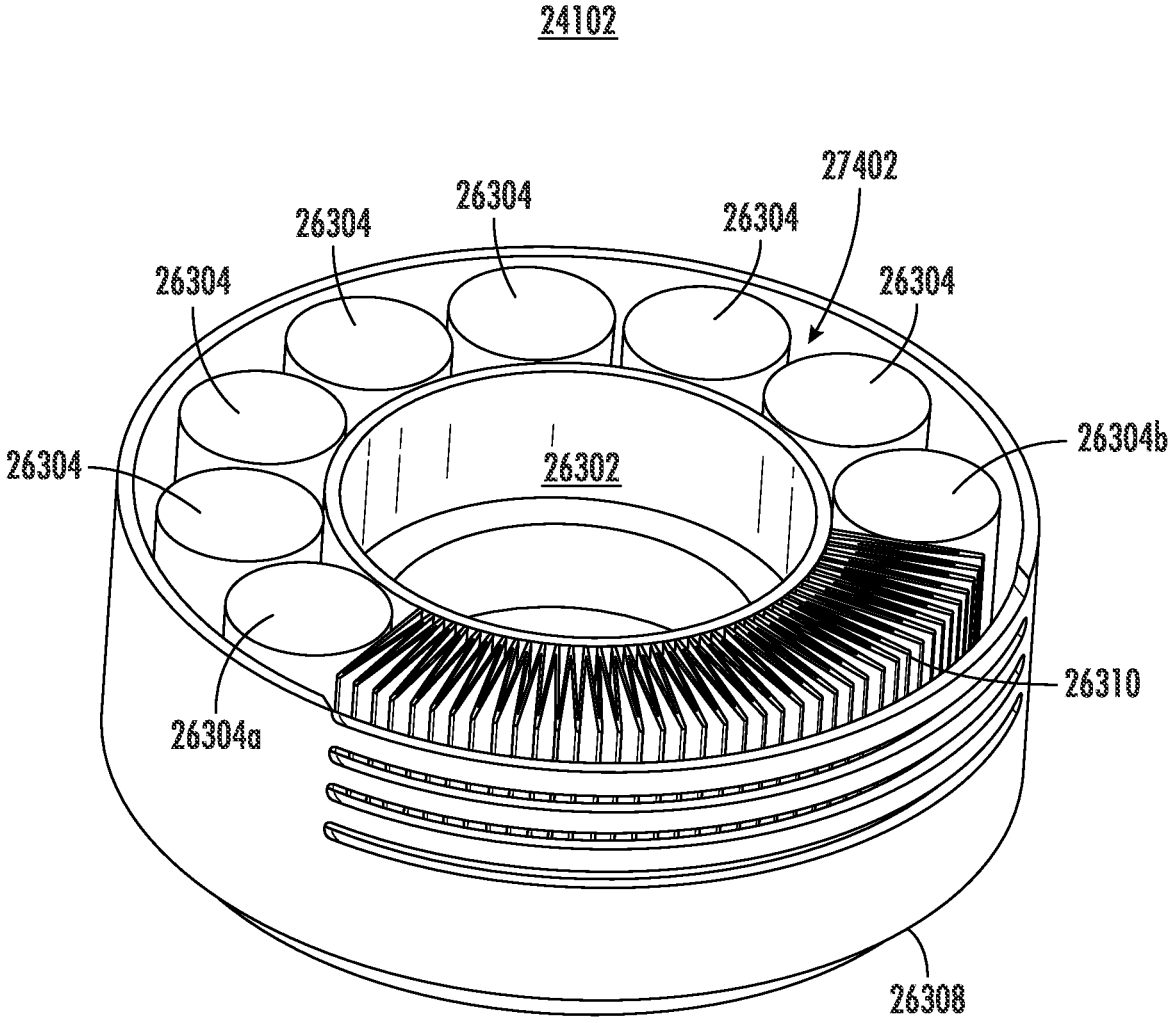
FIG. 29 shows another cross-sectional view of an arrangement of the batteries of a motor-battery assembly, consistent with embodiments of the present disclosure.

Turning now to FIG. 27, a cross-sectional view of another embodiment of the motor-battery assembly 24102 is generally illustrated. In particular, the housing/body 26308 may include one or more sidewalls 27401 at least partially defining one or more cavities 27402. For example, the housing 26308 may define a single cavity 27402 configured to at least partially receive the suction motors 26302, batteries 26304, motor/battery controller 26306, and/or filter 26310. Alternatively, the housing 26308 may define a plurality of cavities 27402, each cavity 27402 configured to at least partially receive one or more of the suction motors 26302, batteries 26304, motor/battery controller 26306, and/or filter 26310. In the illustrated embodiment, the motor/battery controller 26306 may be disposed proximate to the bottom of the housing 26308. For example, the housing 26308 may include an opening 27404 configured to allow the inlet 27405 of the suction motor 26302 to fluidly couple with the debris container 24104. The motor/battery controller 26306 may be disposed on a sidewall 27401 that is generally opposite to the sidewall 27401 defining the opening 27404. The motor/battery controller 26306 may also include one or more electrical and/or mechanical connections 27408 for electrically coupling the motor/battery controller 26306 to the suction motor 26302 and to the batteries 26304, and optionally for mechanically coupling, mounting, or otherwise securing the suction motor 26302 and/or the batteries 26304 to the motor/battery controller 26306. Alternatively (or in addition), the motor/battery controller 26306 may be mechanically coupled, mounted, or otherwise secured to the housing 26308.

With reference to FIGS. 28-33, the motor-battery assembly 24102 may include batteries 26304, which may be arranged within the housing 26308 around at least a portion of the perimeter of the suction motor 26302. The batteries 26304 may be arranged in any configuration including, but not limited to, arcuate configurations, linear configurations, non-linear configurations, one or more groups, or the like. For example, the motor-battery assembly 24102 may include batteries 26304 arranged in one or more arcuate configurations around at least a portion of the suction motor 26302 as generally illustrated in the cross-sectional view of FIGS. 28 and 29. As can be seen, the batteries 26304 may be arranged along only a portion of a generally circular configuration. According to one embodiment, the suction motor 26302 may be disposed generally at the center of the circular arrangement, though this is not a limitation of the present disclosure unless specifically claimed as such. According to one embodiment, the batteries 26304 may be arranged along a portion of one or more arcs extending between 15 degrees and 360 degrees relative to the suction motor 26302, for example, along a portion of one or more arcs extending between 45 degrees and 360 degrees relative to the suction motor 26302, along a portion of one or more arcs extending between 90 degrees and 360 degrees relative to the suction motor 26302, along a portion of one or more arcs extending between 180 degrees and 360 degrees relative to the suction motor 26302, along a portion of one or more arcs extending between 200 degrees and 360 degrees relative to the suction motor 26302, along a portion of one or more arcs extending between 250 degrees and 360 degrees relative to the suction motor 26302, along a portion of one or more arcs extending between 300 degrees and 360 degrees relative to the suction motor 26302, and/or along a portion of one or more arcs extending between 300 degrees and 320 degrees relative to the suction motor 26302, including all values and ranges therein.

Optionally, one or more filters 26310 may be disposed within the housing 26308 and may also extend between two or more batteries 26304. According to one embodiment, a filter 26310 may be disposed between the batteries 26304*a*, 26304*b* that define the beginning and end of the one or more arcs. For example, the filter 26310 may be arranged along a portion of one or more arcs extending between greater than 0 degrees and 180 degrees relative to the suction motor 26302, for example, along a portion of one or more arcs extending between greater than 0 degrees and 120 degrees relative to the suction motor 26302, along a portion of one or more arcs extending between greater than 0 degrees and 100 degrees relative to the suction motor 26302, along a portion of one or more arcs extending between greater than 0 degrees and 90 degrees relative to the suction motor 26302, along a portion of one or more arcs extending between greater than 0 degrees and 60 degrees relative to the suction motor 26302, along a portion of one or more arcs extending between greater than 0 degrees and 45 degrees relative to the suction motor 26302, along a portion of one or more arcs extending between greater than 0 degrees and 30 degrees relative to the suction motor 26302, and/or along a portion of one or more arcs extending between greater than 0 degrees and 15 degrees relative to the suction motor 302, including all values and ranges therein.

Figure 30:
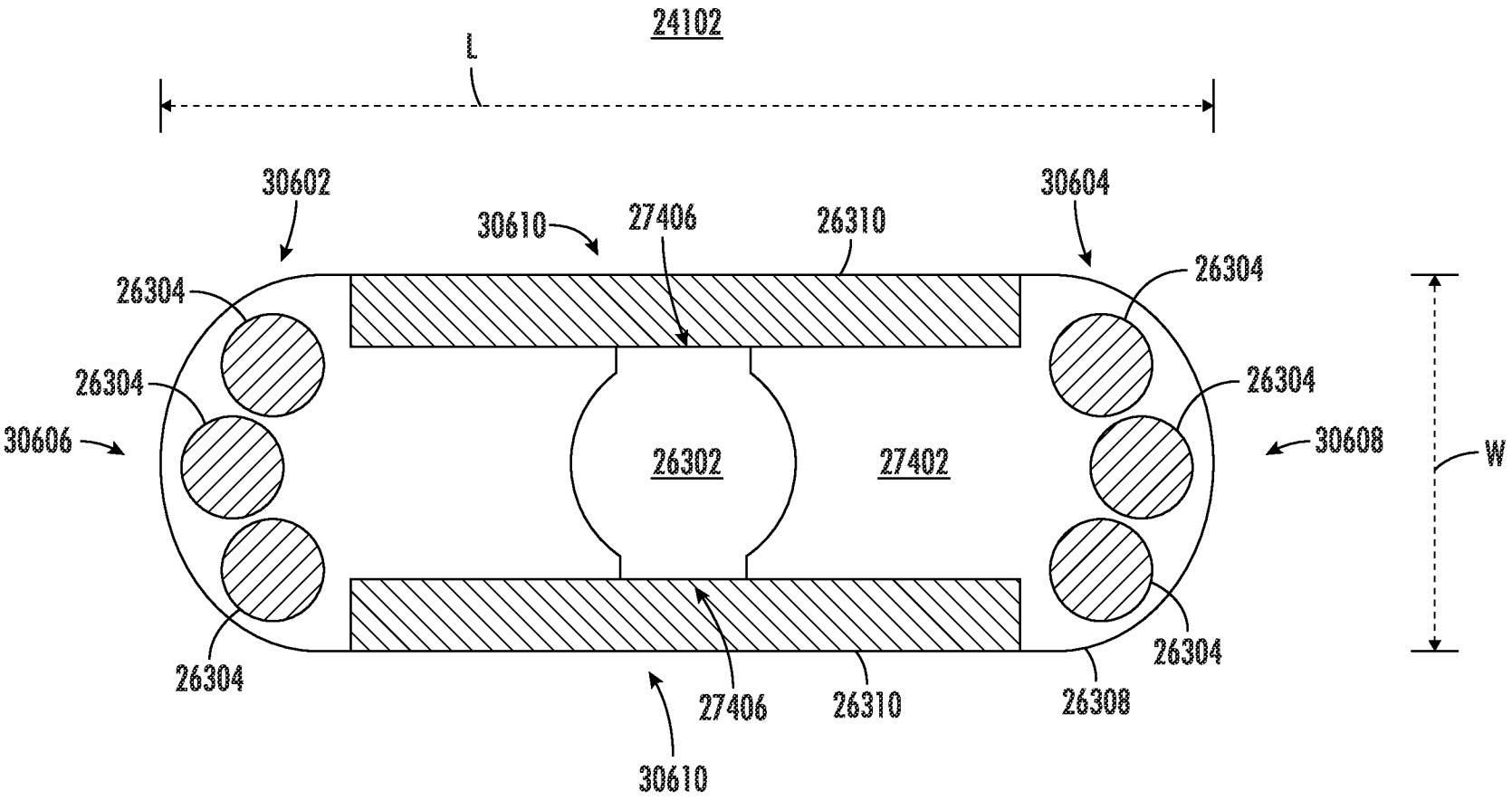
FIG. 30 shows a cross-sectional view of another arrangement of the batteries of a motor-battery assembly, consistent with embodiments of the present disclosure.
Figure 31:
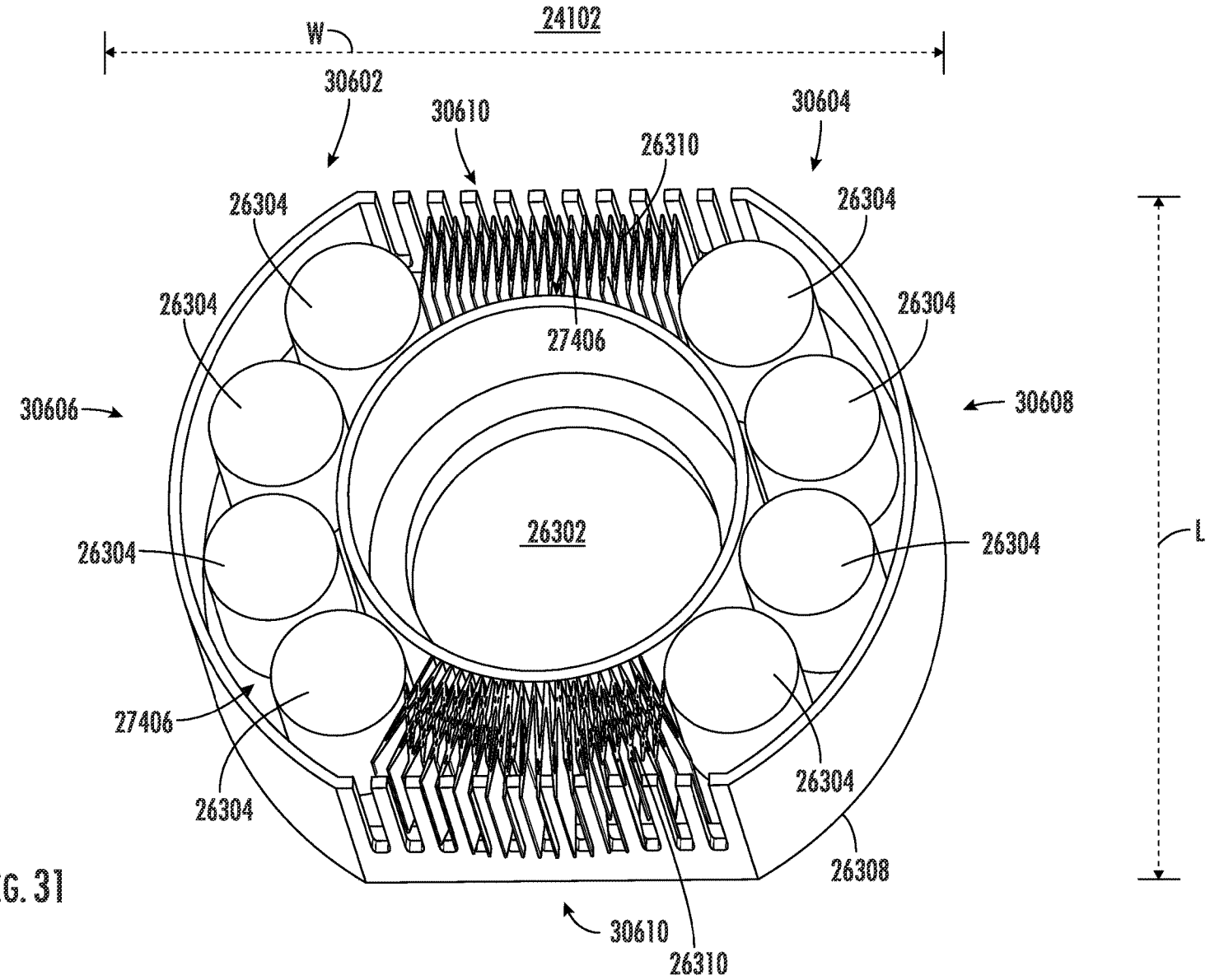
FIG. 31 shows another cross-sectional view of an arrangement of the batteries of a motor-battery assembly, consistent with embodiments of the present disclosure.

According to another embodiment, the motor-battery assembly 24102 may include batteries 26304 arranged in one or more (e.g., two or more) groups relative to the suction motor 302 as generally illustrated in the cross-sectional view of FIGS. 30 and 31. The housing 26308 may have an elongated cross-section such that the length L is greater than the width W, for example, the length L is at least 1.5 times greater than the width W and/or the length L is at least 2 times greater than the width W. A plurality of batteries 26304 may be grouped together to form a first and at least a second group or set 30602, 30604. For example, a first group 30602 may be disposed proximate a first arcuate end 30606 of the housing 26308 and a second group 30604 may be disposed proximate a second arcuate end 30608 of the housing 26308 generally opposite to the first arcuate end 30606 of the housing 26308. The motor-battery assembly 24102 may include one or more filters 26310 disposed between the groups 30602, 30604 of batteries 26304. For example, one or more filters 26310 may be disposed along one or more generally linear portions/regions 30610 of the housing 26308. The arrangement of the batteries 26304 and filters 26310 may be reversed. Additionally, the batteries 26304 may be arranged at only one end 30606, 30608 and/or along one or more generally linear portions 26310 of the housing 26308 and the filter 26310 may be arranged along only one or more generally linear portions 26310 and/or at only one end 30606, 30608 of the housing 26308. In the illustrated embodiment, the suction motor 26302 may include one or more discharge outlets 27406. The discharge outlets 27406 may discharge air directly into one or more of the filters 26310 (which may optionally be disposed in separate cavities 27402 from the suction motor 26302 and/or batteries 26304) and/or into a common cavity 27402.

Figure 32:
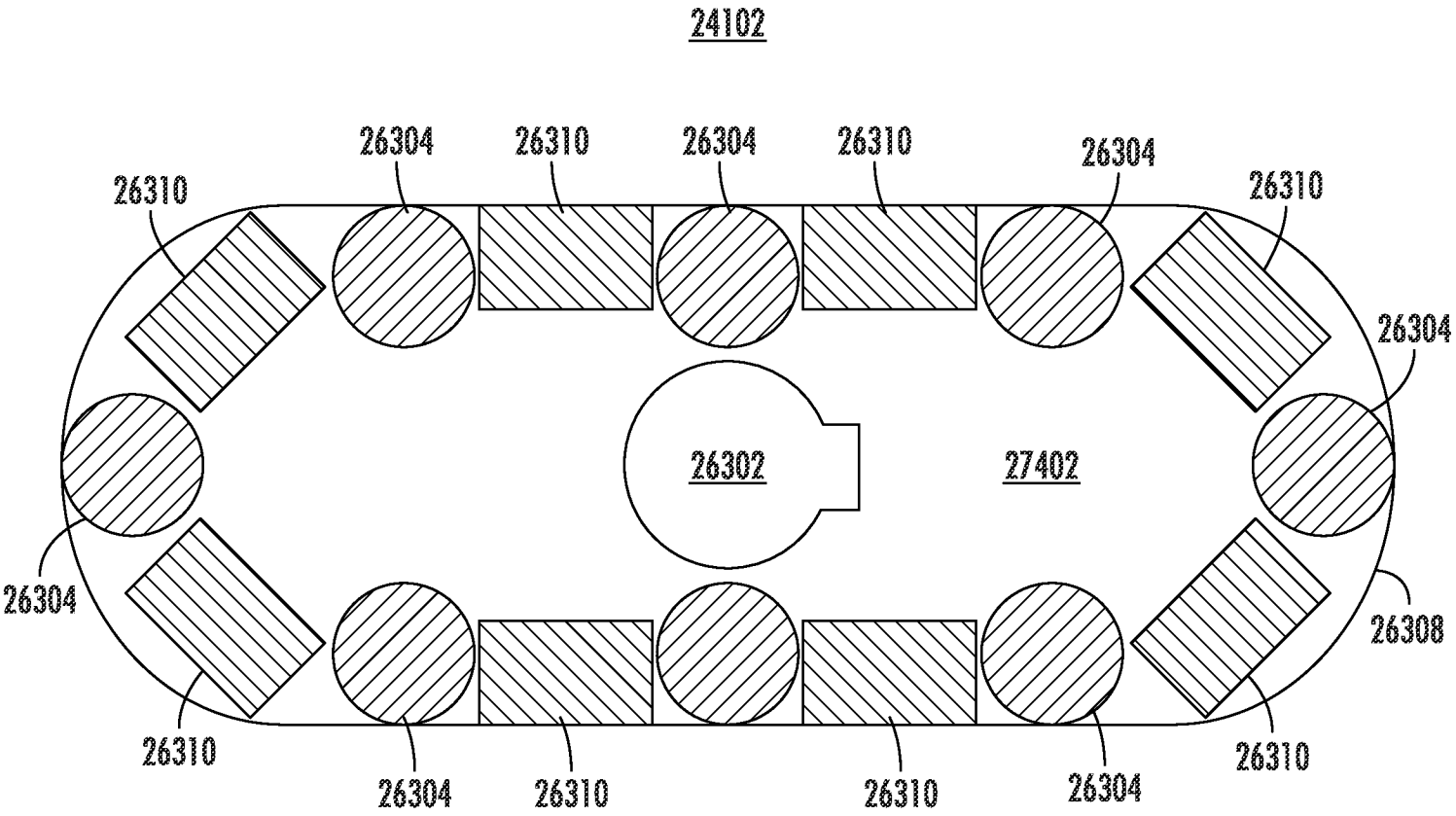
FIG. 32 shows a cross-sectional view of a further arrangement of the batteries of a motor-battery assembly, consistent with embodiments of the present disclosure.
Figure 33:
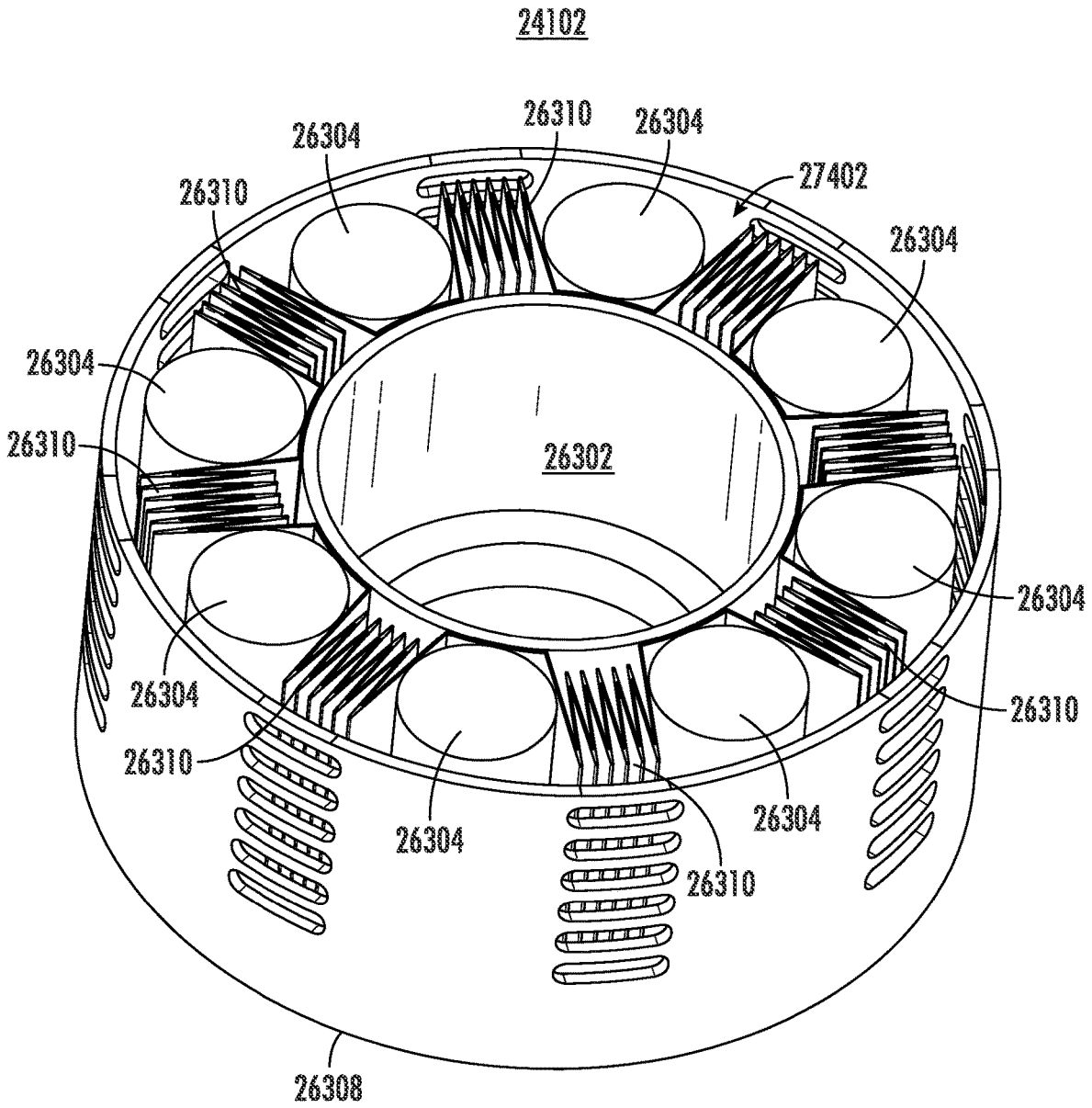
FIG. 33 shows another cross-sectional view of an arrangement of the batteries of a motor-battery assembly, consistent with embodiments of the present disclosure.

According to a further embodiment, the motor-battery assembly 24102 may include one or more batteries 26304 and filters 26310 arranged in a generally alternating pattern around the suction motor 26302 as generally illustrated in the cross-sectional view of FIGS. 32 and 33. According to one embodiment, one or more (e.g., each) of the batteries 26304 may be adjacent to two filters 26310. Alternatively (or in addition), one or more (e.g., each) of the filters 26310 may be adjacent to two batteries 26304.

Figure 34:
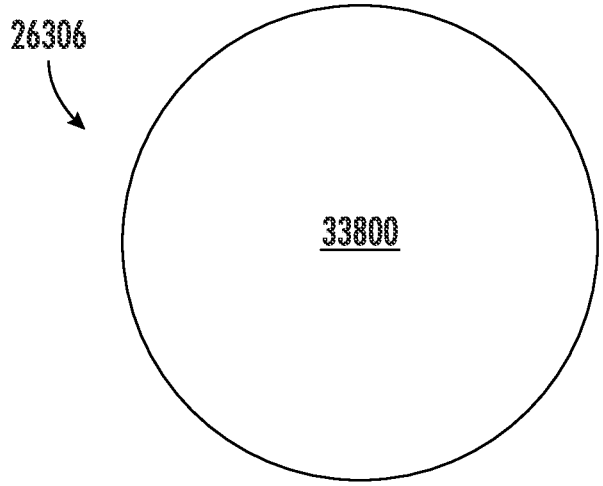
FIG. 34 shows a schematic view of one embodiment of a motor/battery controller, consistent with embodiments of the present disclosure.
Figure 35:
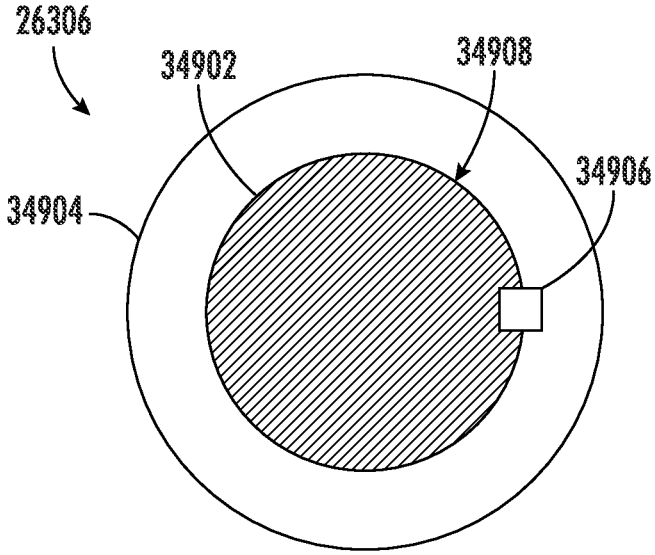
FIG. 35 shows a schematic view of another embodiment of a motor/battery controller, consistent with embodiments of the present disclosure.
Figure 36:
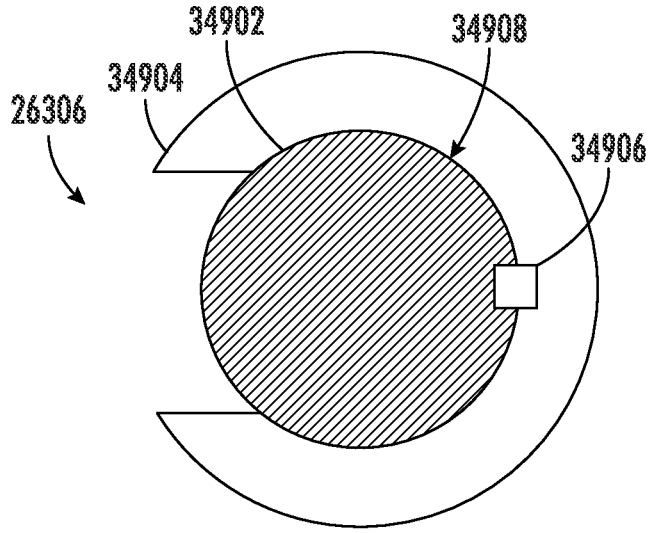
FIG. 36 shows a schematic view of a further embodiment of a motor/battery controller, consistent with embodiments of the present disclosure.

As discussed herein, the motor-battery assembly 24102 may include one or more motor/battery controllers 26306. FIGS. 34-36 generally illustrate various embodiments of the motor/battery controllers 26306. According to one embodiment, both the suction motor and battery controllers may be integrated into a single controller 33800. As may be appreciated, integrating both the suction motor controller and the battery controller into a single controller (e.g., but not limited to, a single printed circuit board) may reduce and/or eliminate the wiring needed for the vacuum cleaner 24100, thereby reducing manufacturing costs. In addition, integrating both the suction motor controller and the battery controller into a single controller may further reduce manufacturing costs by eliminating the need to install two separate controllers in the vacuum cleaner 24100. Finally, integrating both the suction motor controller and the battery controller into a single controller may reduce the overall size of the vacuum cleaner 24100 and provide greater design flexibility (e.g., allowing the designer to create a more pleasant aesthetic design).

According to another embodiment, the motor-battery assembly 24102 may include separate suction motor controller 34902 and battery controller 34904 as generally illustrated in FIG. 35. The separate suction motor controller 34902 and battery controller 34904 may be substantially coplanar with each other when installed in the motor-battery assembly 24102 or at least with substantially parallel planes as might be the case with electrical connectors. As used herein, the suction motor controller 34902 and battery controller 34904 are considered to be substantially coplanar when a separation distance between the upper and/or lower surfaces of the suction motor controller 34902 and battery controller 34904 is within 15% of the thickness of the thickest controller 34902, 34904. In the illustrated embodiment, at least a portion of the suction motor controller 34902 generally abuts against at least a portion of the battery controller 34904; however, it should be appreciated that there may be a gap between the suction motor controller 34902 and the battery controller 34904. Optionally one or more electrical and/or mechanical connectors 34906 may be provided to electrically and/or mechanically couple the suction motor controller 34902 to the battery controller 34904. One or more of the controller 34902, 34904 may be at least partially disposed within a cavity 34908 formed by the other controller 34902, 34904 as generally illustrated in FIGS. 35 and 36. In the illustrated embodiments, the battery controller 34904 forms a cavity 34908 that partially receives the suction motor controller 34902; however, it should be appreciated that the suction motor controller 34902 may form a cavity that at least partially receives the battery controller 34904.

Figure 37:
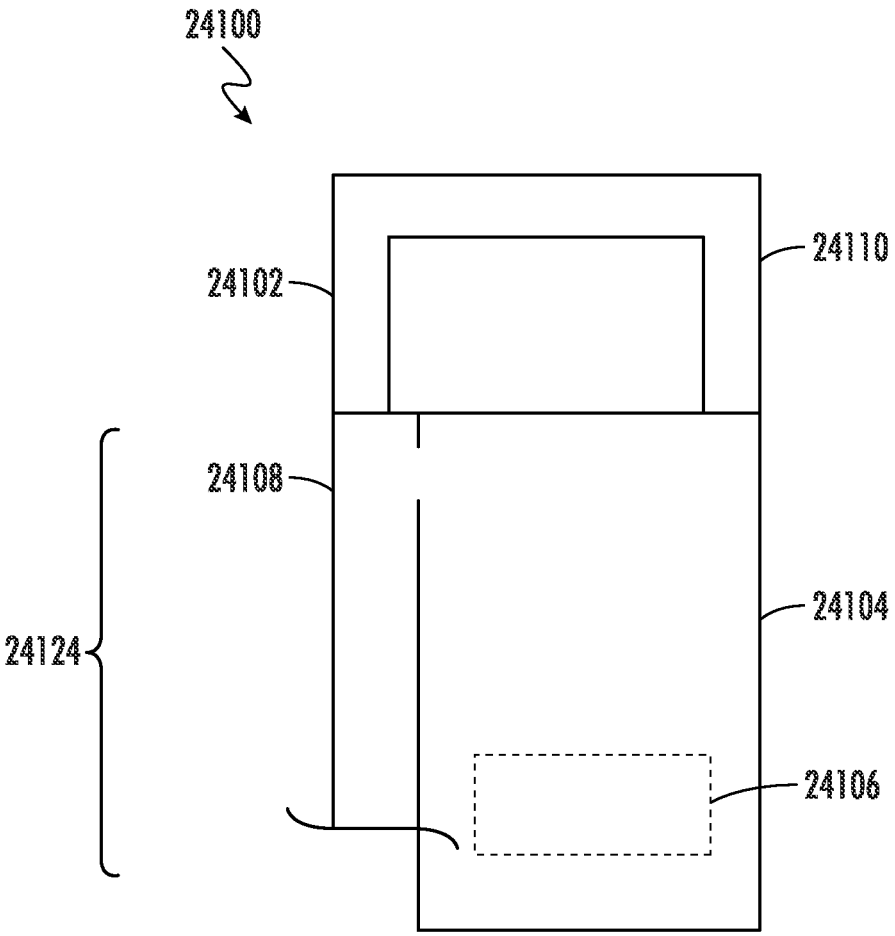
FIG. 37 shows a schematic view of a motor-battery assembly disconnected from a vacuum cleaner, consistent with embodiments of the present disclosure.
Figure 37:
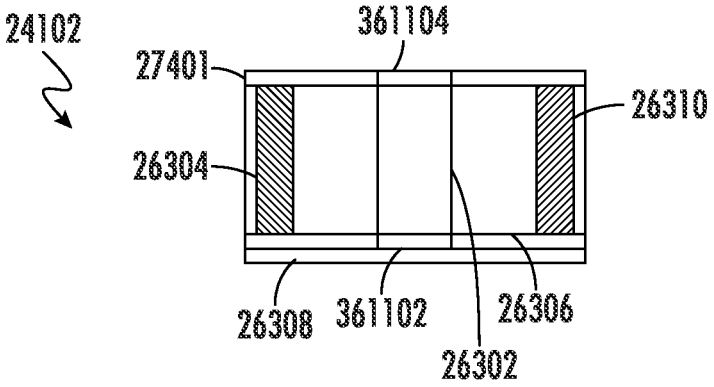

Turning now to FIG. 37, a cross-sectional view of another embodiment of the motor-battery assembly 24102 that is configured to be removably coupled to the vacuum cleaner 24100. The motor-battery assembly 24102 includes one or more suction motors 26302, one or more batteries 26304, and one or more motor/battery controllers 26306 at least partially disposed within a housing 26308. The motor-battery assembly 24102 and/or the main body 24124 of the vacuum cleaner 24100 may also optionally include one or more filters 26310 and/or one or more interlocks 361102. The interlocks 361102 may be configured to generally prevent the suction motor 26302 from being powered unless the motor-battery assembly 24102 is coupled to the vacuum cleaner 24100 (e.g., coupled to the debris compartment 24104). The interlocks 361102 may include mechanical interlocks, optical interlocks, magnetic interlocks, shaped-based interlocks, switches, or the like. Additionally (or alternatively), the motor-battery assembly 24102 may include a screen, grating, or the like 361104 extending over at least a portion of the passageway to the inlet of the suction motor 26302. The screen 361104 may generally prevent objects from coming into contact with the suction motor 26302, thereby preventing damage to the suction motor 26302 and/or injury to a user.

Figure 38:
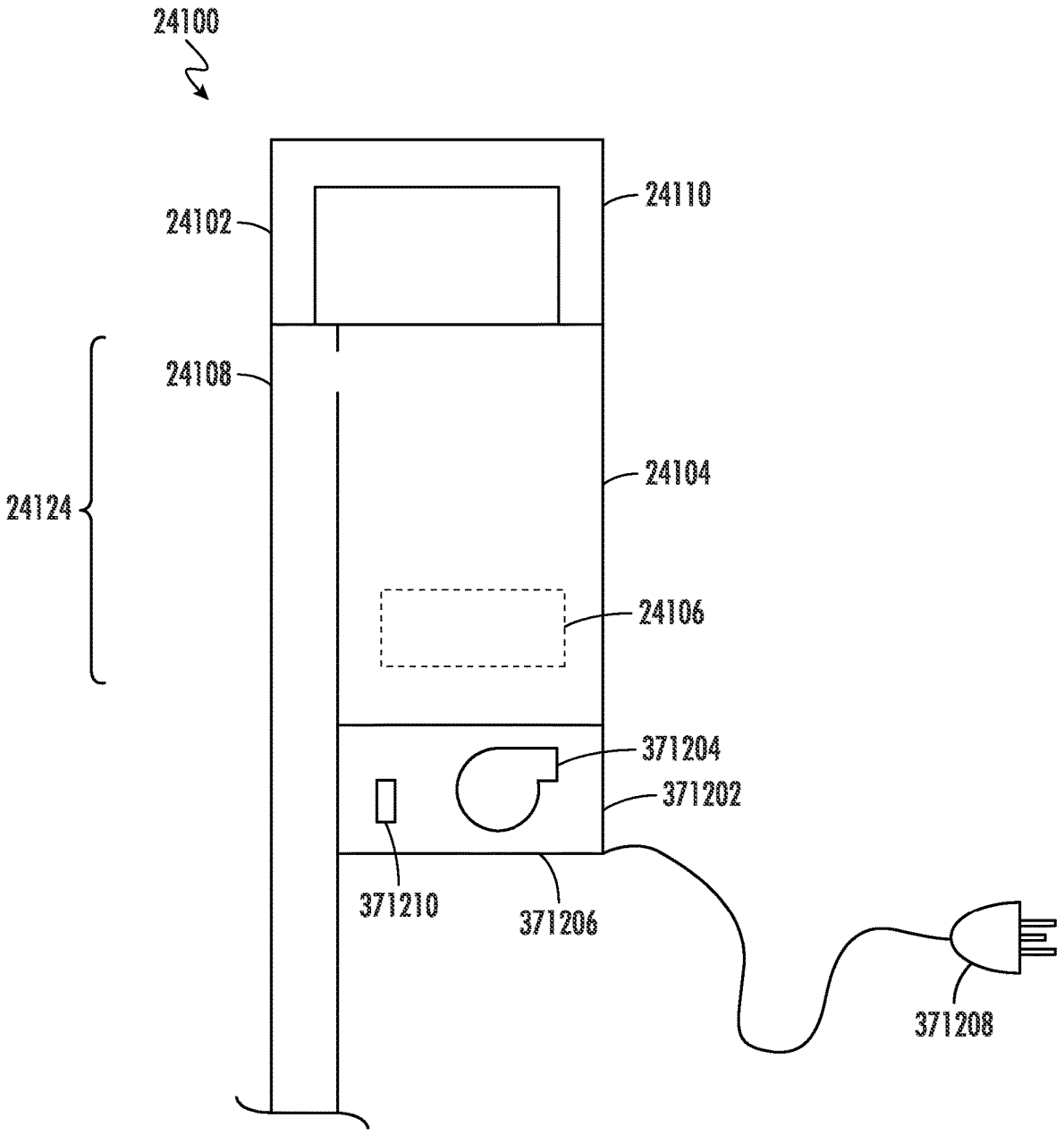
FIG. 38 shows a perspective view of one embodiment of an alternating current (AC) powered suction motor assembly removably coupled to a vacuum cleaner, consistent with embodiments of the present disclosure.
Figure 39:
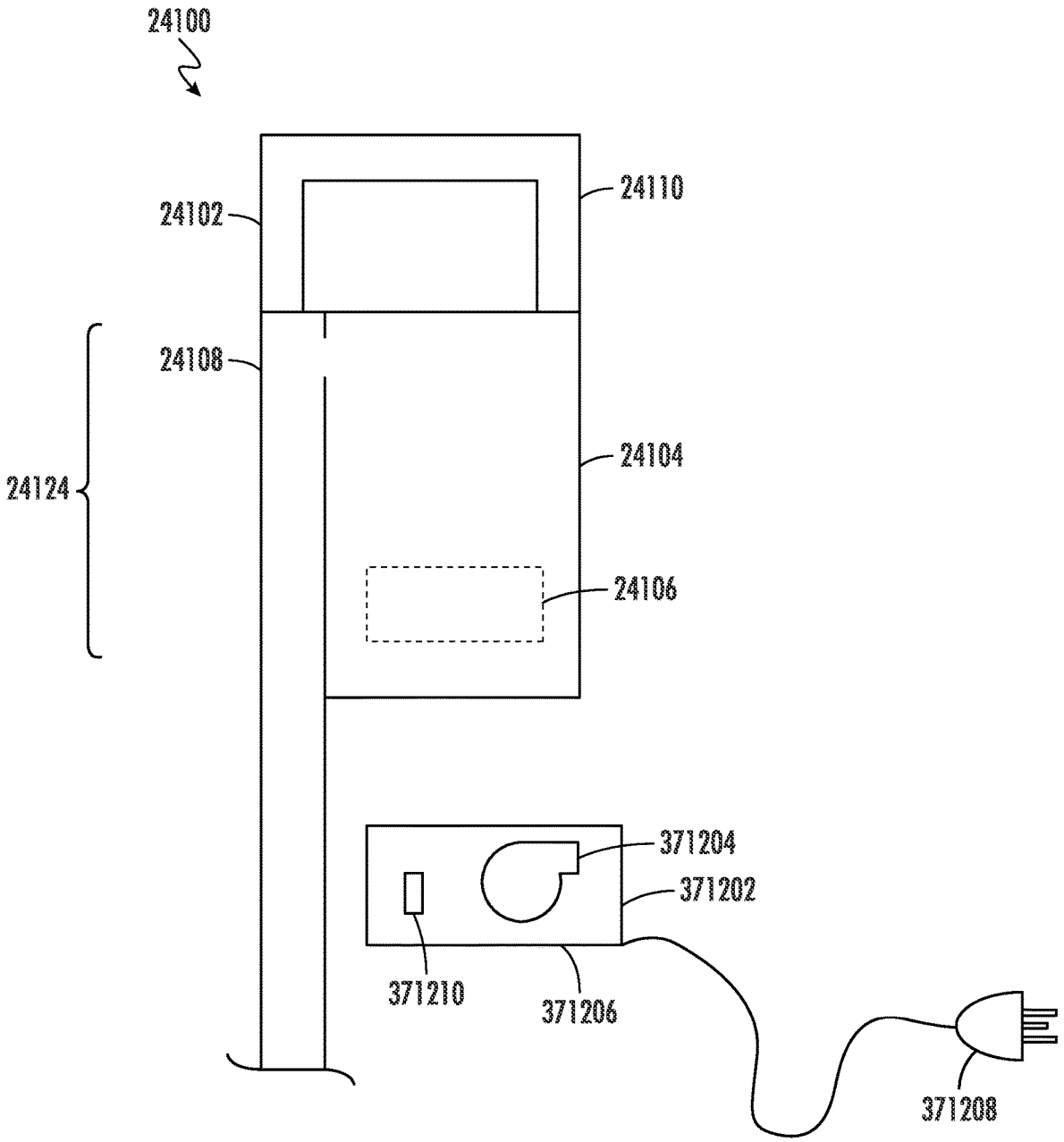
FIG. 39 shows perspective view of the AC powered suction motor assembly of FIG. 38 disconnected from the vacuum cleaner, consistent with embodiments of the present disclosure.

With reference to FIGS. 38 and 39, once the motor-battery assembly 24102 has been removed from the vacuum cleaner 24100, an AC powered suction motor assembly 371202 may be releasably coupled to the vacuum cleaner 24100 in place of the motor-battery assembly 24102. The AC powered suction motor assembly 371202 may include one or more AC powered suction motors 371204 at least partially disposed within a motor housing 371206 and an electrical cord with an electrical plug 371208 configured to be electrically coupled to an electrical outlet (not shown). The AC powered suction motor assembly 371202 may also optionally include a power switch 371210 to selectively power the suction motor 371204 and/or any other devices coupled to the vacuum cleaner 24100.

Figure 40:
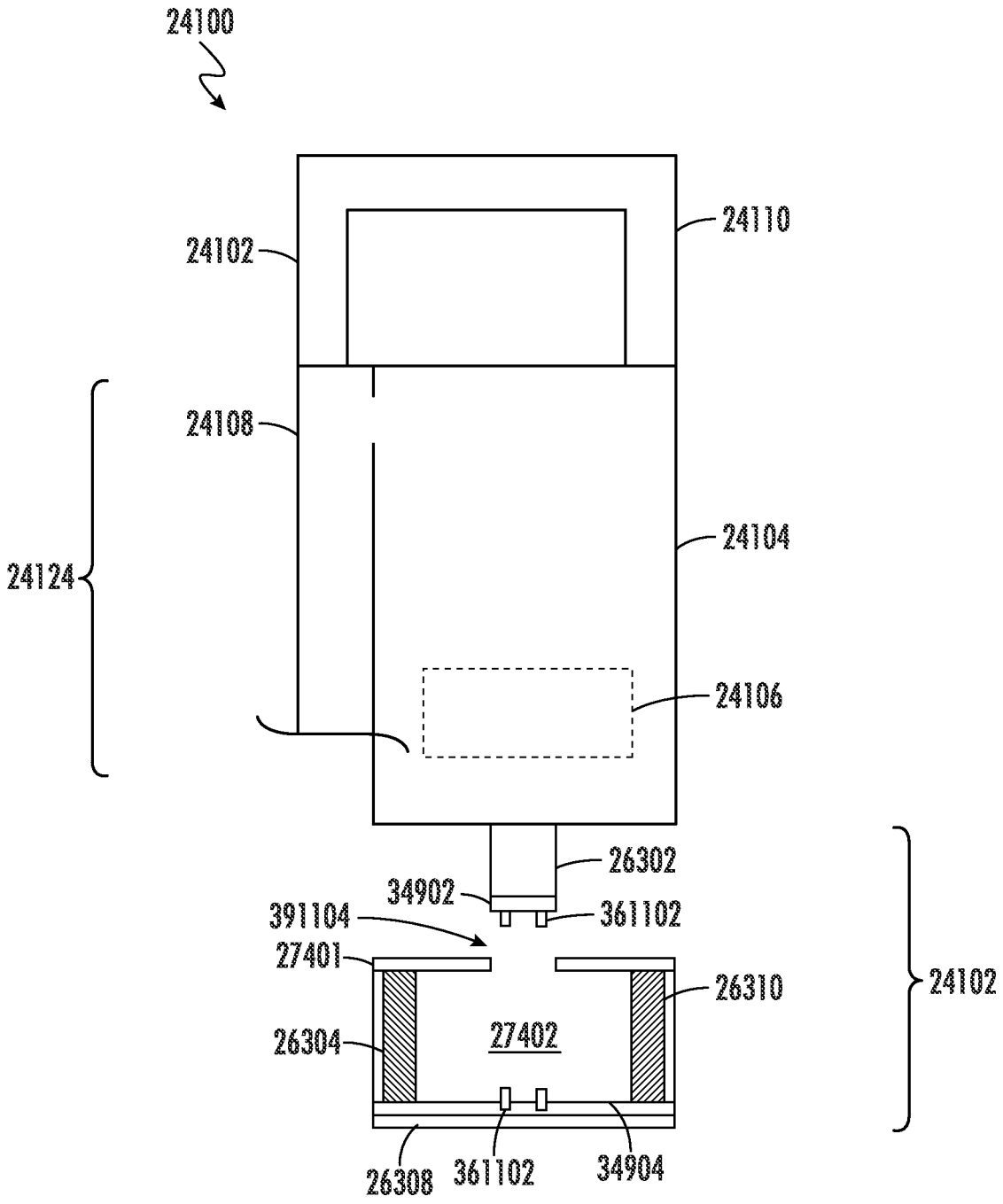
FIG. 40 shows a perspective view of one embodiment of a motor-battery assembly disconnected from a vacuum cleaner, consistent with embodiments of the present disclosure.
Figure 41:
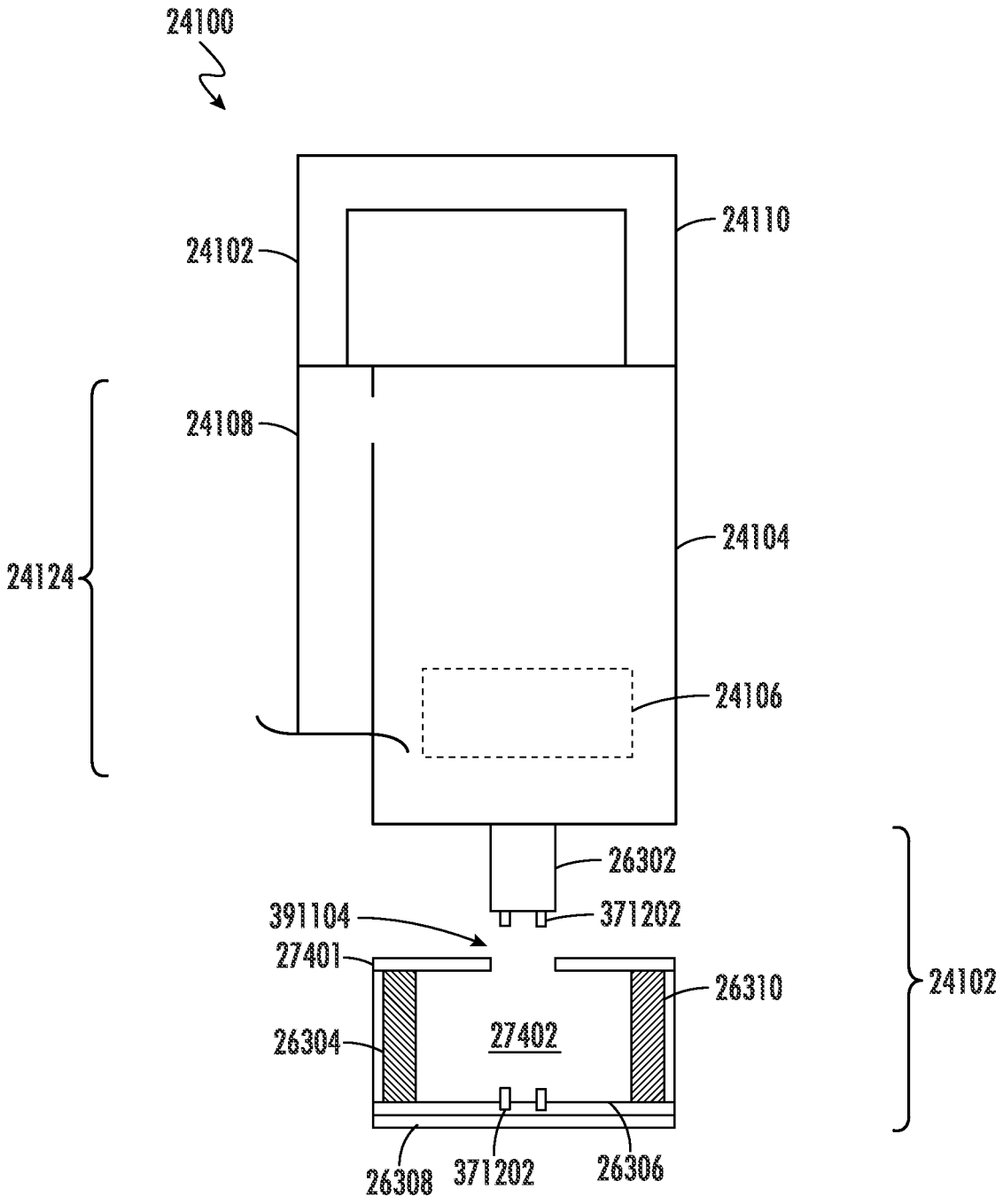
FIG. 41 shows a perspective view of another embodiment of a motor-battery assembly disconnected from a vacuum cleaner, consistent with embodiments of the present disclosure.

Turning now to FIGS. 40 and 41, cross-sectional views of further embodiments of the motor-battery assembly 24102 are generally illustrated. The motor-battery assembly 24102 may include one or more batteries 26304, one or more motor/battery controllers 26306 at least partially disposed within a housing 26308, and one or more suction motors 26302 configured to be removably coupled to the housing 26308 and/or motor/battery controllers 26306. According to one embodiment, the suction motor 26302 may be permanently coupled to the vacuum cleaner 24100 as generally illustrated in FIG. 40. For example, the suction motor 26302 may be mounted, secured, and/or otherwise coupled to main body 24124 of the vacuum cleaner 24100, e.g., but not limited to, the debris compartment 24104. The suction motor 26302 may also include one or more suction motor controllers 34902 configured to control the operation of the suction motor 26302. One or more electrical and/or mechanical connectors 361102 may be provided to electrically and/or mechanically couple the suction motor controller 34902 to the battery controller 34904. The housing 24108 may include one or more batteries 26304, a battery controller 34904, and optionally one or more filters 26310 at least partially disposed within one or more cavities 27402. At least one sidewall 27401 of the housing/body 26308 may include a motor opening 391104 configured to receive at least a portion of the suction motor 26302.

Figure 42:
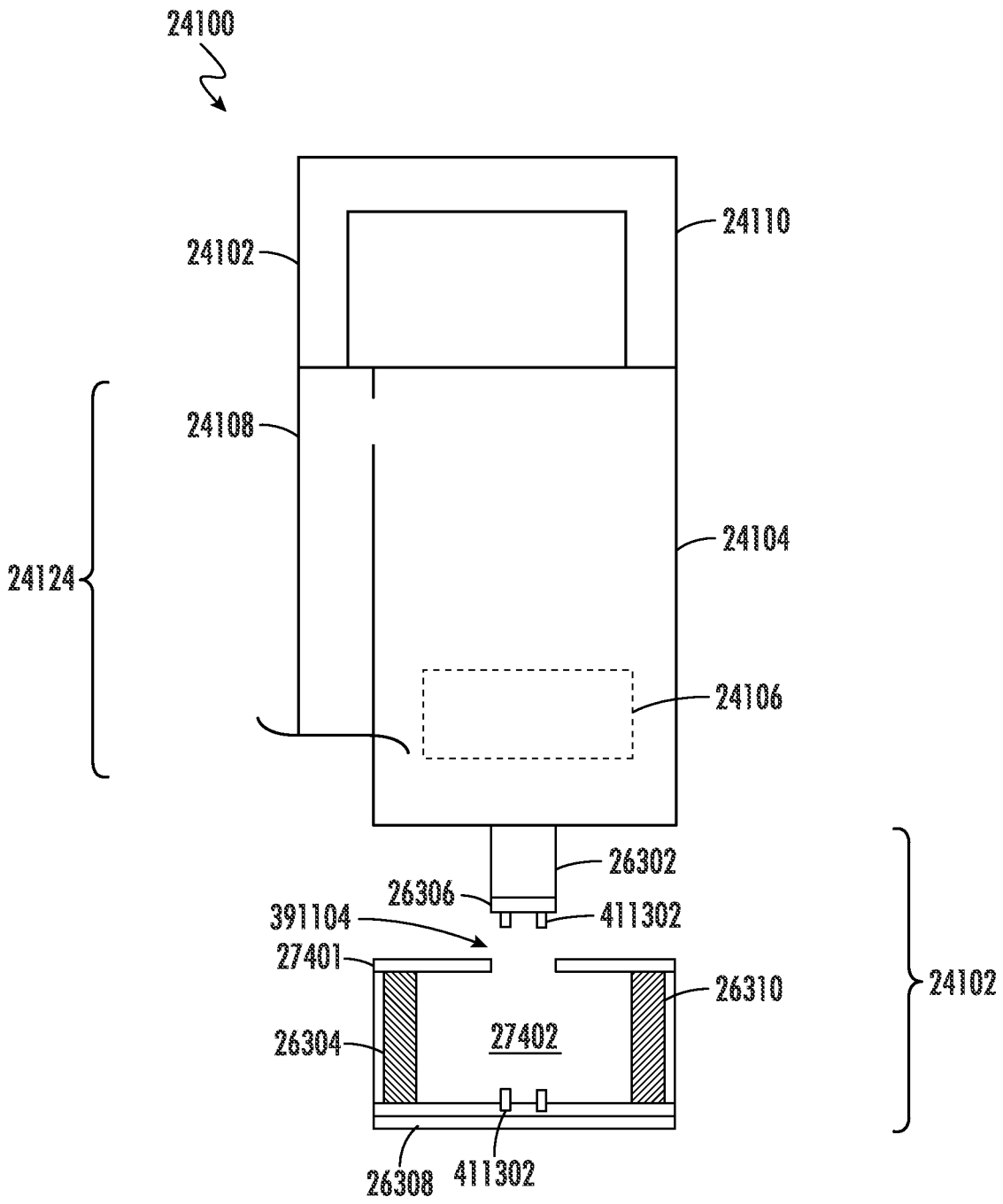
FIG. 42 shows a perspective view of a further embodiment of a motor-battery assembly disconnected from a vacuum cleaner, consistent with embodiments of the present disclosure.

Alternatively, the suction motor controllers 34902 and the battery controller 34904 may be combined into a single motor/battery controller 26306 which may be disposed within the housing 26308 as shown in FIG. 41. One or more electrical and/or mechanical connectors 371202 may be provided to electrically and/or mechanically couple the suction motor 26302 to the single motor/battery controller 26306. Alternatively, the suction motor controllers 34902 and the battery controller 34904 may be combined into a single motor/battery controller 26306 permanently coupled to the suction motor 26302 as generally illustrated in FIG. 42. One or more electrical and/or mechanical connectors 411302 may be provided to electrically and/or mechanically couple the single motor/battery controller 26306 to the batteries 26304.

Figure 43:
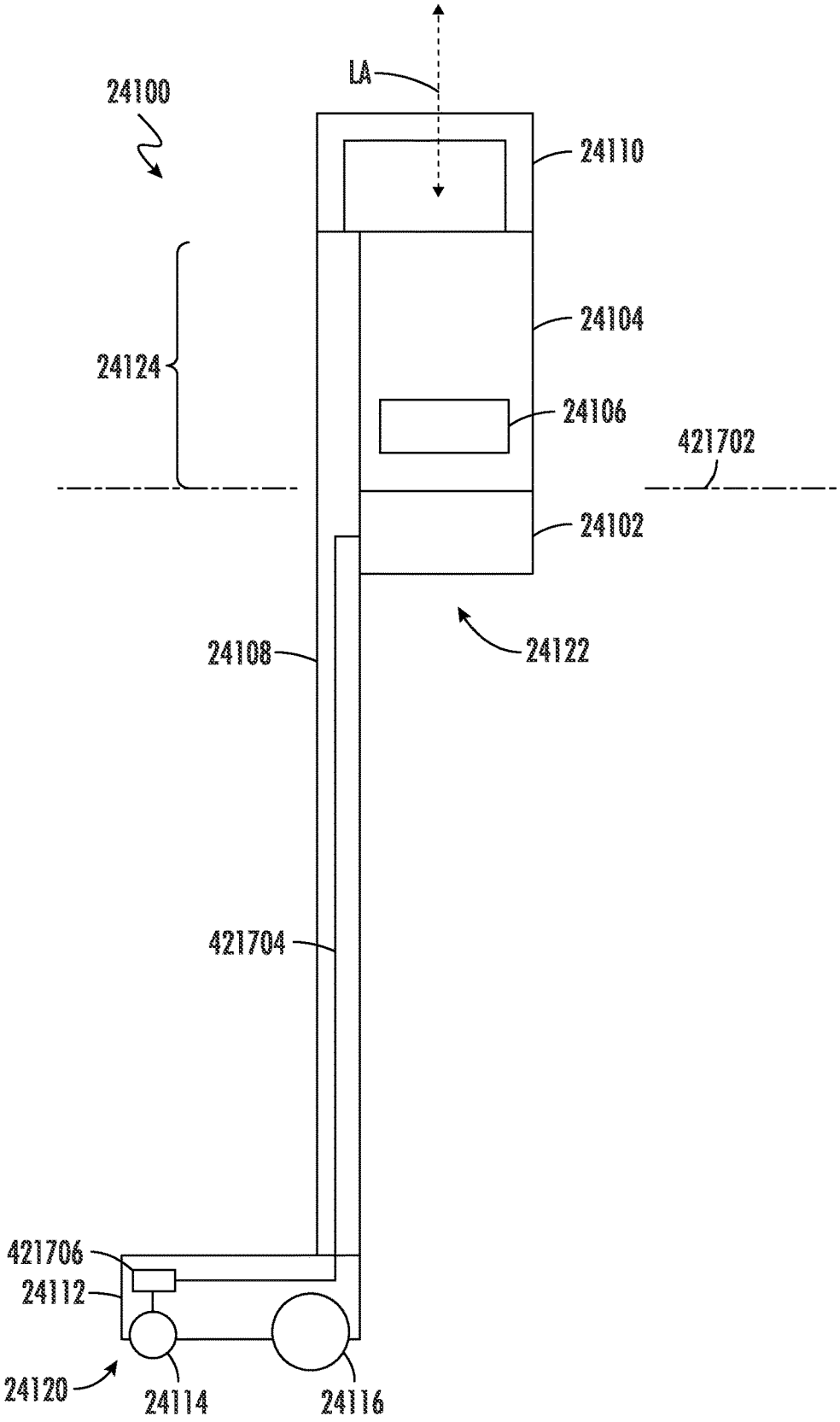
FIG. 43 shows a perspective view of one embodiment of a motor-battery assembly coupled to a vacuum cleaner, consistent with embodiments of the present disclosure.

Turning now to FIG. 43, the motor-battery assembly 24102 according to at least one embodiment of the present disclosure allows for all of the circuitry, batteries, motors, and/or wiring for the main body 24124 of the vacuum cleaner 24100 to consolidated into a single package. As a result, a designer of the vacuum cleaner 24100 may have greater freedom when arranging/designing the shapes, colors, and/or configurations of the various elements of the main body 24124 of the vacuum cleaner 24100. According to one embodiment, the main body 24124 (e.g., including the debris collector 24104) may be washable since it may not include any electrical components and/or wiring. For example, wiring in the main body 24124 of the vacuum cleaner 100 may be eliminated above the motor-battery assembly 24102, e.g., above a plane 421702 extending horizontally through the top of the motor-battery assembly 24102 when the vacuum cleaner 24100 is in an upright position in the direction towards the handle 24110. The vacuum cleaner 24100 may include wiring 421704 electrically coupled to the motor-battery assembly 24102 for providing power to one more motors 421706 for powering the agitator 24114, wheels 24116, and/or any other electrical device in the surface cleaning head 24112.

Figure 44:
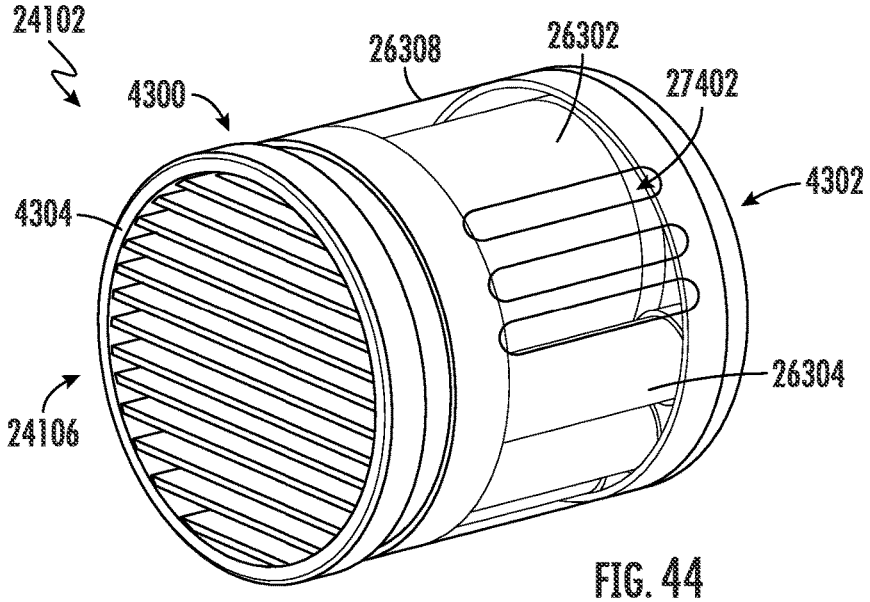
FIG. 44 shows a perspective view of a motor-battery assembly, consistent with embodiments of the present disclosure.
Figure 45:
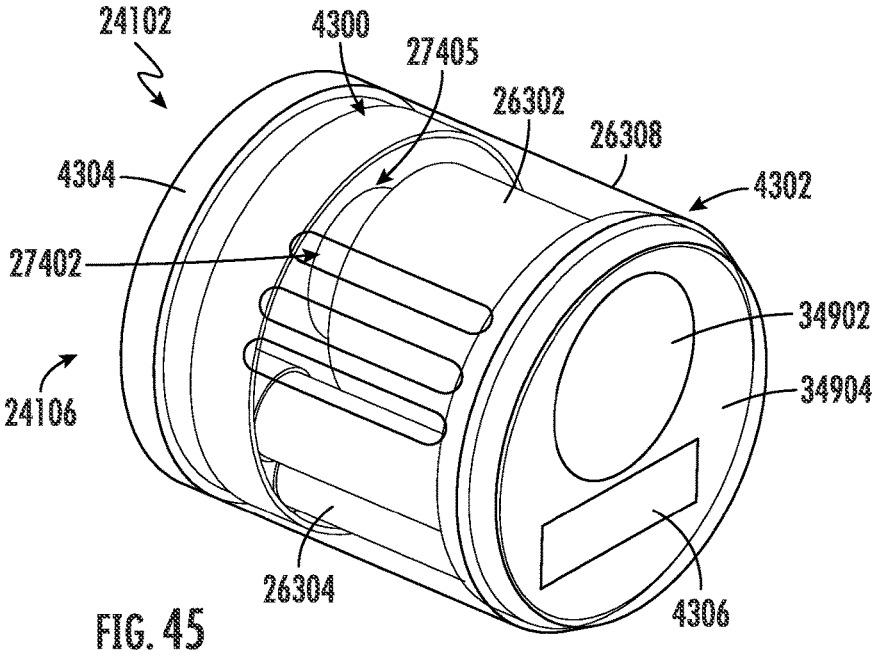
FIG. 45 shows another perspective view of the motor-battery assembly of FIG. 44, consistent with embodiments of the present disclosure.

FIGS. 44 and 45 show a further embodiment of the motor-battery assembly 24102. The cavity 27402 of the housing 26308 includes batteries 26304 and the suction motor 26302. As shown, the batteries 26304 extend at least partially around a perimeter of the suction motor 36302. The cavity 27402 extends between a first end 4300 and a second end 4302, wherein the inlet 27405 of the suction motor 36302 is positioned closer the first end 4300 than the second end 4302 of the cavity 27402. The premotor filter 24106 may extend over the first end 4300 such that air entering the suction motor 36302 passes through the premotor filter 24106 before entering the suction motor 36302. In some instances, the premotor filter 24106 may be coupled to the first end 4300. For example, the premotor filter 24106 may include a filter frame 4304, wherein at least a portion of an outer surface of the filter frame 4304 engages with at least a portion of an inner surface of the cavity 27402, forming a friction fit therebetween.

The second end 4302 of the cavity 27402 may couple to the suction motor controller 34902 and/or the battery controller 34904. In some instances, a variable switch 4306 (e.g., a slide switch) may be electrically coupled to the suction motor controller 34902 and/or the battery controller 34904. The variable switch 4306 may be configured to adjust an amount of power provided to the suction motor 36302 such that an amount suction generated may be controlled. As such a user may adjust the amount of suction based on, for example, floor type. Reducing the generated suction may improve battery life while decreasing cleaning performance and increasing the amount of suction may decrease battery life while improving cleaning performance. As such, the variable switch 4306 may generally be configured to allow a user to optimize cleaning performance and battery life for a particular cleaning situation.

Figure 46:
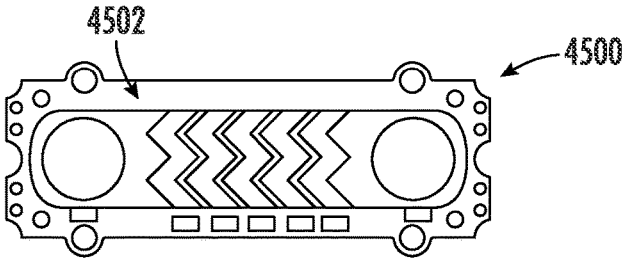
FIG. 46 shows a top view of a capacitive switch capable of being used with the motor-battery assembly of FIG. 44, consistent with embodiments of the present disclosure.

The variable switch 4306 may include a plurality of increments, wherein each increment corresponds to a different suction power. In some instances, the variable switch 4306 may generally be described as being infinitely adjustable. FIG. 46 shows a capacitive switch 4500, which may be an example of the variable switch 4306. The capacitive switch 4500 may include a sensing surface 4502 configured to sense a movement of an appendage of a user (e.g., a finger) over the sensing surface 4502. The appendage of the user may be spaced apart from the sensing surface 4502 by a predetermined detection distance. As such, a secondary touch surface may extend over the sensing surface 4502. The secondary touch surface may include a printed user interface that guides the user in the user of the capacitive switch 4500. The secondary touch surface may be at least partially transparent such that light can be emitted therefrom. For example, light may be emitted from the secondary touch surface to illuminate various portions of a static user interface printed on the secondary touch surface. The illuminated portions may indicate a suction power, a remaining battery, and/or any other status.

Circuitry associated with the variable switch 4306 (e.g., a variable switch controller) may be combined with one or more of the suction motor controller 34902 and/or the battery controller 34904. Such a combination may reduce the overall size of the motor-battery assembly 24102 and/or the cost of assembly. In instances where the suction motor controller 34902 and the battery controller 34904 are combined to form the motor/battery controller 26306, the circuitry associated with the variable switch may be combined with the motor/battery controller 26306.

Figure 47:
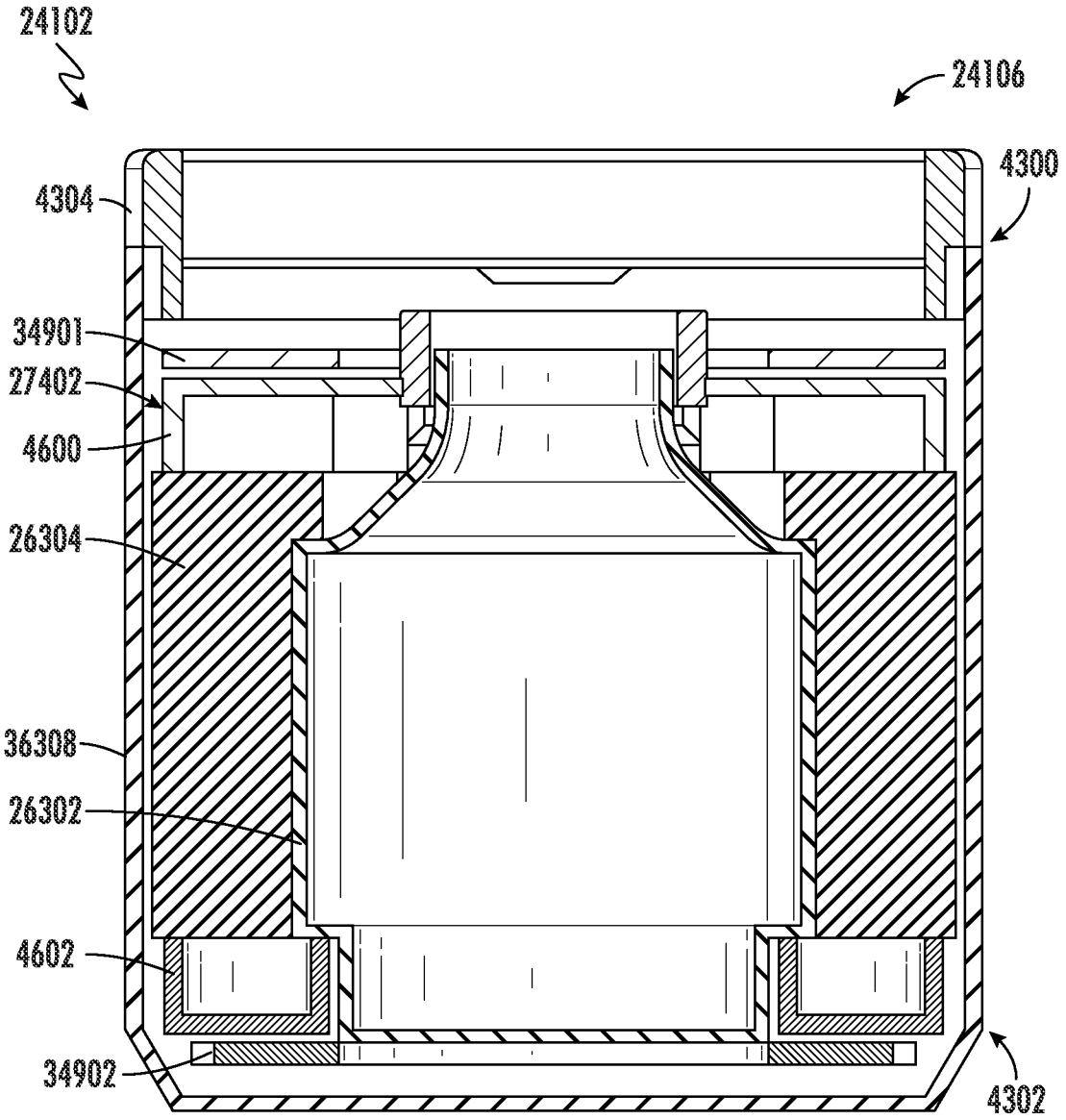
FIG. 47 shows a cross-sectional view of a motor-battery assembly, consistent with embodiments of the present disclosure.

FIG. 47 shows a further embodiment of the motor-battery assembly 24102 having the variable switch 4306. As shown, the motor-battery assembly 24102 includes the premotor filter 24106, wherein a portion of the filter frame 4304 forms a friction fit with an inner surface of the cavity 27402 of the housing 26308. The premotor filter 24106 in the illustrated embodiment may be a HEPA filter having, for example, an 80 millimeter (mm) diameter and a 10 mm thickness. The battery controller 34904 may be disposed between the premotor filter 24106 and the suction motor 26302. In other words, the battery controller 34904 may be positioned closer to the first end 4300 of the cavity 27402 than to the second end 4302. The suction motor controller 34902 and the variable switch 4306 may be positioned such that the suction motor controller 34902 and the variable switch 4306 are closer to the second end 4302 of the cavity 27402 than to the first end 4300. In other words, the suction motor controller 34902 and the variable switch 4306 may be positioned on an opposing side of the suction motor 26302 relative to the battery controller 34904.

As also shown, the batteries 26304 are disposed between a top battery frame 4600 and a bottom battery frame 4602. The top and bottom battery frames 4600 and 4602 may be configured to engage opposing ends of the batteries 26304 such that a position (e.g., a radial position) of the batteries relative to the suction motor 26302 may be maintained.

Figure 50:
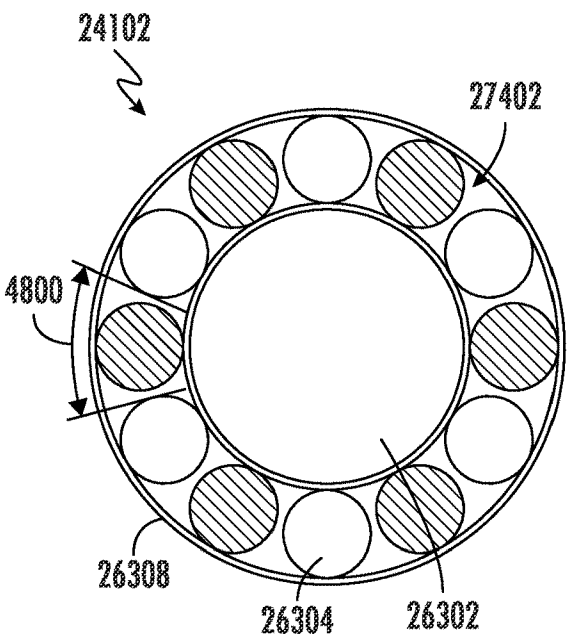
FIG. 50 shows a schematic cross-sectional view of a motor-battery assembly, consistent with embodiments of the present disclosure.
Figure 49:
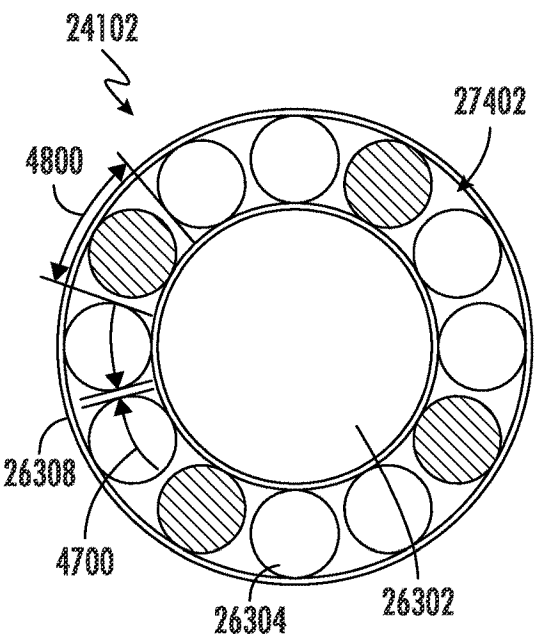
FIG. 49 shows a schematic cross-sectional view of a motor-battery assembly, consistent with embodiments of the present disclosure.
Figure 48:
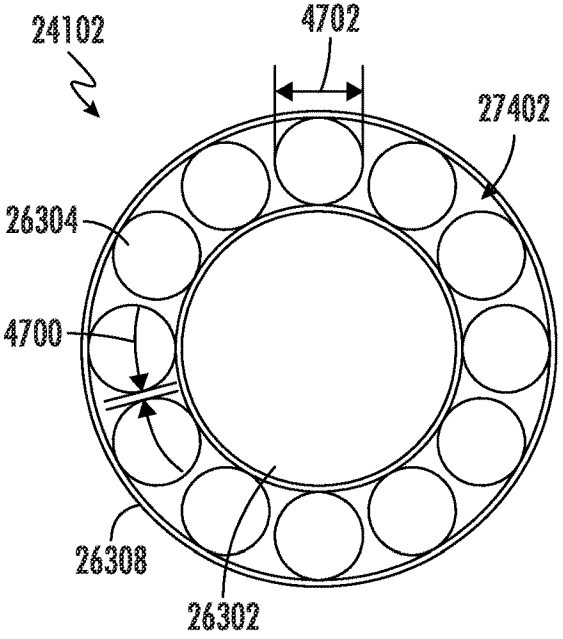
FIG. 48 shows a schematic cross-sectional view of a motor-battery assembly, consistent with embodiments of the present disclosure.

FIGS. 48-50 show various arrangements of the batteries 26304 around a perimeter of the suction motor 26302 within the housing 26308 of the motor-battery assembly 24102. As shown in FIG. 48, the batteries 26304 extend around the suction motor 26302 and are spaced apart from immediately adjacent batteries 26304 by a first battery separation distance 4700. The first battery separation distance 4700 measures less than a battery width 4702 of a corresponding one of the batteries 26304. For example, the first battery separation distance 4700 may measure less than 10% of a measure of the battery width 4702. In this example, air may be exhausted from the suction motor 26302 only from a location proximate the second end 4302 of the cavity 27402. In other words, the motor-battery assembly 24102 may only include one or more exhaust outlets 24122 at locations proximate the second end 4302 of the cavity 27402 (e.g., defined in a surface defining the second end 4302 of the cavity 27402). In some instances, air may be exhausted from the gaps defined by the first battery separation distance 4700.

As shown in FIG. 49, the batteries 26304 extend around the suction motor 26302 and are spaced apart from a first immediately adjacent battery 26304 by the first battery separation distance 4700 and are spaced apart from a second immediately adjacent battery 26304 by a second battery separation distance 4800. The second battery separation distance 4800 measures greater than the first battery separation distance 4700. For example, the second battery separation distance 4800 may measure equal to or greater than a measure of the battery width 4702. In this example, air may be exhausted from the suction motor 26302 from a location proximate the second end 4302 of the cavity 27402 (e.g., from an opening in the second end 4302 of the cavity 27402) and/or through the gaps defined by the second battery separation distance 4800. In other words, the motor-battery assembly 24102 may include one or more exhaust outlets 24122 at locations corresponding to gaps defined by the second battery separation distance 4800 and/or one or more exhaust outlets 24122 at locations proximate the second end 4302 of the cavity 27402 (e.g., defined in a surface defining the second end 4302 of the cavity 27402).

As shown in FIG. 50, the batteries 26304 extend around the suction motor 26302 and are spaced apart from immediately adjacent batteries 26304 by the second battery separation distance 4800. In this example, air may be exhausted from the suction motor 26302 only through gaps defined by the second battery separation distance 4800. In other words, the motor-battery assembly 24102 may include one or more exhaust outlets 24122 only at locations corresponding to gaps defined by the second battery separation distance 4800. Alternatively, air may be exhausted from the suction motor 26302 from a location proximate the second end 4302 of the cavity 27402 (e.g., from an opening in the second end 4302 of the cavity 27402) and through the gaps defined by the second battery separation distance 4800. In other words, the motor-battery assembly 24102 may include one or more exhaust outlets 24122 at locations corresponding to gaps defined by the second battery separation distance 4800 and one or more exhaust outlets 24122 at locations proximate the second end 4302 of the cavity 27402 (e.g., defined in a surface defining the second end 4302 of the cavity 27402). Alternatively, air may be exhausted from the suction motor 26302 only from a location proximate the second end 4302 of the cavity 27402. In other words, the motor-battery assembly 24102 may only include one or more exhaust outlets 24122 at locations proximate the second end 4302 of the cavity 27402 (e.g., defined in a surface defining the second end 4302 of the cavity 27402).

Figure 53:
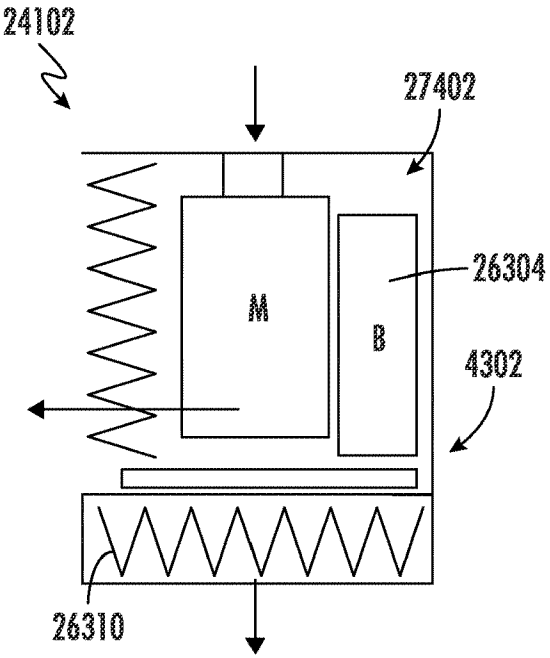
FIG. 53 shows a schematic cross-sectional example of a motor-battery assembly, consistent with embodiments of the present disclosure.
Figure 52:
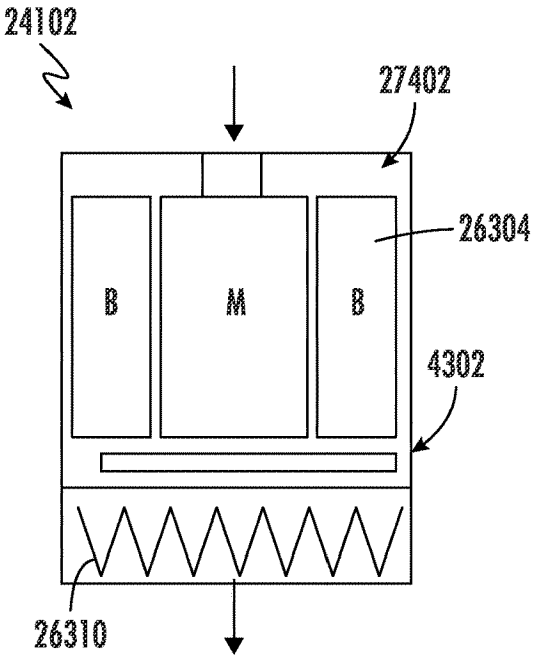
FIG. 52 shows a schematic cross-sectional example of a motor-battery assembly, consistent with embodiments of the present disclosure.
Figure 51:
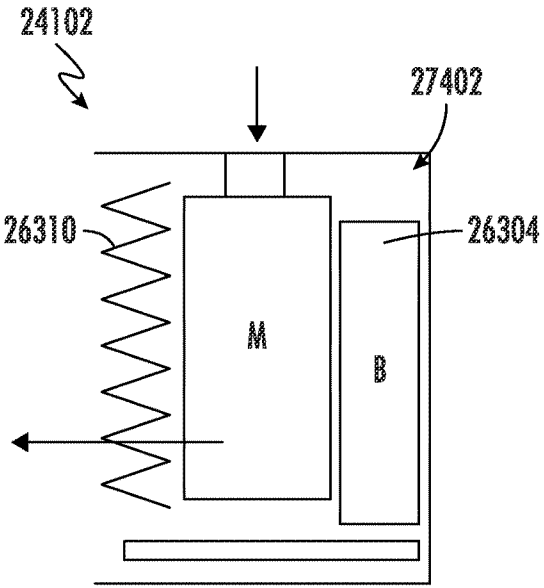
FIG. 51 shows a schematic cross-sectional example of a motor-battery assembly, consistent with embodiments of the present disclosure.

The post-motor filter 26310 can be disposed within the airflow path at location between the discharge outlet 27406 and the exhaust outlet 24122. As such, air exhausted from the motor-battery assembly 24102 passes through the post-motor filter 26310 before entering a surrounding environment. FIG. 51 shows a schematic example of the motor-battery assembly 24102 having one or more post-motor filters 26310, each extending within respective gaps defined by the separation distance between batteries 26304. FIG. 52 shows a schematic example of the motor-battery assembly 24102 having one or more post-motor filters 26310 proximate the second end 4302 of the cavity 27402. FIG. 53 shows a schematic example of the motor-battery assembly 24102 having one or more post-motor filters 26310 proximate the second end 4302 of the cavity 27402 and one or more post-motor filters 26310 extending within respective gaps defined by the separation distance between batteries 26304.

An example of a system, consistent with the present disclosure, may include a motor-battery assembly. The motor-battery assembly may include a housing defining one or more cavities, a suction motor configured to be fluidly coupled to a debris compartment of a vacuum cleaner for generating air flow through the vacuum cleaner for entraining debris, one or more batteries at least partially disposed within at least one of the one or more cavities, and a motor/battery controller at least partially disposed within at least one of the one or more cavities, the motor/battery controller configured to control power provided to the suction motor and to regulate charging and/or discharging of the one or more batteries.

In some instances, the suction motor may be at least partially disposed within at least one of the one or more cavities. In some instances, the suction motor may be removably coupled to the motor-battery assembly. In some instances, the suction motor may be permanently coupled to the motor-battery assembly. In some instances, the motor/battery controller may include a suction motor controller configured to control power provided to the suction motor and a separate battery controller configured to regulate charging and/or discharging of the one or more batteries. In some instances, the suction motor controller may be permanently disposed within at least one of the one or more cavities. In some instances, the suction motor controller may be permanently coupled to the suction motor. In some instances, the suction motor controller may be removably coupled to at least one of the one or more cavities. In some instances, the motor/battery controller may include a signal controller configured to control power provided to the suction motor and to regulate charging and/or discharging of the one or more batteries. In some instances, the motor-battery assembly may further include at least one filter. In some instances, the at least one filter may be at least partially disposed within at least one of the one or more cavities. In some instances, the system may further include an AC powered suction motor assembly including one or more AC powered suction motors at least partially disposed within a motor housing and an electrical cord with an electrical plug configured to be electrically coupled to an electrical outlet.

An example of a motor-battery assembly, consistent with the present disclosure, may include a housing defining one or more cavities, a suction motor disposed at least partially within at least one of the one or more cavities, a plurality of batteries disposed at least partially within the housing and extending around a perimeter of the suction motor, and a motor/battery controller at least partially disposed within at least one of the one or more cavities, the motor/battery controller configured to control power provided to the suction motor and to regulate charging and/or discharging of the one or more batteries.

In some instances, the plurality of batteries may be separated from immediately adjacent batteries by a separation distance measuring less than a battery width of a corresponding one of the plurality of batteries. In some instances, each of the plurality of batteries may be separated from a first immediately adjacent battery by a first separation distance and from a second immediately adjacent battery by a second separation distance, the second separation distance measuring greater than the first separation distance. In some instances, the plurality of batteries may be separated from immediately adjacent batteries by a separation distance measuring equal to or greater than a battery width of a corresponding one of the plurality of batteries. In some instances, the motor/battery controller may include a variable switch configured to adjust an amount of suction generated by the suction motor and a signal controller configured to control power provided to the suction motor and to regulate charging and/or discharging of the plurality of batteries.

An example of a vacuum cleaner, consistent with the present disclosure, may include a surface cleaning head, a dust cup fluidly coupled to the surface cleaning head, and a motor-battery assembly. The motor-battery assembly may include a housing defining one or more cavities, a suction motor configured to be fluidly coupled to the dust cup of a vacuum cleaner for generating air flow through the vacuum cleaner for entraining debris, one or more batteries at least partially disposed within at least one of the one or more cavities, and a motor/battery controller at least partially disposed within at least one of the one or more cavities, the motor/battery controller configured to control power provided to the suction motor and to regulate charging and/or discharging of the one or more batteries.

In some instances, the motor/battery controller may include a variable switch configured to adjust an amount of suction generated by the suction motor. In some instances, the motor/battery controller may include a signal controller configured to control power provided to the suction motor and to regulate charging and/or discharging of the one or more batteries.

While the principles of the invention have been described herein, it is to be understood by those skilled in the art that this description is made only by way of example and not as a limitation as to the scope of the invention. Other embodiments are contemplated within the scope of the present invention in addition to the exemplary embodiments shown and described herein. Modifications and substitutions by one of ordinary skill in the art are considered to be within the scope of the present invention, which is not to be limited except by the following claims.

What is claimed is:

1. A system comprising:

a vacuum cleaner having a main body;

a motor-battery assembly configured to removably couple to the main body of the vacuum cleaner, the motor-battery assembly comprising:

a motor-battery housing defining one or more cavities;

a motor-battery assembly suction motor configured to be fluidly coupled to a debris compartment of the vacuum cleaner for generating air flow through the vacuum cleaner for entraining debris, the motor-battery assembly suction motor at least partially disposed within at least one of the one or more cavities;

one or more batteries at least partially disposed within at least one of the one or more cavities; and a motor/battery controller at least partially disposed within at least one of the one or more cavities, the motor/battery controller configured to control power provided to the motor-battery assembly suction motor and to regulate charging and/or discharging of the one or more batteries;

an alternating current (AC) powered suction motor assembly configured to removably couple to the main body of the vacuum cleaner, the AC powered suction motor assembly comprising:

one or more AC powered suction motors at least partially disposed within an AC motor housing; and an electrical cord with an electrical plug configured to be electrically coupled to an electrical outlet;

wherein only one of the AC powered suction motor assembly or the motor-battery assembly is coupled to the main body at a time; and one or more interlocks configured to prevent the motor-battery assembly suction motor from being powered unless the motor-battery assembly is coupled to the main body.

2. The system of claim 1, wherein the motor-battery assembly suction motor is removably coupled to the motor-battery assembly.

3. The system of claim 1, wherein the motor-battery assembly suction motor is permanently coupled to the motor-battery assembly.

4. The system of claim 1, wherein the motor/battery controller includes a suction motor controller configured to control power provided to the motor-battery assembly suction motor and a separate battery controller configured to regulate charging and/or discharging of the one or more batteries.

5. The system of claim 4, wherein the suction motor controller is permanently disposed within at least one of the one or more cavities.

6. The system of claim 4, wherein the suction motor controller is permanently coupled to the motor-battery assembly suction motor.

7. The system of claim 4, wherein the suction motor controller is removably coupled to at least one of the one or more cavities.

8. The system of claim 1, wherein the motor/battery controller includes a signal controller configured to control power provided to the motor-battery assembly suction motor and to regulate charging and/or discharging of the one or more batteries.

9. The system of claim 1, wherein the motor-battery assembly further comprises at least one filter.

10. The system of claim 1, wherein the at least one filter is at least partially disposed within at least one of the one or more cavities.

11. The system of claim 1, wherein:

the one or more batteries includes a plurality of batteries disposed at least partially within at least one of the one or more cavities and extending around a perimeter of the motor-battery assembly suction motor; and the motor/battery controller includes a switch configured to receive a user input to provide power to the motor-battery assembly suction motor.

12. The system of claim 11, wherein the plurality of batteries are separated from immediately adjacent batteries by a separation distance measuring less than a battery width of a corresponding one of the plurality of batteries.

13. The system of claim 11, wherein each of the plurality of batteries are separated from a first immediately adjacent battery by a first separation distance and from a second immediately adjacent battery by a second separation distance, the second separation distance measuring greater than the first separation distance.

14. The system of claim 11, wherein the plurality of batteries are separated from immediately adjacent batteries by a separation distance measuring equal to or greater than a battery width of a corresponding one of the plurality of batteries.

15. The system of claim 11, wherein the switch is a variable switch configured to adjust an amount of suction generated by the suction motor.

* * * * *